US005600363A

United States Patent [19]

Anzaki et al.

[11] Patent Number: 5,600,363

[45] Date of Patent: Feb. 4, 1997

[54] IMAGE FORMING APPARATUS HAVING DRIVING MEANS AT EACH END OF ARRAY AND POWER FEEDING SUBSTRATE OUTSIDE HEAD HOUSING

[75] Inventors: Toshihiro Anzaki, Kokubu; Yasuo Nishiguchi, Kyoto; Moriyuki Arai, Tokyo; Shunji Murano; Sadayuki Orito, both of Aira-gun; Yuuji Kurazono, Kokubu, all of Japan

[73] Assignee: Kyocera Corporation, Kyoto, Japan

[21] Appl. No.: 148,522

[22] Filed: Nov. 3, 1993

Related U.S. Application Data

[63] Continuation of Ser. No. 422,543, Oct. 18, 1989, abandoned.

[30] Foreign Application Priority Data

| | | | |
|---|---|---|---|
| Dec. 28, 1988 | [JP] | Japan | 1-145738 |
| Dec. 28, 1988 | [JP] | Japan | 63-335133 |
| May 31, 1989 | [JP] | Japan | 1-140116 |
| Jul. 8, 1989 | [JP] | Japan | 1-176660 |
| Sep. 21, 1989 | [JP] | Japan | 1-246851 |

[51] Int. Cl.[6] ..... B41T 2/447; B41T 2/435

[52] U.S. Cl. ..... 347/237; 347/238; 347/130; 347/132

[58] Field of Search ..... 370/113; 345/55, 345/82, 204; 347/145, 237, 238, 130, 132, 180, 181, 182, 13, 211

[56] References Cited

U.S. PATENT DOCUMENTS

| | | | |
|---|---|---|---|
| 3,021,387 | 2/1962 | Rajchman | 178/7.3 |
| 3,512,158 | 5/1970 | Scarbrough | 346/76 |
| 3,740,570 | 6/1973 | Kaelin et al. | 307/40 |
| 3,832,488 | 8/1974 | Fahey et al. | 178/15 |
| 3,988,742 | 10/1976 | Meier et al. | 346/107 |
| 4,074,319 | 2/1978 | Goldschmidt et al. | 358/230 |
| 4,074,320 | 2/1978 | Kapes, Jr. | 358/230 |
| 4,141,018 | 2/1979 | Mizuguchi et al. | 346/154 X |
| 4,181,912 | 1/1980 | Satake | 346/154 |
| 4,455,562 | 6/1984 | Dolan et al. | 346/154 |
| 4,455,578 | 6/1984 | Fearnaide | 358/302 |
| 4,524,372 | 7/1985 | De Cock et al. | 346/160 |
| 4,689,694 | 8/1987 | Yoshida | 346/107 R X |
| 4,706,130 | 11/1987 | Yamakawa | 346/154 X |
| 4,780,730 | 10/1988 | Dodge et al. | 346/108 |
| 4,807,047 | 2/1989 | Sato et al. | 346/107 R X |
| 4,916,464 | 4/1990 | Ito et al. | 347/237 |

FOREIGN PATENT DOCUMENTS

| | | |
|---|---|---|
| 59-2627 | 1/1984 | Japan . |
| 60-34023 | 2/1985 | Japan . |
| 1210360 | 8/1989 | Japan . |

*Primary Examiner*—Benjamin R. Fuller
*Assistant Examiner*—David Yockey
*Attorney, Agent, or Firm*—Loeb & Loeb LLP

[57] ABSTRACT

An optical print head in an image forming apparatus includes linearly arranged blocks and integrated circuits for driving disposed at one or both ends of the line of blocks. Each of the blocks includes a plurality of light emitting diodes. Positionally corresponding light emitting diodes in each block are connected to one of a plurality of meandering individual signal lines which are connected to the integrated circuits and each block is further connected to a corresponding common signal electrode to which power is selectively applied, thereby making possible illumination and drive of light emitting diodes in each block. The head may include a housing containing the blocks, individual signal lines and common signal electrodes and further include a flexible substrate located outside of the housing connected to and supplying power to the common signal electrodes.

2 Claims, 57 Drawing Sheets

Fig. 21(1) CK
Fig. 21(2) DA
Fig. 21(3) $\overline{LT}$
Fig. 21(4) $\overline{ENB}$
Fig. 21(5) Vk1
Fig. 21(6) Vk2
Fig. 21(7) Vk3

Fig. 34 (1)
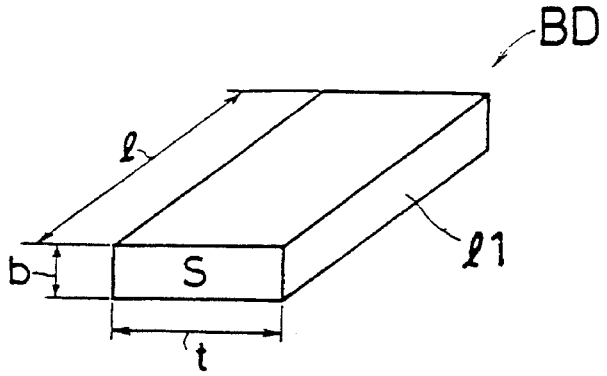
Fig. 34 (2)
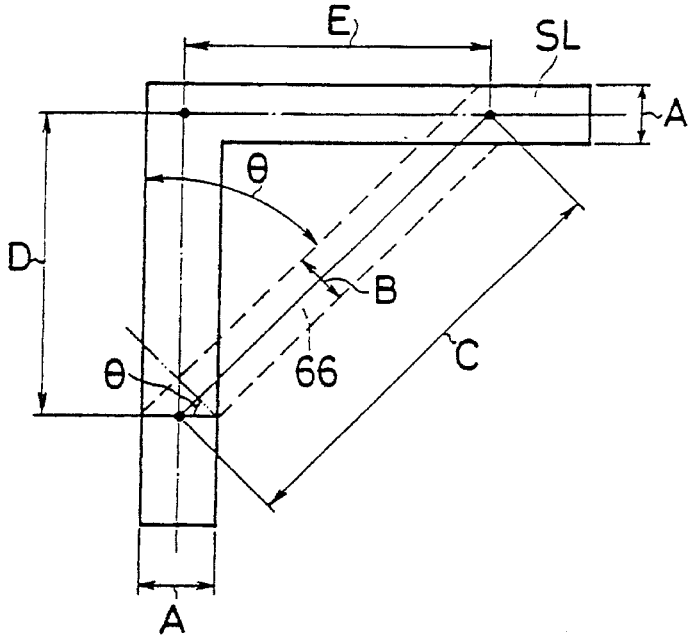
Fig. 34 (3)
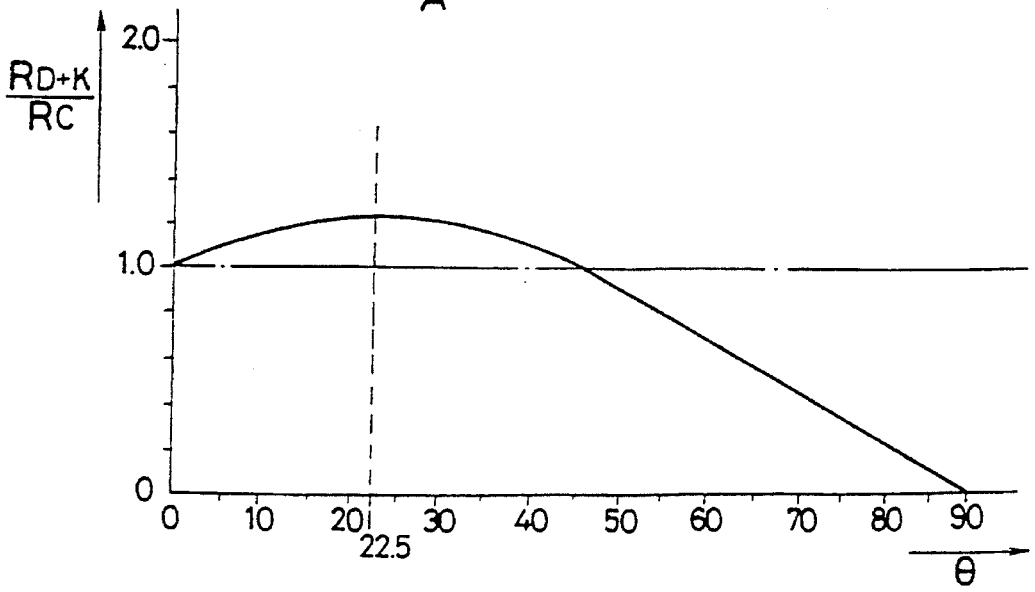

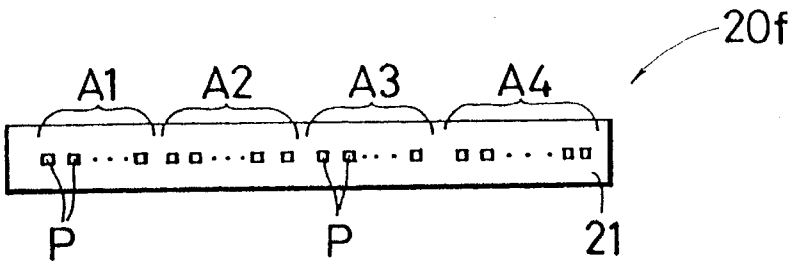
Fig. 45
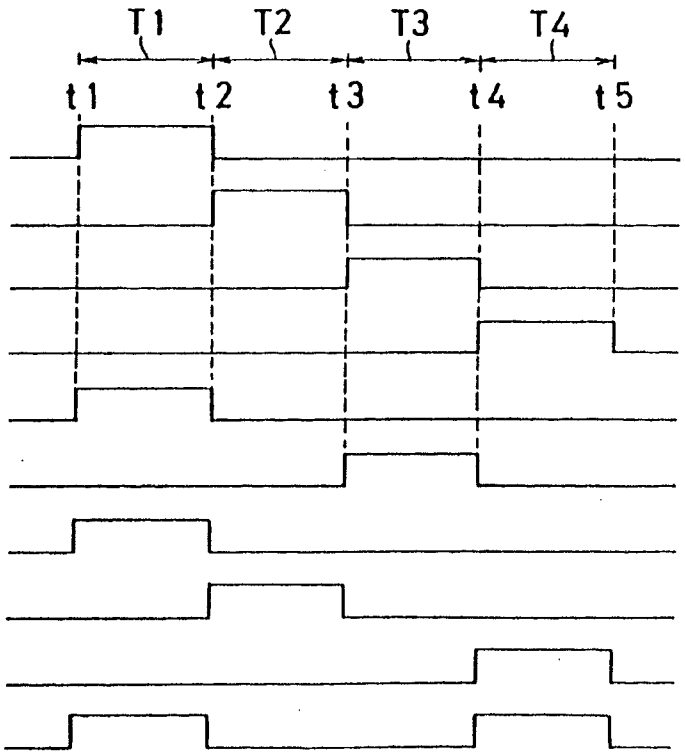
Fig. 46 (1)
Fig. 46 (2)
Fig. 46 (3)
Fig. 46 (4)
Fig. 46 (5)
Fig. 46 (6)
Fig. 46 (7)
Fig. 46 (8)
Fig. 46 (9)
Fig. 46 (10)

Driving means DR1
to Driving circuit DR2
Processing circuit

DR1a

Printing data
to Block changeover circuit 108
to Driving circuit DR1b
Processing circuit
Latch signal output
Printing data
EO
ENB
LA
CLK
CK
CLR
T
K
Q
D
C
L
PW1a
PW2a
PW3a
PW62a
PW63a
PW64a
G1a
G2a
G3a
G62a
G63a
G64a
L1a
L2a
L3a
L62a
L63a
L64a
F1a
F2a
F3a
F62a
F63a
F64a
100
101
102
103
104
104a
104c
105a
106a
107
108
109
112
127
131
133
136
23
74
75a
76a
77a
78a
79a
80a
81a
82a
83a
84a
85a
86a
87a
88a
89a
90a
91a
92a
94a
95a
96a
97a
98a
183a
188a Fig.62 (1)
Fig.62 (2)
Fig.62 (3)
Fig.62 (4)
Fig.62 (5)
Fig.62 (6)
Fig.62 (7)
Fig.62 (8)

| Fig. 65 | Fig. 66 |
|---|---|

DR1a

Printing data
to block changeover circuit 108
to Driving circuit DR1b, DR2a DR2b
Processing circuit
EO
ENB
LA
CLK
CLR
CK
J
K
Q
D
L
C
PW1a
PW2a
PW3a
PW62a
PW63a
PW64a
G1a
G2a
G3a
G62a
G63a
G64a
L1a
L2a
L3a
L62a
L63a
L64a
F1a
F2a
F3a
F62a
F63a
F64a
100
101
102
103
104
104a
104c
106a
107
109
112
127
131
133
136
188a
183a
74
23

IMAGE FORMING APPARATUS HAVING DRIVING MEANS AT EACH END OF ARRAY AND POWER FEEDING SUBSTRATE OUTSIDE HEAD HOUSING

This is a continuation of application Ser. No. 07/422,543, filed on Oct. 18, 1989, now abandoned.

BACKGROUND OF THE INVENTION

1. Field of the Invention

The present invention relates to an image forming apparatus to be applied in, for example, light-emitting diode (LED) head and thermal head.

2. Description of the Prior Art

An optical printer head 201 of a typical prior art is shown in FIG. 1, and FIG. 2 is its longitudinal sectional view. A common lead wire 2 is formed on the surface of a substrate 1 made of electrically insulating material. Light-emitting diode (LED) elements 3 are joined in the upper part of the common lead wire 2, which works as an electrode for emitting light by applying an electric power to the LED elements 3. Parallel to the array of LED elements 3, driving circuits 4 are disposed on the substrate 1. Connection lead wires 5 are formed on the substrate 1. These connection lead wires 5 are connected to the individual electrodes **3*b* of LED elements 3 and output terminals 4*a* of the driving circuits 4 through bonding wires 6 individually, while input terminals 4*b* of the driving circuits 4 are connected to individual driving lead wires 7 on the substrate 1 by bonding wires 8. The individual driving lead wires 7 are connected to multiple printed wires 10 disposed on a flexible circuit wiring substrate 9. One LED array 3*a* comprises, for example, 64 LED elements 3, and a total of 40 such arrays 3*a* are disposed on the substrate 1. Therefore, the total number of LED elements 3** amounts to 2,560.

FIG. 3 is a block diagram showing a pracitcal electrical composition of a driving circuit 4. The driving circuit 4 is disposed on each array **3*a*. Shift registers 12 in a total of 64 bits possessing bits individually corresponding to LED elements 3 are connected in cascade, and clock signals shown on the top line in FIG. 4 are supplied to these shift registers 12 from lines 13. Synchronizing with these clock signals, print data is fed into the shift registers 12 from lines 14 as shown on the second line in FIG. 4. The store information of shift registers 12 is transferred and stored into latch circuits 16 corresponding to latch signals from lines 15 shown on the third line in FIG. 4. A strobe signal shown on the bottom line in FIG. 4 is given to a line 17, and accordingly the store information in the latch circuits 16 is led out into the output terminals 4*a* through an AND gate 18, so as to be individually applied to LED elements 3**.

A total of 2,560 clock pulses are given to lines 13, and at the same time print data is given serially from lines 14, and in this way the print data for the portion of one scanning line is stored in a total of 40 shift registers 12, and the latch signals are given to lines 15, and the print data totaling to 2,560 are transferred in batch to the latch circuits 16, and 2,560 LED elements 3 for the portion of one line are selectively illuminated and driven on the basis of the print data for the duration period T of the strobe signal.

If emission outputs of plural LED arrays **3*a* are varied, and/or emission outputs of plural LED elements 3 contained in one LED array 3*a* are varied, plural times of emission driving are effected for each line in order to make uniform the emission outputs, that is, the exposure quantities by the LED arrays 3*a* or LED elements 3 having variations in emission outputs, for the exposure and printing of one line. In other words, the arrays 3*a* low in emission output and/or LED elements 3** low in emission output are selectively illuminated plural times depending on the print data.

For example, when composed to emit twice, in order to emit and drive in two emission drive periods, a total of 2,560 pieces of serial and sequential print data must be fed and stored in a total of 40 shift registers 12. If the emission outputs of arrays **3*a* or LED elements 3** have greater fluctuations, the emission driving must be repeated selectively more times, which results in lowering of the printing speed.

In this prior art, a total of 2,560 LED elements 3 for the portion of one scanning line are illuminated and driven for the duration of strobe signals selectively and in batch on the basis of the print data, and therefore a large current flows momentarily. Accordingly, a power supply with a large electric power capacity is needed.

Besides, a large Joule heat is generated in the LED elements 3, common lead wires 2, connection lead wires 5, and bonding wires 6, 8, and the temperature of LED elements 3 rises. As a result, the emission wavelength of LED elements 3 and the brightness vary depending on the temperature, and fluctuations occur in the emission wavelength and brightness in each LED element 3. Hence, clear printing is disabled, and uneven printing occurs.

To prevent temperature rise of LED elements 3, a heat sink may be used, but it causes the structure to be enlarged, and mounting is difficult in the recent electrophotographic printer and other recording apparatus in the tendency of reduction of size.

This prior art also involves other problems. For example, there are too many bonding wires 6, 8, and it takes a very long time for connecting them, and it may lead to a higher rate of defectives of connections.

As a further different problem of the prior art, the integrated circuits 4 are individually provided for each one LED arrays **3*a*, and therefore a great number of driving circuits 4** should be required.

Thus, in a coventional optical printer head 201, LED arrays **3*a* and driving circuits 4 are disposed correspondingly by 1:1, and the length w1 of the driving circuits 4 along the array direction is selected to be equal to the length w2 of the LED arrays 3*a*** along the array direction.

FIG. 27 is a block diagram showing a structural example of an optical printer 51 using an optical printer head 201, and this diagram is also referred to in the embodiments. The optical printer 51 comprises a photosensitive drum 52 which is, for example, right cylindrical and is rotated and driven in the direction of arrow A1, and the photosensitive drum 52 is surrounded by a charger 53 for electrically charging the entire outer surface of the photosensitive drum 52, the optical printer head 201 for focusing an optical image on the photosensitive drum 52 to form an electrostatic latent image, and a developing device 54 for making the electrostatic latent image visible by using toner and others, and the toner image made visible is transferred on a recording paper 56 held against, for example, a transfer roller 55. The toner image on the recording paper 56 is fixed by a fixing device (not shown).

In the conventional optical printer head 201 described herein, the following problems are known.

(1) Since the lengths w2, w1 of the LED array **3*a* and driving circuit 4 must be defined to correspond to 1:1, LED arrays 3***a* of length W2 in plural types corresponding to the print dot density are prepared, and exclusive driving circuits 4 must be designed and manufactured accordingly. Therefore, the development requires an enormous labor and cost, and the production efficiency for fabrication of driving circuits 4 is lowered.

(2) When the LED arrays 3*a* are at relatively high density, it is necessary to bond by bonding wires 6, 8 at high precision for every LED array 3*a* as shown in FIG. 5, and the working efficiency deteriorates and the production efficiency are lowered.

(3) In the case of an optical printer head 201 composed as shown in FIG. 1, the length along the rotating direction A1 of the photosensitive drum 52 in FIG. 27, that is, the entire length of the optical printer head 201 including the length L1 in the vertical direction in FIG. 1 is extended. In other words, with respect to the central axis of the photosensitive drum 52 shown in FIG. 27, the angles θ1, θ2 formed by the optical printer head 201 with the charger 53 and developing device 54 become very wide.

FIG. 6 is a graph showing the time-course changes of the surface potential of the photosensitive drum 52, and FIG. 7 is a graph showing the relation between the surface potential of the photosensitive drum 12 and the toner deposition. At time t0 in FIG. 6, charging on the photosensitive drum 52 is started, and at time t1, reaching the specified quantity of charging, the charger 53 stops its operation. Afterwards, until exposure action at time t2, the surface potential attenuates spontaneously, and exposure is effected by the optical printer head 201 at time t2. In exposure, light is not emitted to the portion to be printed in black, and a spontaneous attenuation curve l1 continuous to curve l0 from time t1 to t2 is drawn. In the portion to be printed in white, the maximum quantity of light is emitted, and the surface potential drops suddenly as indicated by curve l2. In the portion of halftone gray printing, an intermediate quantity of light is emitted, and an intermediate curve l3 of curves l1, l2 is drawn.

Therefore, the angles θ1, θ2 will define the time intervals Tθ1, Tθ2 among times t1, t2, t3 in FIG. 6. Hence, the wider the angles θ1, θ2, the greater becomes the spontaneous attenuation quantity δ0 of the surface potential at exposure time t2, and the print quality deteriorates. Besides, between exposure time t2 and development time t3, if the attenuation δ1 is large, the print quality similarly deteriorates. To wit, as shown in FIG. 7, the toner deposition is limited by the surface potential, and printing at desired density is not realized if the degree of spontaneous attenuation is great, and coloring may be disturbed, specially in color printing.

(4) If the angles θ1, θ2 are relatively wide, even when the photosensitive drum 52 is reduced in size for downsizing the optical printer 51, the optical printer head 201 to be disposed in the periphery cannot be reduced in size, and hence it is difficult to reduce the size of the optical printer 51.

FIG. 8 is a sectional view showing an internal structure of an optical printer head 201 assumed in relation to the above problems, FIG. 9 is an exploded perspective view showing the appearance of the optical printer head 201, and FIG. 10 is a sectional view seen from line K1—K1 in FIG. 9. Referring to these drawings, the optical printer head 201 is explained below. In the optical printer head 201, plural light-emitting diode arrays (LED arrays) 203 are arranged in multiplicity on a straight line on a substrate 202 made of electrically insulating material, and on each one of the LED arrays 203, plural LEDs 204 are formed on a straight line parallel to the array direction of the LED arrays 203.

On the substrate 202, individual signal lines 205 for sequentially connecting the corresponding LEDs 204 of LED arrays 203 are formed, and an insulation layer 206 is disposed so as to partly cover the individual signal lines 5. On this insulation layer 206, common signal electrodes 207 are formed as many as the number of LED arrays 203, and the LED arrays 203 are formed on these common signal electrodes 207. Corresponding to each one of LEDs 204 of LED arrays 203, terminals 208 are provided, and the terminals 208 and individual signal lines 205 are connected together by bonding wires 209.

The common signal electrodes 207 are connected with electrodes 211 of flexible wiring substrate 212 integrally comprising flexible film 210 made of polyimide resin or the like and electrodes 211.

The substrate 202 on which the LED arrays 203 are mounted is disposed on a housing 213 having a function of cooling plate of optical printer head 201, and a lid 214 for pressing the flexible wiring substrate 212 is disposed between them. By this housing 213 and lid 214, the housing 215 of the optical printer head 201 is composed.

The lid 214 is provided with a pressing member 216 having an elasticity for adhering the flexible wiring substrate 212 to the substrate 202, especially to the common signal electrodes 207. To fix this lid 214 to the housing 213, penetration holes 217, 218 are formed in the lid 214 and flexible wiring substrate 212, and screw holes 213*a* are formed in the housing main body 213 to be engaged with the setscrews 219 passing through these penetration holes 217, 218. The flexible wiring substate 212 is connected to a connector 220, and is supported at a position remote from the housing 213 by a predetermined distance.

The first subject for the optical printer head 201 is as follows.

The insulation layer 206 is formed in order to prevent short-circuit between the individual signal line 205 and the common signal electrode 207, but because of the three-layer structure, in this conventional example, two steps of vapor deposition of the metal layer and two steps of etching are necessary for forming patterns of the individual singal line 205 and common signal electrode 207, and therefore the working time and necessary materials increase, and the product yield is lowered.

In particular, when forming common signal electrodes 207, a very high precision is needed for positioning with the previously formed individual signal lines 205, and an enormous time and high precision technique are required. Moreover, because of such positioning of high precision, it is difficult to meet the demand for increasing the size of the substrate 202, in the aspects of extension of length of optical printer head 201 and manufacturing efficiency of the substrate 202 for mounting LED arrays 203.

The second problem is as follows. Since the flexible wiring substrate 212 is press-fitted to the substrate 202 in the structure as described above, in order to mutually cover the flexible wiring substrate 212 and the substrate 20 to realize an electric conduction between electrodes, a length of about 2.0 mm is required for the covering range A1, and therefore the penetration holes 218 and screw holes 213*a* are required to have a diameter of about 3.0 mm. That is, downsizing of the optical printer head 201 is limited.

On the other hand, it may be also considered to omit the connection region A1 of the flexible wiring substrate 212, and connect the circuit wiring on the remaining flexible wiring substrate 212 and the substrate 202 by bonding wires, but in the optical printer head 201, the Common signal electrodes 207 possess, in the space opposite to the substrate 202, insulation layer 206 made of relatively soft material such as polyimide, and individual signal lines 205. When the bonding wires used in such common signal electrodes 207 are connected by ordinary technique, the common signal electrodes 207 which are relatively thin metal films on the insulation layer 206 made of relatively soft material are deformed in convex by the pressure of the jig used in connection at the bonding wire connecting points, and the bonding becomes difficult, and therefore this connecting technique is not employed.

FIG. 11 shows an electrical constitutional block diagram of the optical printer head 201. The parts correspondings to those in the foregoing prior art are identified with the same reference numbers. This optical printer head 201 of current changeover type driving system comprises a plurality of light-emitting diode arrays (LED arrays) g1, g2, . . . , gn composed of plural LEDs 204, and the LEDs 204 are arranged linearly. The corresponding LEDs 204 of LED arrays gi (i=1 to n) are individually connected to plural individual signal lines 205, and driving circuits 4 comprising transistors 221 for driving the LEDs 204 are connected to the individual signal lines 205. To the LED 204 selected by the driving circuit 4, a driving current from a power supply 222 installed separately is supplied through the individual signal lines 205, thereby realizing emission of a desired LED 204.

The cathodes of the LEDs 204 composing the LED arrays gi are commonly grounded, while the anodes are connected to the power supply 222 through the current limiting resistance R connected respectively in series. Between each LED 204 and the corresponding resistance R, the collector of the transistor 221 is connected, and the emitters of the transistors 221 are commonly grounded. Each LED 204 comprises wiring resistances R1, R2, . . . , Rn, and the wiring resistance is higher in the LED 204 as going remoter from the driving circuit 4. By feeding driving signal Sg to each base of the transistor 221, each LED 204 is individually lit and extinguished, thereby forming an electrostatic latent image as stated above.

When the LED 204 is not lit, the corresponding transistor 221 is set in conductive state, and the current from the power supply 222 is passed to the transistor 221 side, so that the current flowing into the LED 204 is cut off, thereby putting it out. On the other hand, when illuminating the LED 204, the transistor 221 is cut off, and the current from the power supply 222 flows into the LED 204.

In such optical printer head 201, since the individual signal lines 205 connected to the LEDs 204 are relatively thin and long, the wiring resistances R1 to Rn are large, and hence a voltage drop occurs due to the wiring resistances R1 to Rn. For example, when the LED array gn connected at a position remote from the driving circuit 4 which is the supply source of the driving current of the individual signal line 205 is selected, as compared with the case when the LED array g1 close to the driving circuit 4 is selected, the wiring resistance is added and increased, while the driving current becomes smaller. Therefore, the remoter is the LED array gi (i=1 to n) at the connecting position from the driving circuit 4, the less is the quantity of emission, and when such optical printer head 201 is used in an electrophotographic apparatus, the image quality deteriorates.

Incidentally, in the type of changing over the current between the LED 204 and the transistor 221 as mentioned above, the resistances R are used owing to the following reason. That is, assuming a case without this resistance R, when not illuminating the LED 204, if the power supply 222 is grounded through the transistor 221 in the conductive state, an excessive current flows into the transistor 221. The transistor 221 possesses an ON voltage VCE in conductive state between the collector and emitter, and when it exceeds the ON voltage of the LED 204, the LED 205 may be lit unexpectedly.

Moreover, in the above example, regardless of the emitting state or extinguished state of the LED 204, a current flows into the resistance R, and the power consumption in the optical printer head 201 increases, and the structure is incresed in size because it is necessary to install the resistance R in each LED 204.

SUMMARY OF THE INVENTION

It is hence a first object of the invention to present an image forming apparatus capable of suppressing the increase of driving current of LED elements so as to reduce the generated joule heat and power consumption, and also excellent in productivity and decreased in the number of parts.

It is a second object of the invention to present an image forming apparatus solving the above technical problems, outstandingly reduced in the structural size, and enhanced in print quality.

It is a third object of the invention to present an image forming apparatus capable of supplying a uniform driving current to LED elements over the entire length in the array direction of the group of LED elements, and adjusting the quantity of the emissions uniformly.

It is a fourth object of the invention to present an image forming apparatus not requiring rearrangement of print data for print elements such as light-emitting diodes so as to simplify the structure, and also capable of enhancing the printing speed.

To realize the above objects, the invention presents an image forming apparatus comprising plural light-emitting diode arrays individually possessing plural light-emitting diode elements, and an integrated circuit for selectively driving the light-emitting diode elements, wherein each light-emitting diode element of each light-emitting diode array is connected commonly to the connecting terminal of the integrated circuit.

The invention also presents an image forming apparatus comprising plural light-emitting circuit elements substantially arranged on a straight line individually possessing plural light-emitting elements, and plural individual lines sequentially connected to the corresponding light-emitting elements, extending up to the light-emitting circuit elements.

The invention further presents an image forming apparatus wherein driving circuit elements for supplying driving current to light-emitting elements through individual lines are connected on a straight line along the arranging direction of the light-emitting circuit elements, near one end portion common to the individual lines.

Moreover, the invention presents an image forming apparatus possessing plural light-emitting element arrays having plural light-emitting elements arranged on a straight line which are arranged on a straight line on an electrically insulating wiring substrate, and also a power feeding wiring substrate for supplying driving electric power to each light-emitting element array, further comprising:

individual signal lines disposed on the electrically insulating substrate, sequentially connected to corresponding light-emitting elements of light-emitting element arrays, and possessing a curved portion alternately curved in convex in two directions intersecting with the arrangement direction, and common signal electrodes disposed at a position not conducting electrically with the individual signal lines, among the curved portions in the individual lines on the electrically insulating wiring substrate, and connected to the corresponding light-emitting elements and also connected to the power feeding wiring substrate.

The invention also presents an image forming apparatus wherein the common signal electrodes and power feeding wiring substrate are connected with fine metal wires.

The invention further presents an image forming apparatus wherein the curved portions in the individual signal lines contain slant portions at an angle of 0 being selected in a range of $0°<\theta\leqq 45°$, with regard to the direction crossing with the arrangement direction of light-emitting arrays.

The invention still more presents an image forming apparatus wherein the shape of the curved portions in the individual signal lines is selected in a convex curve relating to the direction crossing with the arrangement direction of light-emitting element arrays.

Furthermore, the invention presents an image forming apparatus which comprises:

means for printing having plural printing elements arranged in a row and divided into plural blocks, with the terminals at one side of printing elements at symmetrical positions of adjacent blocks connected to individual signal line, while the terminals at the other side of the printing elements conneted to common signal lines in each block, plural memory elements disposed corresponding individually to plural printing elements contained in one block, and applying the store outputs to the terminals at one side of printing elements to set at one predetermined potential, a data generation source for sequentially delivering the print data to be applied to each printing element of the printing means in the order of arrangement of the printing elements, a first switching element for applying the output of the memory element in the previous stage to the input of memory elements of the next stage, and applying the print data from the data generation source to the input of the memory elements of the first stage, a second switching element for applying the output of the memory elements of the final stage to the input of the memory elements of one stage before, and applying the print data from the data generation source to the inputs of the memory elements of the final stage, means for setting the common signal lines of the block corresponding to the print data generated from the data generation source to the other predetermined potential in the sequence of blocks, and a changeover signal generation source for applying a changeover signal to the first and second switching elements in every block of the print data generated from the data generation source to alternately change the store sequence into the memory devices in each block, thereby electrically energizing the printing elements in the order of arrangement.

The invention also relates to an image forming apparatus comprising:

a latch circuit disposed between a memory element and a printing element, and latching the output of the memory element to apply to one terminal of the printing element, and means for applying the print data of the block to be printed next to the memory element while the store output of the latch circuit is being applied to the printing element.

The invention moreover relates to an image forming apparatus comprising plural constant current sources having:

first switching means being arranged at the negative pole side relating to plural groups determined by dividing plural light-emitting elements, for setting the conductive/cut-off state, and second switching means with the positive poles of corresponding light-emitting elements of each group commonly connected, for setting the conductive/cut-off state of driving current, wherein each one of the first switching means is changed from the cut-off state to the conductive state sequentially, and the second switching means is sequentially set in the conductive state within each conductive state period of each first switching means.

The invention also presents an image forming apparatus wherein plural constant current sources are connected to mutually different positions of common lines to which corresponding light-emitting elements of each group are commonly connected, and a same group is selected by these constant current sources, and the light-emitting elements of the selected group are driven simultaneously.

The invention still more relates to an image forming apparatus wherein corresponding light-emitting diode elements in every light-emitting diode array of plural light-emitting diode arrays possessing individually plural light-emitting diode elements are connected to common lines individually, plural driving circuits are connected to mutually different positions of the common lines, and a same light-emitting diode array is selected by these driving circuits, and the light-emitting diode elements of the selected light-emitting diode array are driven simultaneously.

The invention also relates to an image forming apparatus comprising:

means for printing having plural blocks possessing plural block portions, with each block portion comprising plural printing elements arranged in a row, having terminals at one end of printing elements at symmetrical positions of adjacent blocks connected to individual signal lines, and other terminals of printing elements connected to common signal lines in each block, a data generation source for delivering the print data to be given to each printing element of the printing means sequentially in the order of arrangement of printing elements, and means for driving for simultaneously driving the plural blocks disposed at one end or both ends of the direction of arrangement of blocks, in which, depending on each block portion, each driving means is connected to the individual signal line and common signal line, and selects the common signal line in the sequence of blocks by responding to the print data from the data generation source, then supplies the electric power corresponding to the print data through the individual signal line in the block portion corresponding to each driving means to the printing elements included in the selected block.

The invention moreover relates to an image forming apparatus comprising:

means for printing possessing plural blocks composed by having plural printing elements arranged in a row, with the terminals at one end of the printing elements at symmetrical positions of adjacent blocks being connected to the individual signal lines, and the other terminals of the printing means connected to the common signal lines, a data generation source for delivering the print data to be given to each printing element of the printing means sequentially in the order of arrangement of prinitng elements, and a pair of driving means disposed at both ends in the direction of arrangement of blocks, in which each driving means is connected with the individual signal line and common signal line, selects the common signal lines in the sequence of blocks by responding to the print data from the data generation source, supplies the electric power corresponding to the print data mutually in the reverse directions in the direction of arrangement of printing elements through the individual signal lines, and thereby simultaneously driving the printing elements included in the selected block.

In the invention, a changeover signal generation source for generating a changeover signal for alternately changing over the storing direction of the print data is disposed in each block of the print data generated from the data generation source, one driving means disposed at one end in the direction of arrangement of blocks acts in response to the changeover signal from the changeover signal generation source to lead out the inverted changeover signal having the changeover signal inverted, from the output terminal, and the other driving means disposed at the other end in the direction of arrangement of blocks possesses an input terminal for receiving the inverted changeover signal from the output terminal, and acts in responses to the inverted changeover signal from this input terminal.

According to the invention, LED elements of LED arrays are commonly connected to the connection terminals of the integrated circuit for driving the LEDs, and the LED elements are selectively driven in each array by the integrated circuit, and therefore only a relatively small number of LEDs contained in each array are illuminated and driven in batch according to the print data. It is not intended to illuminate and drive all of LED elements in plural arrays in batch, and hence a large current is not needed momentarily. Therefore, as a matter of course, a power supply of large electric power is not needed, and also generation of Joule heat may be suppressed, and hence it is possible to suppress the changes of the emission wavelength and brightness of LED elements by heat generation depending on temperature, and fluctuations among LED elements may be also suppressed. As a result, a clear printing is possible, and the print quality may be enhanced.

Still more, since heat generation is kept low, heat sink is not needed, or if heat sink is necessary, only a small one is enough, and hence it is easy to install in a recording apparatus which tends to be smaller in size recently.

What is more, according to the invention, since a driving circuit is commonly used in plural light-emitting diode arrays, the number of connections of bonding wires may be decreased. As a result, the time required for connection work of bonding wires may be curtailed, and the rate of defectives in connection may be also reduced.

Also by the invention it is evident that the number of integrated circuits may be reduced as compared with the prior art described hereabove because a common integrated circuit is used for plural LED arrays.

The image forming apparatus of the invention features a linear arrangemnet of plural light-emitting circuit elements individually possessing plural light-emitting elements. The corresponding light-emitting elements in each light-emitting circuit element are sequentially connected by the plural individual lines extending along each light-emitting circuit element. According to the invention, the driving circuit elements are connected on a straight line along the arrangement direction of the light-emitting circuit elements, near one common end of the individual lines.

Thus, the size of the light-emitting circuit elements of the image forming apparatus in the direction intersecting with the arrangement direction may be shortened, and the structure may be downsized, while the print quality may be enhanced at the same time. Furthermore, since the necessity of arranging the driving circuit elements at a rate of 1:1 to the light-emitting circuit elements has been eliminated, the limitations relating to the size of the driving circuit elements as mentiond in relation to the prior art are cleared, and driving circuit elements of a single size may be used for light-emitting circuit elements of plural sizes, and the production efficiency of these driving circuit elements and the image forming apparatus will be outstandingly improved.

According to the invention, the individual signal lines formed on the electrically insulating substrate possess curved portions curved in a convex form mutually in two directions crossing with the arrangement direction of the light-emitting element arrays, and connecting portions to be connected to the light-emitting elements between adjacent curved portions. An exposure region of the electrically insulating substrate is disposed among the curved portions of the individual signals lines at one side crossing with the arrangement direction of the light-emitting element arrays on the electrically insulating substrate, and common signal electrodes of the light-emitting arrays are disposed in this region. The common signal electrodes are connected to the corresponding light-emitting element arrays at positions not electrically conducting with the individual signal lines, and a driving electric power is supplied from the power feeding wiring substrate.

In this way, the individual signal lines and common signal electrodes are formed on a same plane on the electrically insulating substrate. As a result, when forming such individual signal lines and common signal electrodes, plural steps of metal particle evaporation or etching may be reduced to a single step, and the manufacturing process may be radically simplified.

In addition, when electrically connecting the power feeding wiring substrate and common signal electrodes, since the common signal electrodes are directly formed on the electrically insulating substrate, this connection may be effected by the technique of wire bonding, and the composition of the image forming apparatus including the printed wiring substrate may be significantly reduced in size.

When the angle $\theta$ is selected in a range conforming to the invention, the substrate may be reduced in size, and the electric resistance of the individual signal lines may be lowered, so that saving of power consumption and increase of signal processing speed may be realized at the same time.

The same action may be also achieved in the curved portions of the individual signal lines in the shape conforming to the invention.

According to the invention, the printing elements at symmetrical positions of adjacent blocks, for example, the individual signal lines to which terminals at one side of LEDs, thermal heat heating resistance elements or the like are connected are composed in a zigzag form, and the print data to be applied to each printing element from the data generation source are sequentially delivered, and the print data from the data generation source are stored in the normal direction and reverse direction by every one block into the memory elements, by the function of plural memory elements and first switching elements and second switching elements, in each block. By setting the store output of memory element at one predetermined potential by applying to one terminal of the printing element, and setting the common signal line of the block corresponding to the print data for one block at other predetermined potential in the sequence of blocks, the printing elements can be electrically energized according to the print data sequentially in the direction of arrangement. Therefore, as mentioned in relation ot the prior art, as compared with the structure for once storing the print data, and specifying the addresses for reading alternately in the block sequence in the normal direction and reverse direction, the structure may be simplified, and the printing speed may be improved because it is not necessary to rearrange the print data.

Also according to the invention, the plural light-emitting elements are divided into plural groups. In each group, first switching means is disposed at the negative pole side, while the positive pole of the corresponding light-emitting element in each group is commonly connected to plural constant current sources having second switching means. In such constitution, each one of the first switching means is sequentially changed over from cut-off state to the conductive state, and the second switching means is sequentially set in the conductive state within each conductive state period of each first switching means.

Thus, the plural light-emitting elements may be controlled individually between the emitting state and non-emitting state. The constant current sources comprising the second switching means for feeding/cutting the driving current to the light-emitting elements at this time are disposed at the positive pole side of each light-emitting element, and an equal current may be supplied to all light-emitting elements, and the nonuniformity of emission by the light-emitting elements as mentioned in the explanation of the prior art may be eliminated. At the same time, the electric resistance elements disposed at the positive pole side of the light-emitting elements are not longer needed. As a result, the structure may be reduced in size. Moreover, since such electric resistance elements may be omitted, the power consumption may be drastically saved.

According to the invention, plural constant current sources are connected at mutually different positions of common lines, and a group of same light-emitting elements is selected by these constant current sources, and the light-emitting elements of the selected group are driven simultaneously. In consequence, a driving power is supplied from the constant current sources to the driven light-emitting elements. Therefore, regardless of the position of the connection of the group of light-emitting elements to the common lines, the magnitude of the driving currents applied to all groups of light-emitting elements may be adjusted almost uniformly, and hence fluctuations of the emission intensity due to wiring resistance of common lines may be elimianted.

In the invention, plural driving circuits are connected to mutually different positions of common lines, and same LED arrays are selected by these driving circuits, and the LED elements of the selected LED arrays are driven simultaneously, so that the driving currents from plural driving sources are supplied to the LED elements being driven. Therefore, regardless of the positions of the connection of LED arrays to the common lines, the magnitude of driving currents flowing in all LED arrays may be almost uniformly adjusted, so that uneven emission brightness due to line resistance of common lines may be eliminated.

According to the invention, the individual signal lines to which the printing elements at symmetrical positions of adjacent blocks, for example, terminals at one side of light-emitting diodes or heating resistance elements of thermal head are connected are bent in a zigzag pattern, and the print data to be given from the data generation source to the printing elements are sequentially delivered, and the driving means responding to the print data from the data generation source is respectively disposed at both ends in the direction of arrangement of blocks, in a total of at least one pair, and the common lines are selected in the sequence of blocks, and each driving means at both ends in the direction of arrangement of blocks supplies the electric power corresponding to the print data in the mutually reverse directions in the direction of arrangement of printing elements, and simultaneously drives the printing elements included in the selected block. Therefore, since one printing element is simultaneously driven by the driving means disposed at both ends in the direction of arrangement of blocks, the current supplied in the printing element may be increased. As a result, when the printing element is a light-emitting diode, its emission output may be increased, and when it is a heating resistance element, its heat output increases, so that the energization time may be shortened. Accordingly,the printing speed may be raised. Comparing with the prior art, according to the invention, for example, the emission time necessary for the light-emitting diode as one printing element is shorter than 34 μsec in the prior art, say 22 μsec, and in an image forming apparatus comprising 40 blocks in total, it is 0.88 msec/line (=22 μsec×40), so that the printing speed may be enhanced.

Furthermore, by the invention, the changeover signal generation source generates changeover signals for alternatly changing over the storing direction of the print data in every block portion of the print data generated from the data generation source, and the changeover signal is applied to one of the driving means, and this driving means possesses an output terminal for leading out an inverted changeover signal having the changeover signal inverted, while the other driving means possesses an input terminal for receiving the inverted changeover signal from this output, so that the other driving means operates in response to the inverted changeover signal from this input terminal. Therefore, one driving means and the other driving means are built in a same basic structure, and the one driving means is designed to act in response to the changeover signal supplied from the changeover signal generation source, while the other driving means acts by receiving at its input terminal the inverted changeover signal led out from the output terminal of the first driving means, so that the invention may be executed in a simple structure.

In the invention, the individual signal lines to which printing elements at symmetrical positions of adjacent blocks, for example, terminals at one side of light-emitting diodes or heating resistance elements of thermal head are connected are bent in a zigzag pattern, and the print data to be given from the data generation source to the printing elements are sequentially delivered. The print data from the data generation source is given to the driving means, and this driving means is disposed at the end portion in the direction of arrangement of blocks, and is connected to the individual signal line and common signal line, corresponding to each block portion. These plural driving means apply the electric power corresponding to the print data through the individual signal line in the corresponding block portion, to the printing elements included in the selected block. Therefore, by these plural driving means, the multiple printing elements contained in the block portion corresponding to each driving means may be driven simultaneously, and thus the number of printing elements included in each block is increased and the number of blocks is decreased, and hence the printing speed may be raised. For example, in an image forming apparatus having a total of 20 blocks of light-emitting diodes, each block possesses two block portions, and each block portion comprises 64 light-emitting diodes, and when the LEDs in one block portion are simultaneously energized, for example, for 34 μsec for exposure of the photoreceptor, a printing speed of 0.68 msec/line (=34 μsec×20) will be achieved. By contrast, as explained in relation to the prior art, if the driving means is composed to sequentially drive each block comprising 64 LEDs, a total of 40 blocks should be required, and the printing speed is 1.36 msec/line (=34 μsec×40). Besides, when transferring the print data for a total of 128 LEDs to the driving means according to the invention, the print data can be transferred at, for example, 10 MHz, and the required transfer time is 12.8 μsec (=128 dots/10 MHz), and therefore iris possible to transfer the print data of the next block while driving the LEDs in one block.

BRIEF DESCRIPTION OF THE DRAWINGS

FIG. 45 is a plan view of an optical printer head 20*f*, FIGS. 46(1)–46(10) together are a timing chart for explaining the operation.

DETAILED DESCRIPTION OF THE PREFERRED EMBODIMENTS

Figure 1:
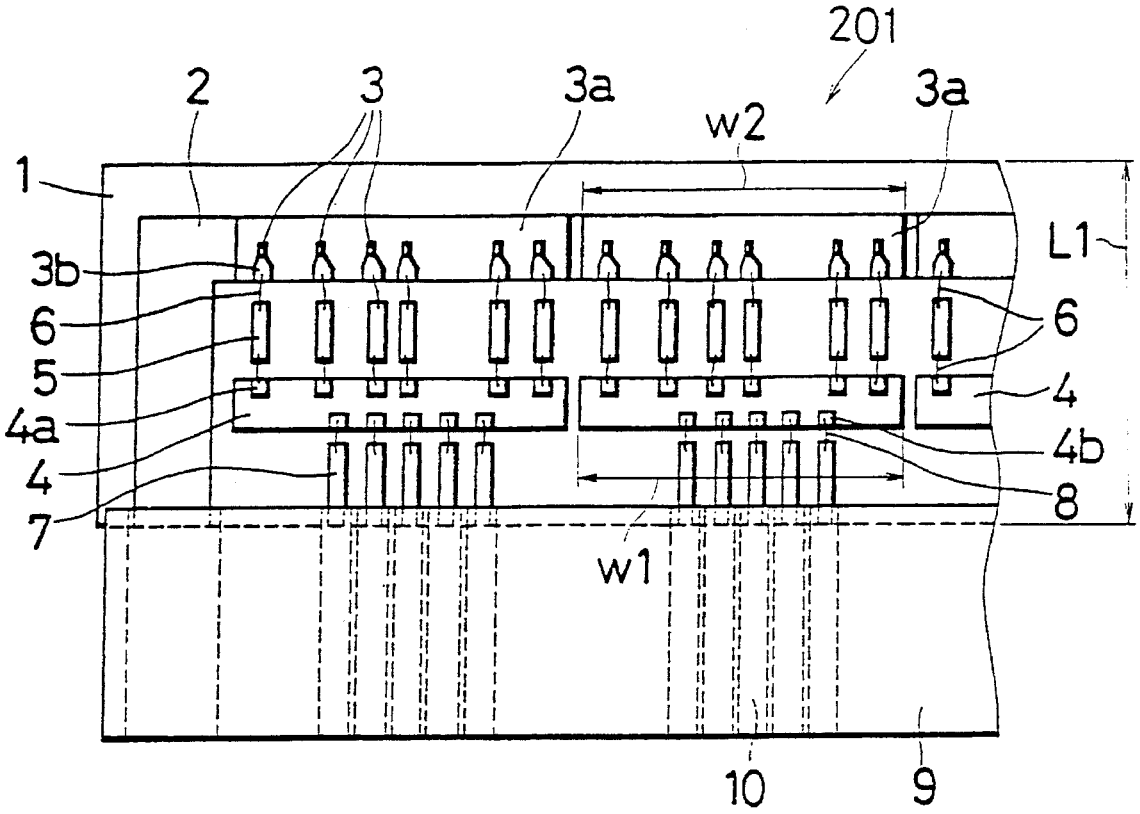
FIG. 1 PRIOR ART
FIG. 1 is a plan view of a prior art.
Figure 2:
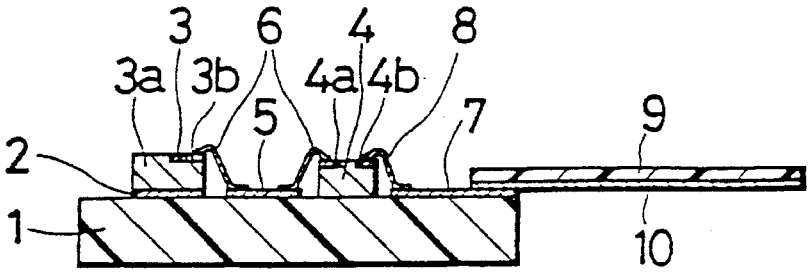
FIG. 2 PRIOR ART
FIG. 2 is a sectional view of the prior art shown in FIG. 1.

Referring now to the drawings, some of the preferred embodiments of the invention are described in detail below.

Figure 12:
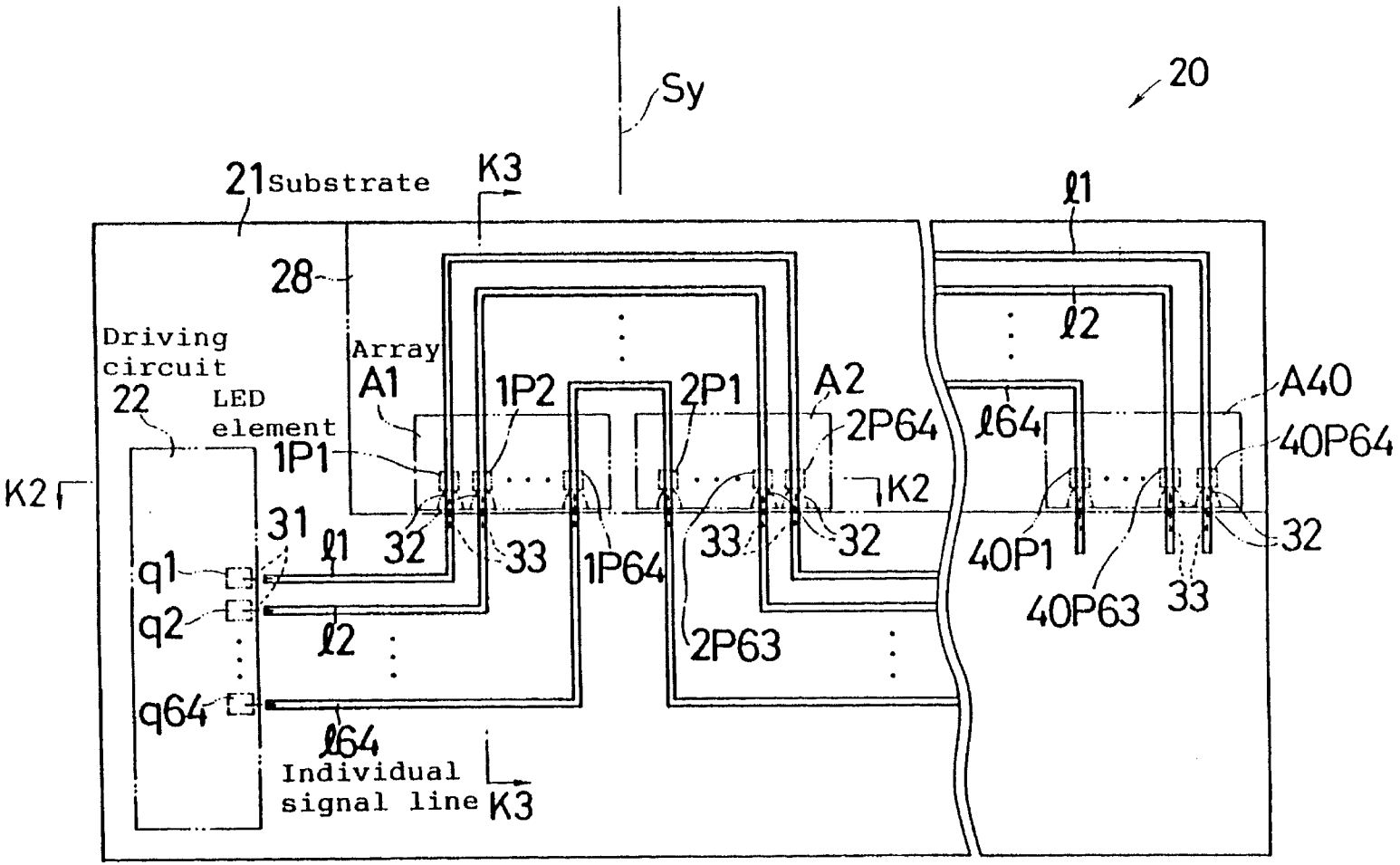
FIG. 12 is a plan view showing individual signal lines l1 to l64 formed on a substrate 21 of an optical printer head 20 in one of the embodiment of the invention.
Figure 13:
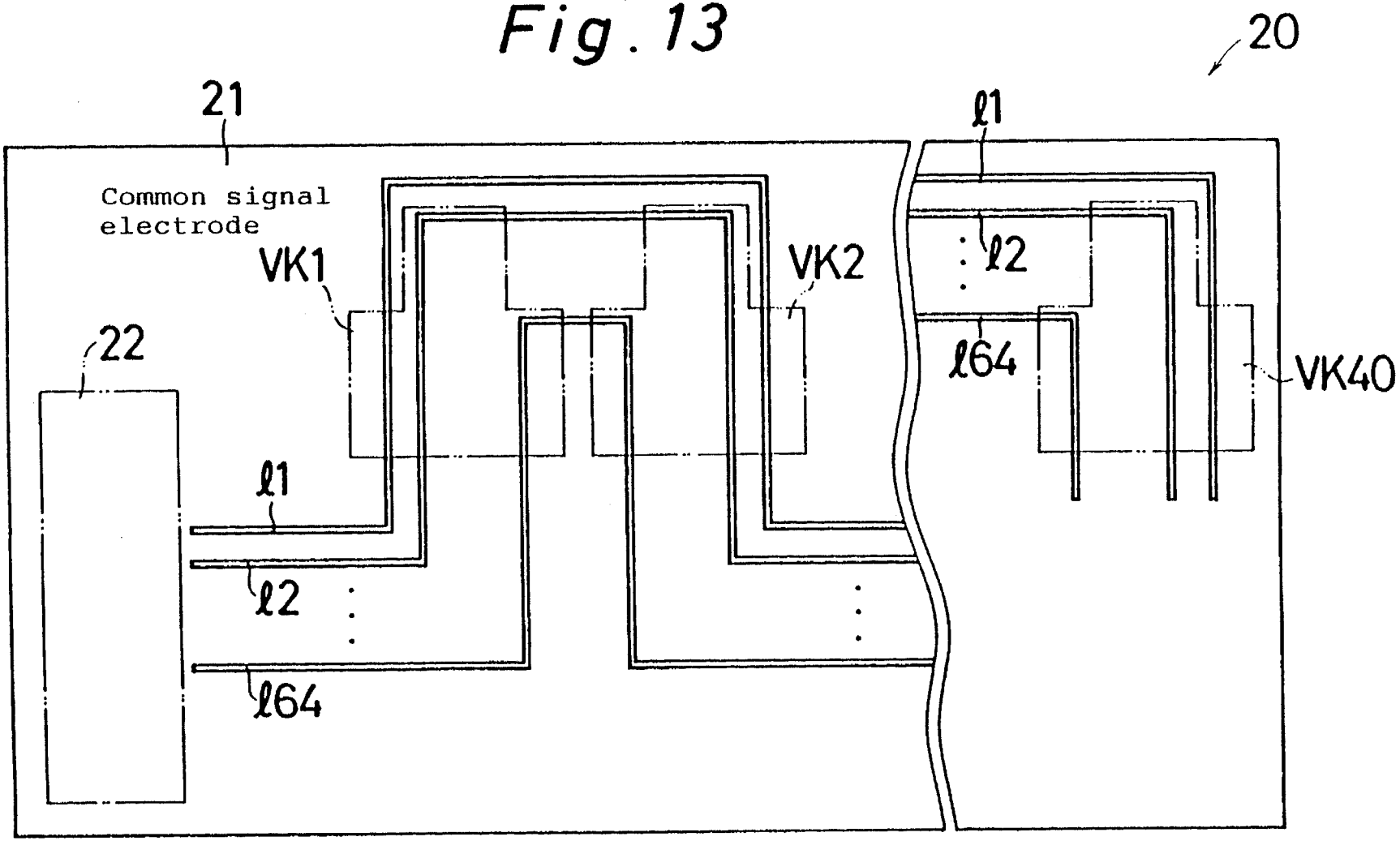
FIG. 13 is a plan view of the substrate 21 showing common signal electrodes VK1 to VK40.
Figure 14:
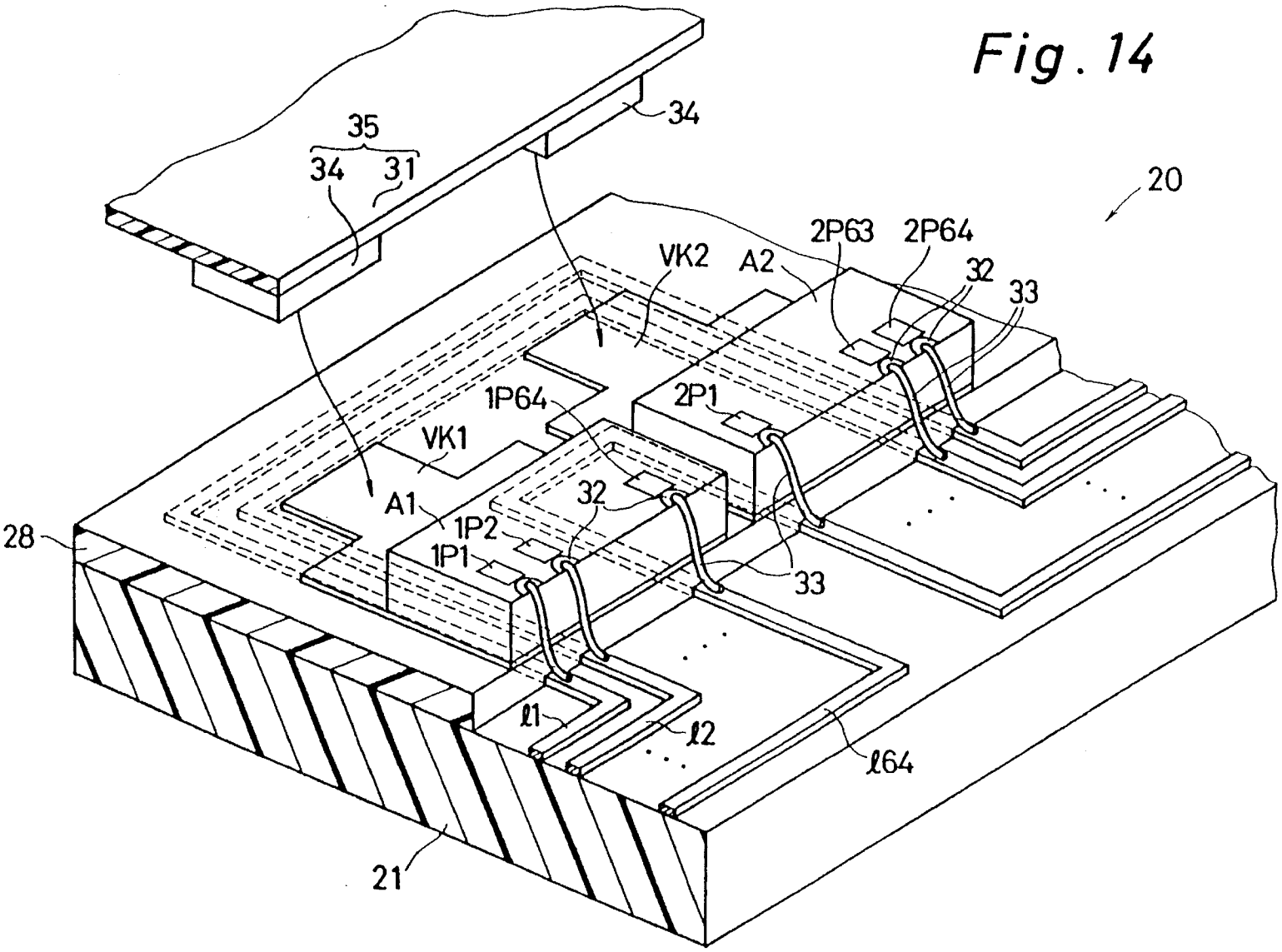
FIG. 14 is a partially cut-away perspective view of an optical printer head 20 of the same embodiment.

FIG. 12 is a plan view showing individual signal lines l1 to l64 formed on a substrate 21 of an optical printer head 20 in a first embodiment of an image forming apparatus of the invention, FIG. 13 is a plan view of the substrate 21 showing common signal electrodes VK1 to VK40, and FIG. 14 is a partially cut-away perspective view of the optical printer 20 of the embodiment shown in FIG. 12 and FIG. 13. The substrate 21 is made of an electrically insulating material such as ceramic and glass, and individual signal lines l1 to l64 are formed on its surface, being deposited in zigzag form or in crank form.

Figure 15:
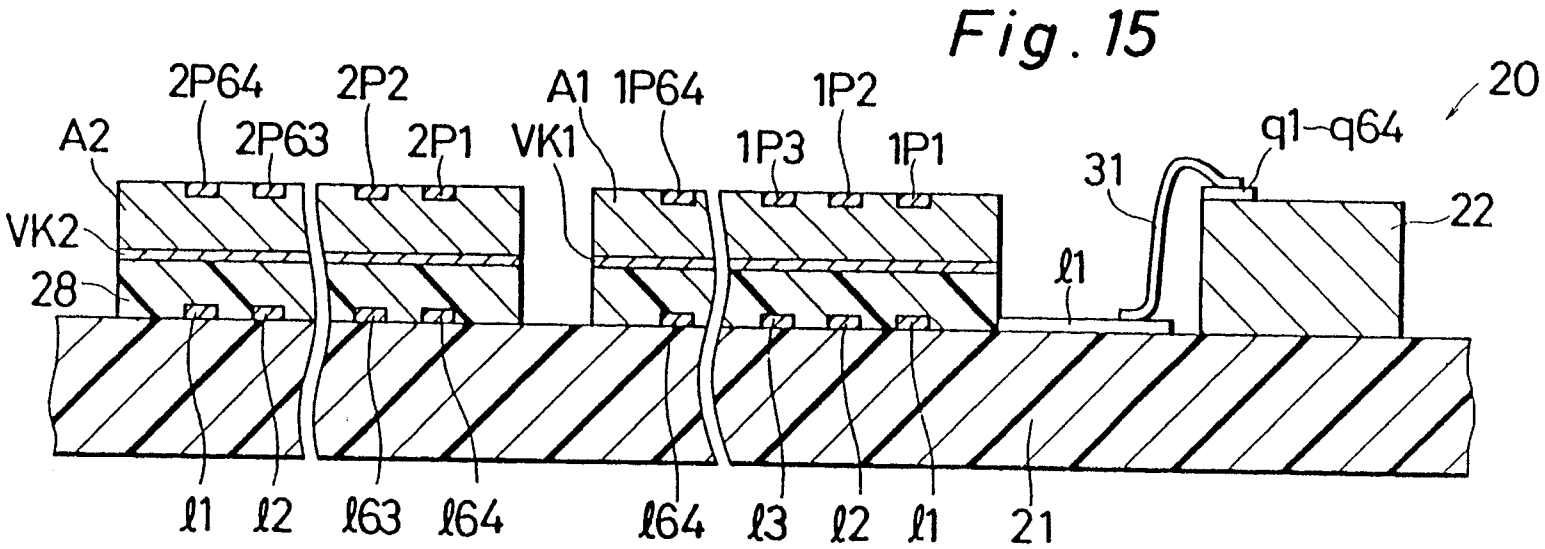
FIG. 15 is a sectional view from line K2—K2 of FIG. 12.
Figure 16:
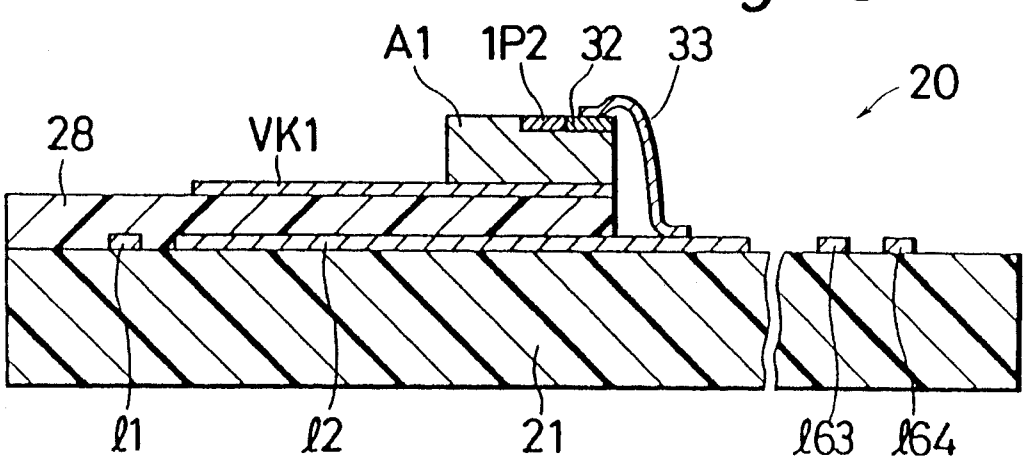
FIG. 16 is a sectional view from line K3—K3 of FIG. 12.

FIG. 15 is a sectional view seen from line K2—K2 in FIG. 12, and FIG. 16 is a sectional view seen from line K3—K3 in FIG. 12. Referring to these drawings, on the substrate 21, electric insulation layers 28 are formed in the upper half of FIG. 12 from the individual signal lines l1 to l64. On the electric insulation layers 28, common signal electrodes VK1 to VK40 are formed. On the common signal electrodes VK1 to VK40, individually LED arrays A1 to A40 are joined, and these common signal electrodes VK1 to VK40 function as one of the terminals for illuminating by passing currents to each one of LED elements 1p1 to 1p64, 2p1 to 2p64, . . . , 40p1 to 40p64 of the arrays A1 to A40.

As the LED elements 1p1 to 1p64, . . . , 40p1 to 40p64, LED elements of GaAsP, GaP or similar compounds are used. For example, in the case of GaAsP type LED elements, first the GaAs substrate is heated to a high temperature in an oven, and is brought to contact with a gas properly containing $AsH_3$ (arsine), $PH_3$ (phosphine) and Ga (gallium) to grow the single crystal of GaAsP (gallium-arsenic-phosphorus) of an n-type semiconductor, and then a membrane of $Si_3N_4$ (silicon nitride) with a window is deposited on the GaAsP single crystal surface, and this window is exposed to gas of Zn (zinc) to diffuse Zn in part of the single crystal layer of GaAsP of the n-type semiconductor to form a p-type semiconductor, thereby bringing about pn junction to form the element.

The LED elements 1p1 to 1p64 are linearly arranged on the array A1, and the array A1 possesses 64 LED elements 1p1 to 1p64, and a total of 40 arrays having similar structure are linearly arranged as indicated by reference numbers A1 to A40. As a result, a total of 2,560 LED elements can be used for printing.

The individual signal lines l1 to l64 and the common signal electrodes VK1 to VK40 may be formed by thin film technique such as vapor deposition and sputtering, or by thick film technique such as screen printing. The individual signal lines l1 to l64 are connected individually to the output terminals q1 to q64 of a driving circuit 22 realized as an integrated circuit at one side of the LED arrays A1 to A40 (the left side in FIG. 12), by means of bonding wires 31 which are thin wires. This driving circuit 22 is to selectively illuminate and drive the LED elements 1p1 to 40p64 by response to the print data signal, and it is fabricated by the semiconductor technology.

The LED elements 1p1 to 1p64 are individually provided with terminals 32. These terminals 32 are connected to the exposed parts, not covered with the electric insulation coating layers 28, of the individual signal lines l1 to l64, individually by bonding wires 33. Such structure of connection is same as in the remaining LED arrays A2 to A40. In this way, for example, in LED arrays A1, A2, the LED elements 1p1 and 2p64 are connected and LED elements 1p2 and 2p63 are connected, and thereafter similarly the LED elements 1p64 and 2p1 are connected through individual signal lines l1 to l64. The individual signal lines l1 to l64 and common signal electrodes VK1 to VK40 are made of aluminum, copper or similar material. The bonding wires 31, 33 are made of aluminum, gold or similar material.

The common signal electrodes VK1 to VK40 are individually connected to the thin conductors 34 formed on the flexible film 31. Thus, the film 31 and conductors 34 composed a flexible wiring substrate 35.

Figure 17:
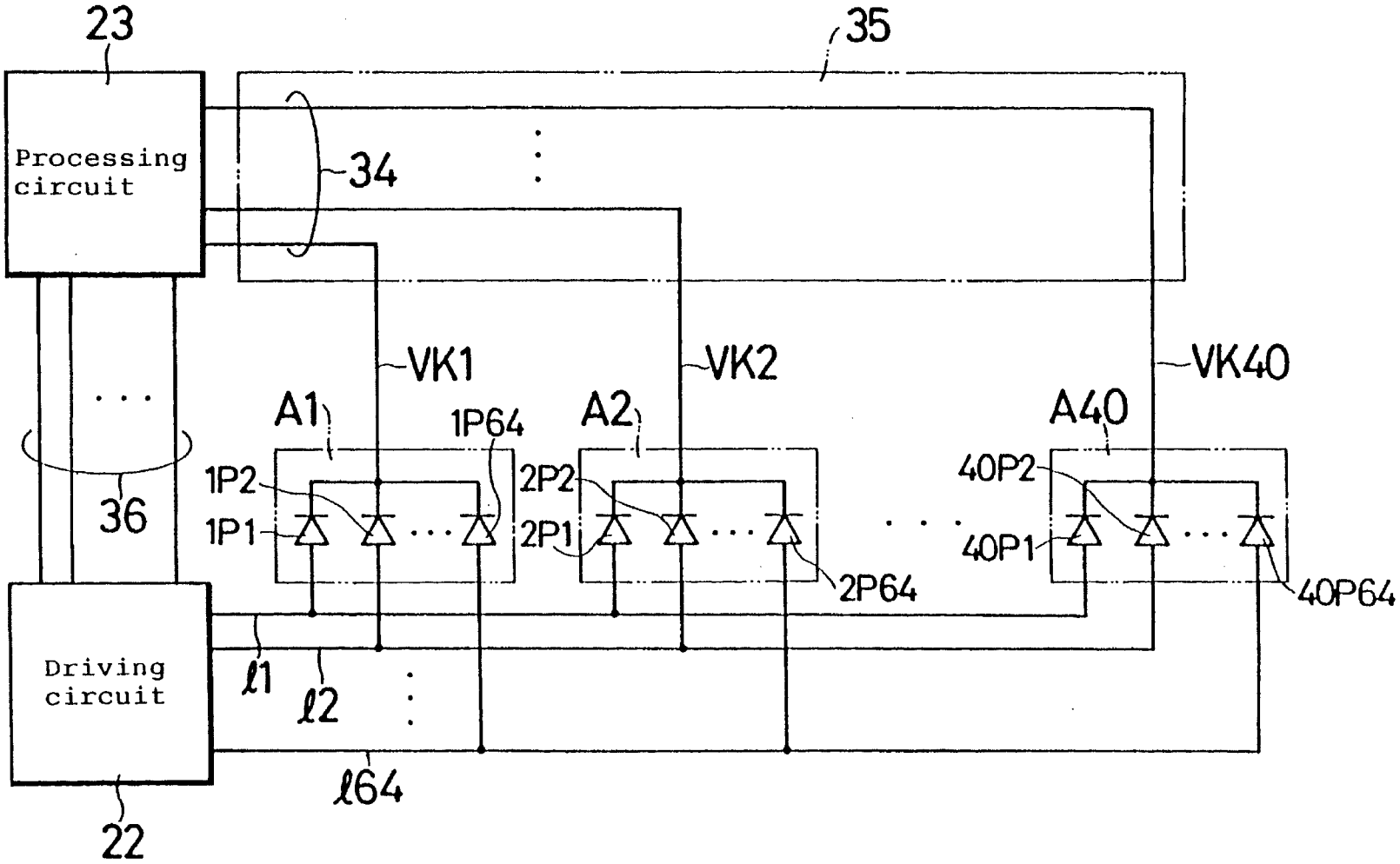
FIG. 17 is an electrical circuit diagram of an embodiment of the invention.

Referring now to FIG. 17, an electrical structure relating to the substrate 21 is shown. The flexible wiring substrate 35 is connected to a processing circuit 23 which is realized by computer of the like, and the driving circuit 22 is connected to the processing circuit 23 through a line representatively indicated by reference number 36. The processing circuit 23 leads out a strobe signal to the conductor 34 of the flexible wiring substrate 35 as stated later, and also functions as the print data source for leading out print data to the driving circuit 22.

Figure 18:
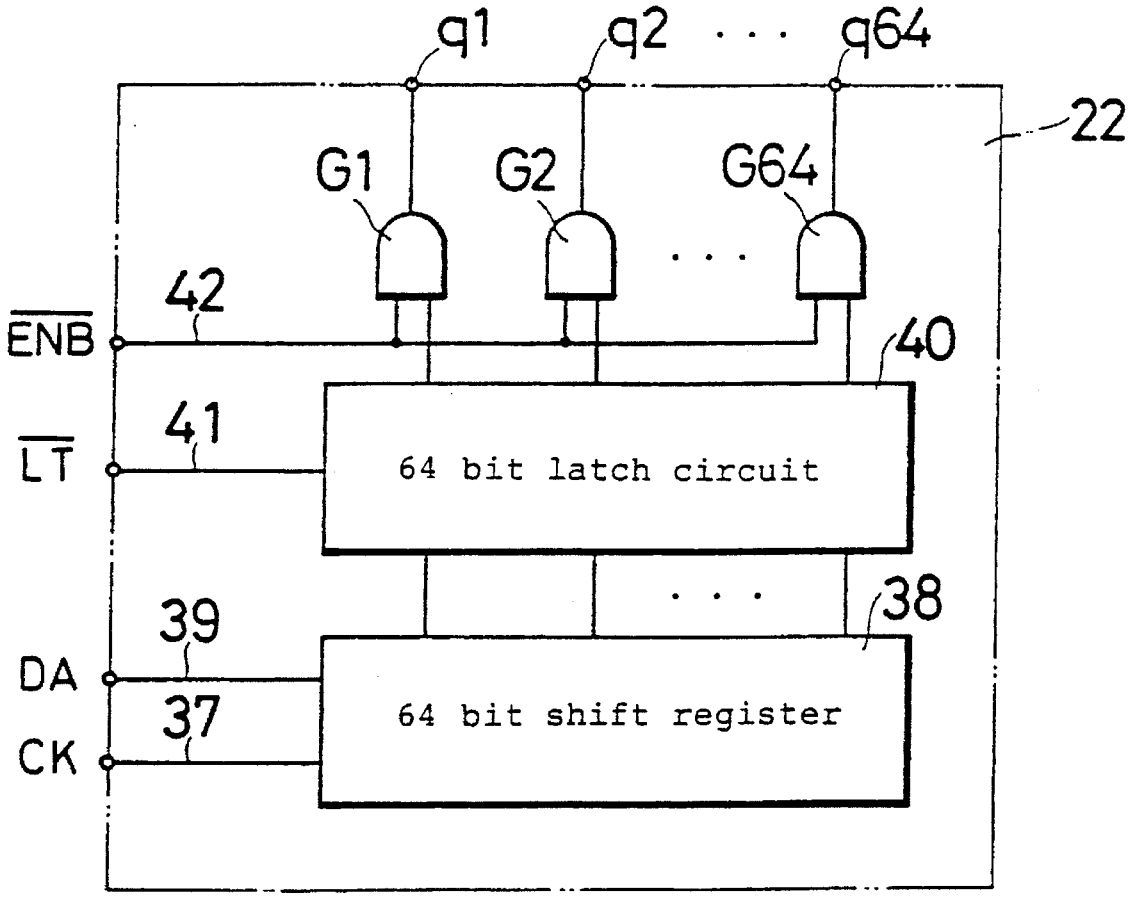
FIG. 18 is a block diagram showing a practical electrical composition of an integrated circuit 22.

FIG. 18 is a block diagram showing a practical elecrical structure of the driving circuit 22. A clock signal CK is given to a line 37, and this clock signal CK is given to a shift register 38 having 64 bits individually corresponding to 64 LED elements 1p1 to 1p64, . . . , 40p1 to 40p64 of each one of LED arrays A1 to A40. This shift register 38 serially and sequentially strobes the print data DA bit by bit which is given through a line 39 in response to clock signal CK from the line 37. A 64-bit latch circuit 40 simultaneously reads and store parallel the information stored in the shift register 38 in response to the latch signal $\overline{LT}$ from the line 41. The output from this latch circuit 40 is given to one of the inputs of AND gates G1 to G64 individually corresponding to the bits. To the other inputs of the AND gates G1 to G64, commonly, strobe signal $\overline{ENB}$ are given from the line 42. The AND gates G1 to G64 apply the stored information for the portion of one array from the latch circuit 40 parallel to the output terminals q1 to q64 when strobe signal $\overline{ENB}$ is given to the line 42.

Figure 19:
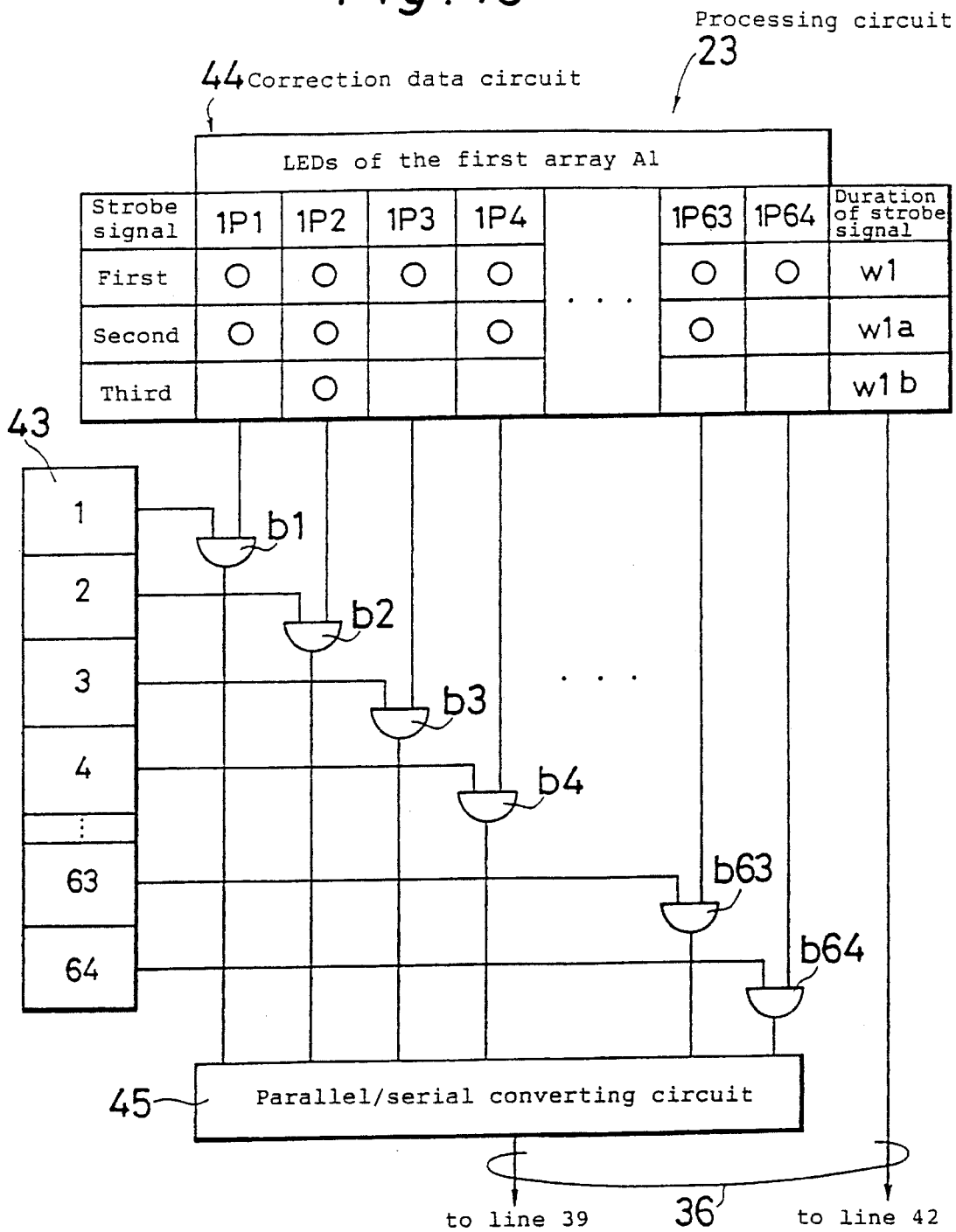
FIG. 19 is a block diagram showing a practical electrical composition of a part of a processing circuit 23, FIGS. 20(1)–20(4) and FIGS. 21(1)–21(7) are waveform diagrams for explaining the operation.

FIG. 19 is a block diagram showing a practical electrical structure of part of the processing circuit 23. Individually corresponding to the 64 LED elements 1p1 to 1p64, . . . , 40p1 to 40p64, respectively contained in each one of LED arrays A1 to A40, a total of 64 pieces of print data DA are individually stored in the registers 43. The output of each bit of registers 43 is given to the one of the inputs of the AND gates b1 to b64 disposed individually. At the other inputs of the AND gates b1 to b64 are stored the data for expressing the emission drive time corresponding to the emission outputs having fluctuations of arrays A1 to A40 from the correction data circuit 44 and LED elements 1p1 to 1p64, . . . , 40p1 to 40p64 individually disposed in each array.

For example, in FIG. 19, the data relating to the emission time of each one of LED elements 1p1 to 1p64 of the first array A1 are stored, and when executing in an electrophotographic apparatus, in order to expose at a desired, predetermined constant exposure on the photoreceptor by the first array A1, the information to be driven is stored corresponding to plural times (3 times in this embodiment) of strobe signal $\overline{ENB}$, regardless of the fluctuations of the emission output of the LED elements 1p1 to 1p64.

The first strobe signal persists for duration W1, and in this period, emission driving of all LED elements 1p1 to 1p64 is possible. The duration W1 is a time determined so as to be exposed optimally corresponding to the mean of the emission output of the 64 LED elements 1p1 to 1p64. The LED elements 1p1, 1p2, 1p4, 1p63, etc. which possess the lower emission output than the mean emission output may be driven for duration W1*a* while the second strobe signal $\overline{ENB}$ is generated. The LED element 1p2 having the lower emission output may be further driven for duration W1*b* while the third strobe signal $\overline{ENB}$ is generated.

In this way, if there is fluctuation in the emission outputs among the LED elements 1p1 to 1p64, an optimum exposure quantity may be obtained on the photoreceptor by selective emission driving for plural times.

The duration W1 of the first strobe signal $\overline{ENB}$ corresponds to the mean of the emission output of the first array A1, and it is so set that the duration W1 may be longer when the mean emission output is low. The LED elements 1p1, 1p2, 1p4, 1p63 and others lower than the mean emission output are designed to be driven more times as the emission outputs are lower, by storing the information about the number of times of emission. In the remaining second to fortieth arrays A2 to A40, similar information is stored in the correction data circuit 44. In the register 43 for storing the print data, the data of the arrays A1 to A40 to be emitted and driven are sequentially transferred and stored in the emission driving period of arrays A1 to A40.

Figure 20:
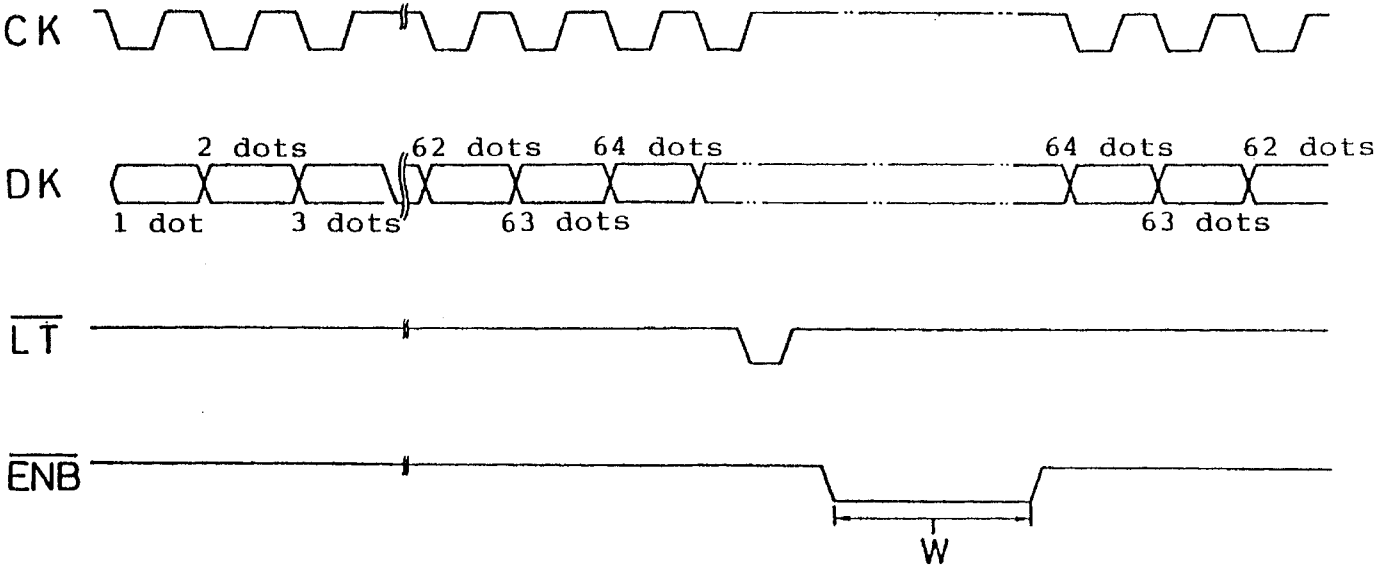

FIG. 20 (1) shows a clock signal CK given to the line 37 of the driving circuit 22. In the parallel/serial converting circuit 45 in the processing circuit 23, outputs of AND gates b1 to b64 are given, and these parallel bit signals are converted into series signals, which are given to the line 39 of the driving circuit 22 through line 36 from the processing circuit 23. The print data given to the line 39 is shown in FIG. 20 (2).

When 64 pieces of print data are serially and sequentially stored in synchronism with the clock signal CK of line 37, the latch signal $\overline{LT}$ shown in FIG. 20 (3) is later given to the line 41, and the information of the shift register 38 is transferred to the latch circuit 40. The strobe signal $\overline{ENB}$ is given from the correction data circuit 44 of the processing circuit 23 to the line 42, and the waveform of this strobe signal $\overline{ENB}$ is as shown in FIG. 20 (4). For the time indicated by reference code W, the signal of the latch circuit 40 is commonly given to LED elements 1p1 to 1p64, . . . , 40p1 to 40p64 of arrays A1 to A40, parallel from the output terminals q1 to q64 through individual signal lines l1 to l64. The processing circuit 23 gives potential to the common signal electrodes VK1 to VK40 from the line 34,and selects the arrays A1 to A40 one by one.

Figure 21:
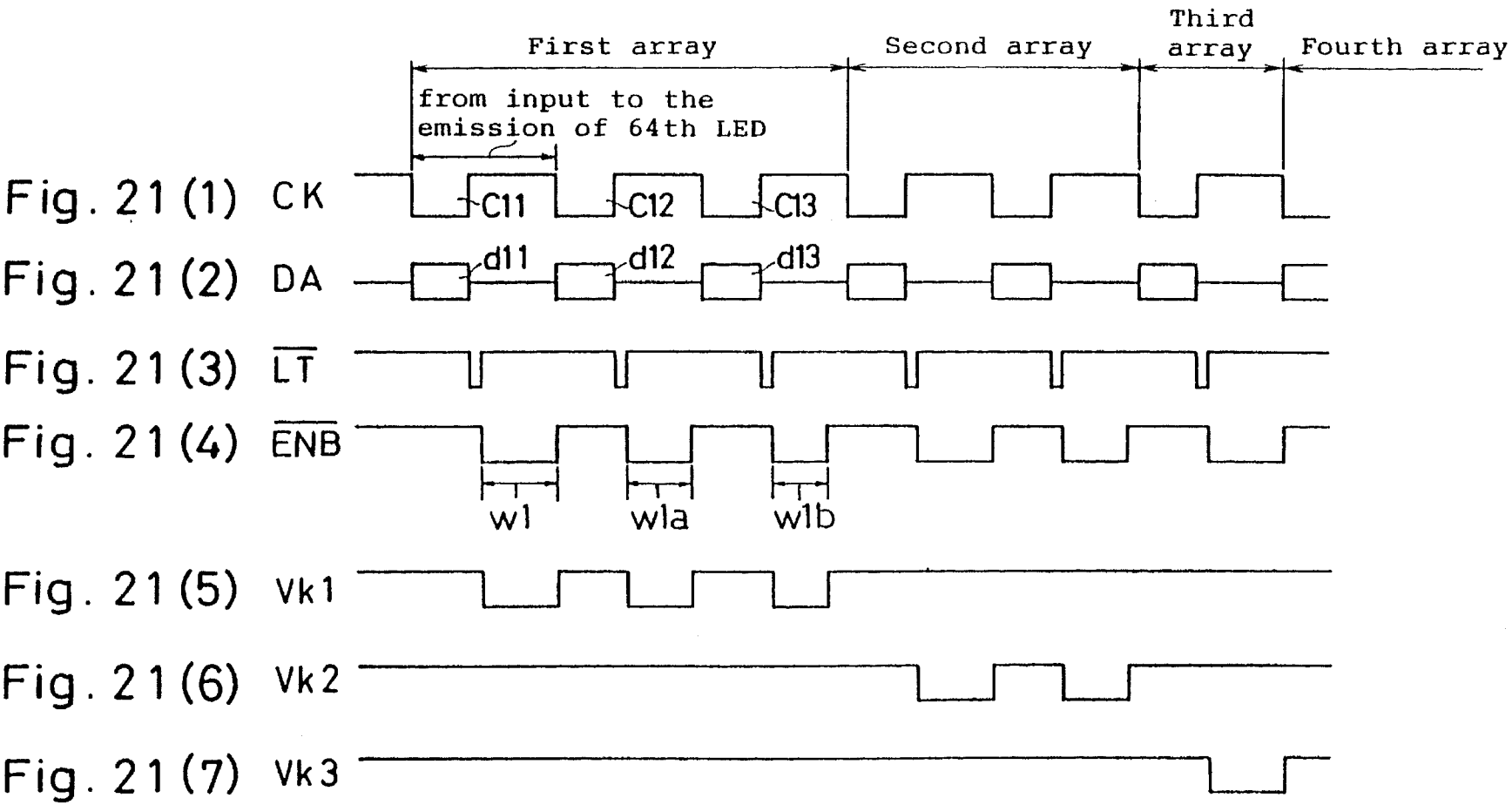

FIG. 21 is a waveform diagram showing by shortening the time axis shown in a simplified form in FIG. 20, and it is to explain the operation for obtaining a desired exposure quantity on the photoreceptor by emitting and driving the LED elements 1p1 to 1p64 of the first array A1. To the line 37, a clock signal c11 indicated by reference number c11 in FIG. 21 (1) is given, and correspondingly to the line 39, print data d11 indicated by reference number d11 in FIG. 21 (2) is given. In this way, in the shift register 38, the print data DA of LED elements 1p1 to 1p64 corresponding to the first strobe signal $\overline{ENB}$ in FIG. 19 are stored. As shown in FIG. 21 (3), by giving the latch signal $\overline{LT}$ to the line 41, the content in the shift register 38 is transferred to the latch circuit 40. Here, as shown in FIG. 1 (4), the strobe signal $\overline{ENB}$ persisting for the duration W1 is given to the line 42. At this time, the signal shown in FIG. 21 (4) is given to the common signal electrode VK1. Thus, for the duration W1, the LED elements 1p1 to 1p64 corresponding to the print data for the array A1 stored in the register 43 are selectively illuminated and driven for duration W1.

Next, by the clock signal c12, the print data d12 selected by the data corresponding to the second strobe signal $\overline{ENB}$ in FIG. 19 and the print data DA stored in the shift register 43 is given to the shift register 38. Being transferred to the latch circuit 40 in this way, the LED elements 1p1, 1p2, 1p4, 1p63 lower in the emission output are selectively illuminated and driven for duration W1*a* depending on the print data stored in the register 43.

Next, by the clock signal c13, the third strobe signal d13 is stored in the shift register 38, and then it is transferred to the latch circuit 40. This print data signal d13 is selectively illuminate and drive on the basis of the print data stored in the register 43 the LED element 1p2 low in the emission output corresponding to the third strobe signal in FIG. 19, and its duration is indicated by W1*b*. To correct the fluctuations of the emission outputs of arrays A1 to A40, signals are given to the individual signal lines l1 to l64 for the duration W1, but in other embodiment of the invention, the signals may be applied to the common signal electrodes VK1 to VK40 for duration W1. In this manner, besides, printing of higher grade may be realized.

In the second array A2, for example, if the fluctuations of the emission outputs of the LED elements 2p1 to 2p64 are relatively small, it is enough to emit and drive by generating the strobe signal $\overline{ENB}$ only twice, and moreover, for example, if the fluctuations of the emission outputs of the LED elements 3p1 to 3p64 in the third array A3 are further smaller, the strobe signal $\overline{ENB}$ may be generated only once. FIG. 21 (6) shows the signal given to the common signal electrode VK2, and FIG. 21 (7) shows the signal given to the common signal electrode VK3.

In this way, depending on the fluctuations of the emission outputs of arrays A1 to A40, the duration of the first strobe signal $\overline{ENB}$ (for example, the duration indicated by reference number W1 in FIG. 19) may be defined to be longer if the emission output is lower, so that it is possible to suppress the undesired variations of the exposure quantity due to fluctuations of the emission outputs of the arrays A1 to A40.

Furthermore, in each array, for example, in A1, if there are fluctuations of emission output of 64 LED elements 1p1 to 1p64, emission is effected plural times, and the elements of lower emission outputs are emitted more times so that it may be possible to suppress the variations of the exposure quantity due to fluctuations of emission outputs of the individual LED elements 1p1 to 1p64. Moreover, it is possible to print at higher grade.

In the foregoing embodiment, the arrays A1 to A40 are individually and sequentially activated, and only the maximum of 64 LED elements 1p1 to 1p64, . . . , 40p1 to 40p64 contained in the individual arrays A1 to A40 are emitted and driven, and hence the number of LED elements to be emitted and driven simultaneously is small. Therefore, only a small current may be passed at a time. Accordingly, a power supply with a small capacity may be used. Still more it is possible to reduce the Joule heat generated by the LED elements 1p1 to 1p64, . . . , 40p1 to 40p64, individual signal lines l1 to l64, common signal electrodes VK1 to VK40, and bonding wires 31, 33. As a result, changes in the emission wavelength and brightness depending on the temperature of LED elements may be suppressed, and the fluctuations of emission wavelength and brightness of each LED element may be suppressed. Consequently, clearer printing is realized, and uneven printing may be prevented at the same time. What is more, heat sink for cooling is not needed, and if necessary, only a small one may be enough. It is hence easier to mount in a recording apparatus which is demanded to be smaller and smaller in size recently.

In this embodiment, furthermore, the number of bonding wires 31, 33 is smaller than in the prior art described in FIG. 1 to FIG. 4. Therefore, the time for connecting the bonding wires is shorter, and the productivity may be enhanced, while the reliability may be improved by lowering the rate of defectives in the connection of bonding wires.

In this embodiment, what is more, since a common single driving circuit 22 is used for 40 arrays A1 to A40, the number of parts may be evidently decreased as compared with the prior art having driving circuits 4 individually for the forty arrays A1 to A40.

Figure 22:
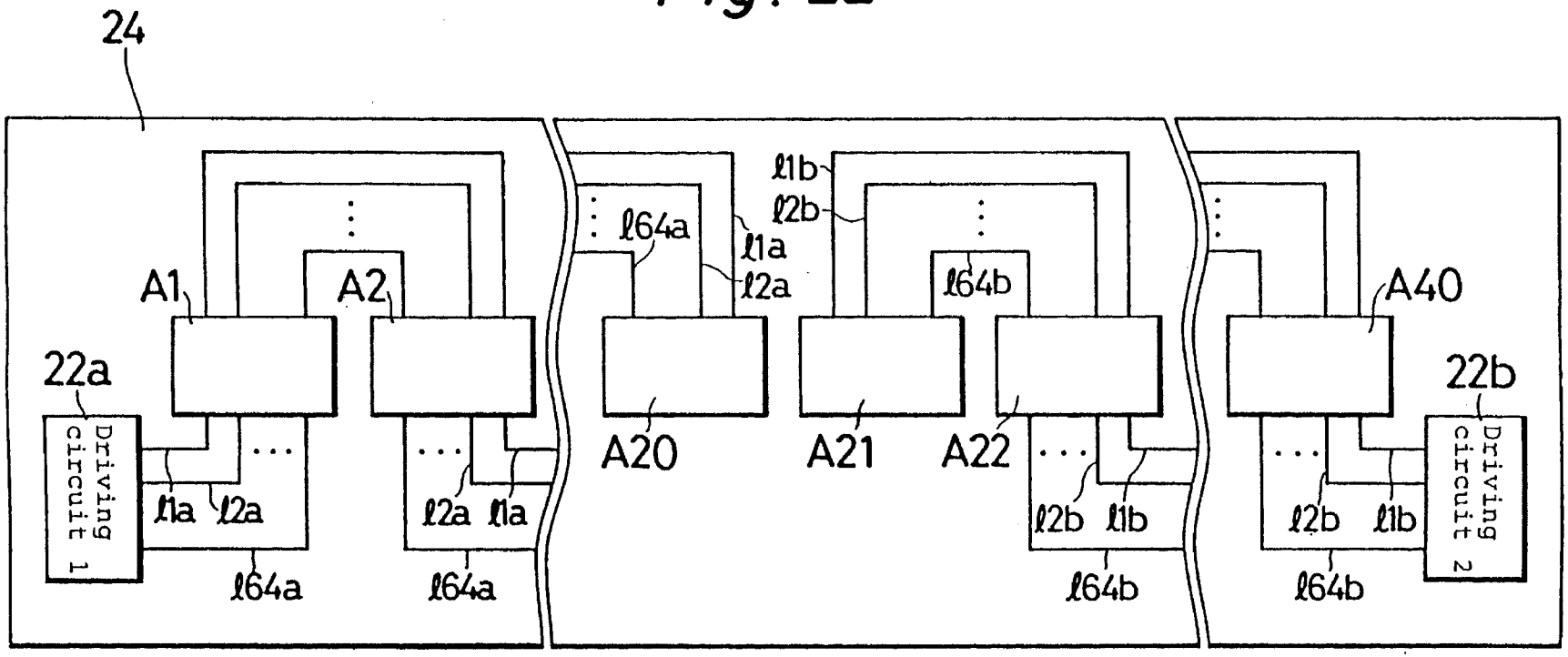
FIG. 22 is a plan view of a substrate 24 in other embodiment of the invention.

FIG. 22 is a simplified plan view of a substrate 24 in a different embodiment of the invention. In this embodiment, a total of 40 arrays A1 to A40 are divided into two groups of 20 arrays each, and the arrays A1 to A20 of one group are connected to a driving circuit 22*a* through individual signal lines l1*b* to l64*a*, while A21 to A40 of other group are connected to a driving circuit 22*b* through individual signal lines l1*b* to l64*b*. By mutually independently driving these arrays A1 to A20, A21 to A40 divided into two groups by two driving circuits 22*a*, 22*b*, the printing speed may be further increased. For example, while driving the array A1 in one group by the driving circuit 22*a*, the array A21 can be driven by the other driving circuit 22*b*.

In another concept of the invention, the arrays A1 to A20, A21 to A40 belonging to two groups may be alternaly, individually and sequentially driven in each group, or according to a further different concept, plural arrays A1 to A40 may be divided into three or more groups, and driving circuits may be in each group for driving.

Figure 23:
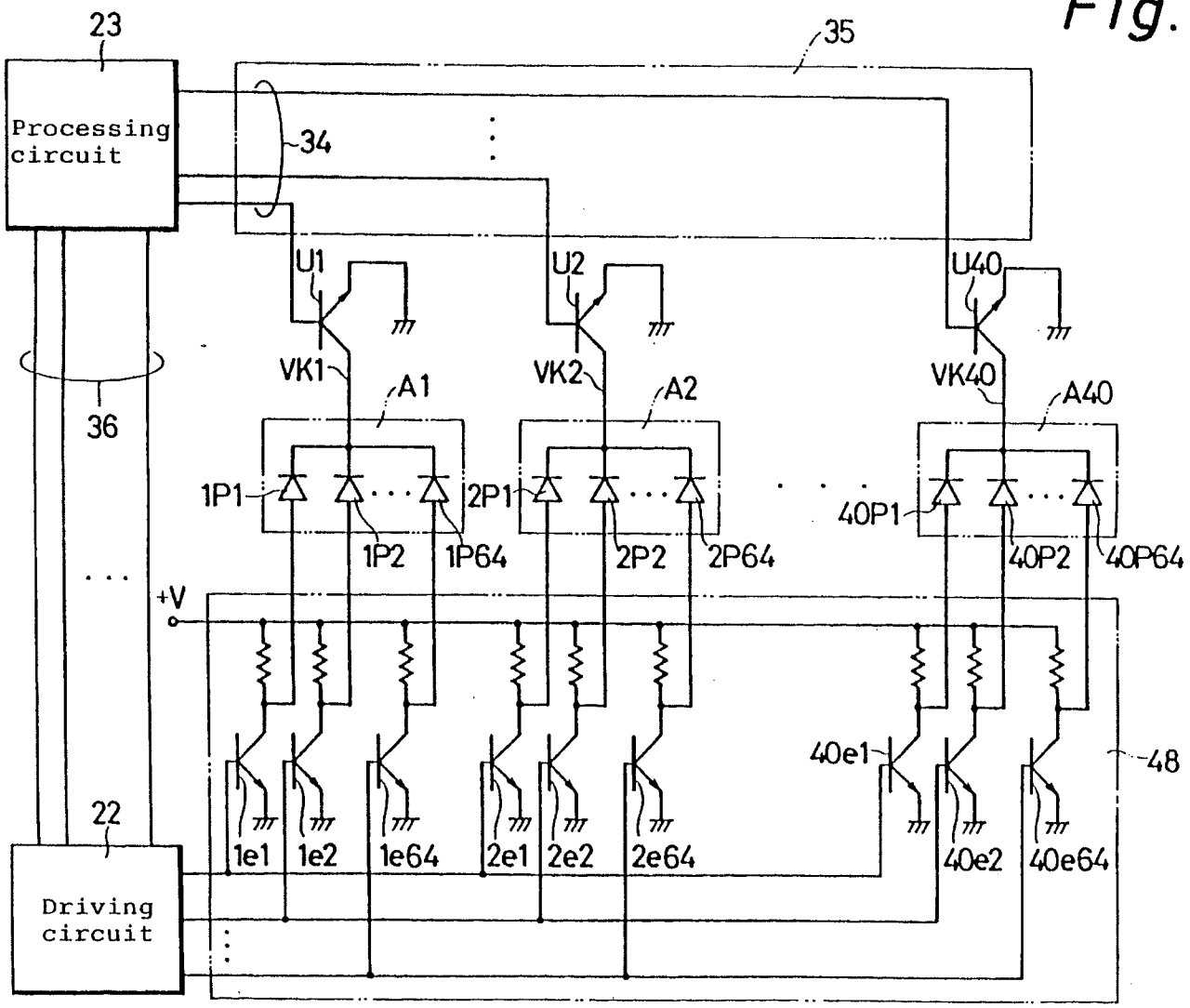
FIG. 23 is an electrical circuit diagram of a further different embodiment of the invention.

In the foregoing embodiments, AND gates G1 to G64 are connected to the LED elements 1p1 to 1p64 in the driving circuit 22, and emission and stopping are effected by opening and closing of the current routes series to the LED elements 1p1 to 1p64, but in another embodiment of the invention, as shown in FIG. 23, to one side of the LED elements 1p1 to 1p64 in one array, for example, A1, a common switching element U1 is connected through the common signal electrode VK1, and at the other terminals, parallel switching elements 1e1 to 1e64 may be connected individually to these LED elements 1p1 to 1p64. In the conductive state of the common switching element U1, when the individual switching elements 1e1 to 1e64 are selectively cut off, the LED elements 1p1 to 1p64 are selectively emitted and driven. Such modifications of the driving circuit 22 and processing circuit 23 may be also possible.

Figure 24:
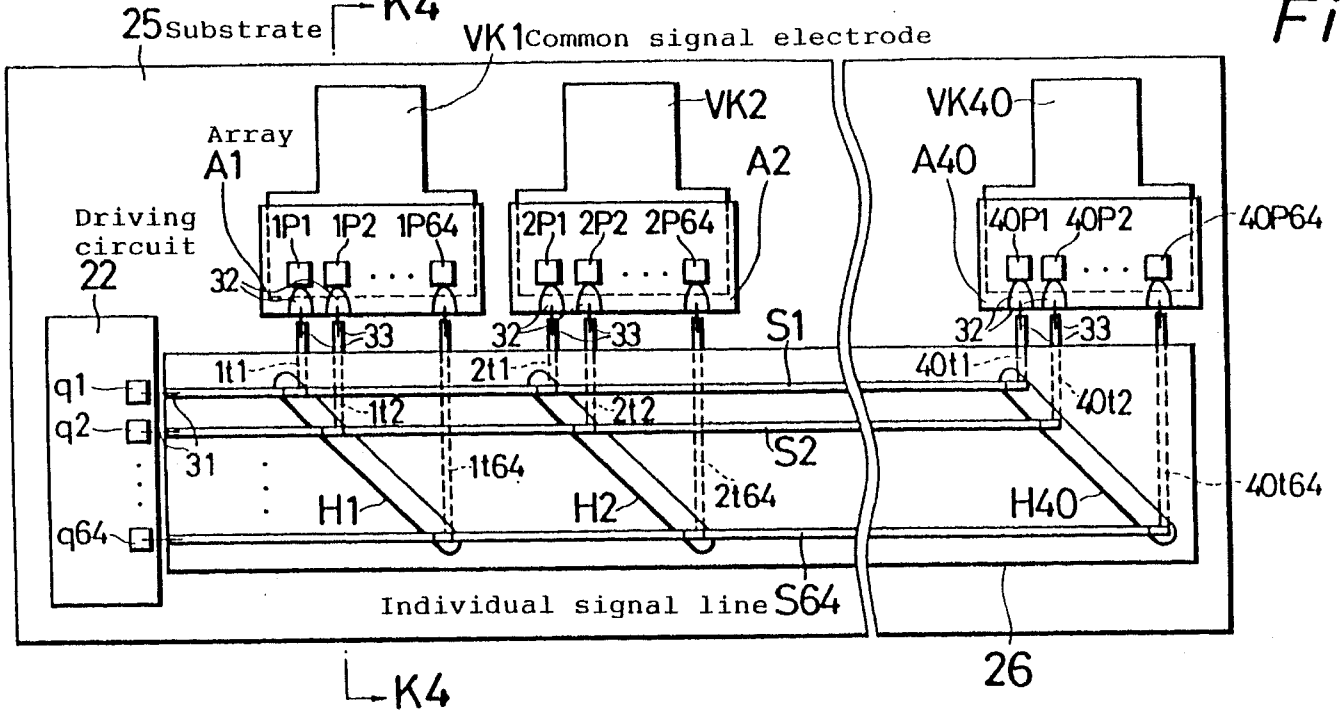
FIG. 24 is a plan view of a substrate 25 in another different embodiment of the invention.
Figure 25:
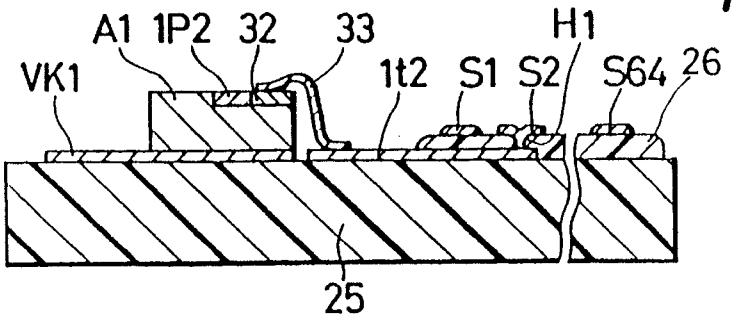
FIG. 25 is a sectional view from line K4—K4 of FIG. 24.

As is obvious in FIG. 12, the wiring may be extremely simple by forming the individual signal line l1 to l64 in zigzag or crank form, but in the structure shown in FIG. 24 and FIG. 25 presented as another embodiment of the invention, wiring of arrays A1 to A40 is also possible. This embodiment shown in FIG. 24 and FIG. 25 is similar to the foregoing embodiments, and corresponding parts are identified with same reference numbers. On the substrate 25, in the first place, first individual signal lines 1t1 to 1t64, 2t1 to 2t64, . . . , 40t1 to 40t64 extending in the vertical direction in FIG. 24 are formed, together with the common signal electrodes VK1, VK2. Next, these first individual signal lines 1t1 to 1t64, . . . , 40t1 to 40t64 are covered with an electric insulating coating layer 26. This electric insulating coating layer 26 possesses exposure holes H1 to H2. Then, forming second individual signal lines S1 to S64 extending in the lateral direction in FIG. 24, the first individual signal lines 1t1, 2t1 are commonly connected, for example, to the signal line S1 at the exposure holes H1, H2. Afterwards, the terminals individually disposed at the LED elements 1p1 to 1p64, . . . , 40p1 to 40p64, and the first individual signal lanes 1t1 to 1t64, . . . , 40t1 to 40t64 are connected with bonding wires 33, while the output terminals q1 to q64 of the driving circuit 22 are connected to the second individual signal lines S1 to s64 by bonding wires 31.

Thus, according to the invention, it is not necessary to pass a large current to the LED elements momentarily, and hence the capacity of the power supply may be reduced, and the changes in the emission wavelength and brightness of the LED elements due to generation of Joule heat, and fluctuations of characteristics of the individual LED elements may be suppressed, and clear printing is possible, and also uneven printing is prevented, and printing of high quality is realized. Besides, the heat sink is not needed, or may be reduced in size, and therefore it is easier to mount on a recording apparatus which is demanded to be smaller in size. Moreover, according to the invention, the number of connections of bonding wires is reduced, and the productivity may be enhanced, and also the rate of defectives may be lowered, so that the reliability may be improved.

Still more, by the invention, the number of driving circuits being used may be decreased, and &he total number of parts may be reduced.

Figure 26:
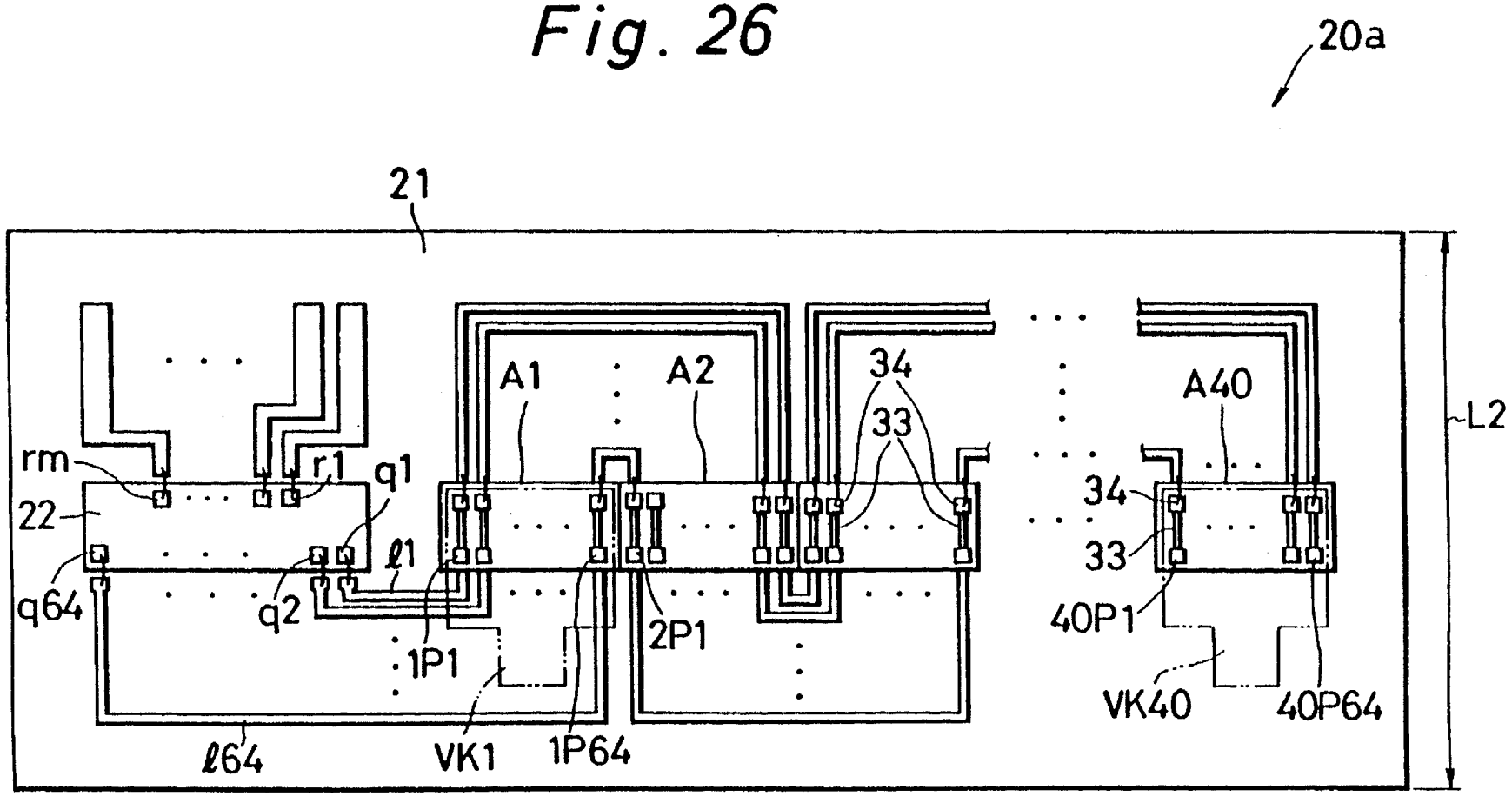
FIG. 26 is a plan view of an optical printer head **20*a* of another embodiment of the invention.

FIG. 26 is a plan view of an optical printer head 20*a* in a second embodiment of the invention. The basic structure of the optical printer head 20 and the printing action are same as those of the optical printer head 20 of the first embodiment, and the same explanation is omitted herein.

In the optical printer head 20*a* of this embodiment, the driving circuit 22 is disposed at an extension of the arrays A1 to A40 arranged linearly on the substrate 21 as shown in FIG. 26. As a result, the necessity of disposing the driving circuits 4 at a rate of 1:1 to the arrays A1 to A40 as in the prior art shown in FIG. 1 is eliminated, and the limitations about the size of the optical printer head 20*a* is eliminated.

Therefore, the mounting density of the LED elements of the arrays A1 to A40 is available in plural types, and if the corresponding arrays A1 to A40 are in plural sizes, it is enough to prepare driving circuits 22 in a same size, which eliminates the necessity of preparing driving circuits 22 in the number of types corresponding to the number of sizes of the arrays A1 to A40 as required in the prior art. Hence, the development of the optical printer head 20*a* is extremely easy, and the production efficiency of the driving circuits 22 may be outstandingly improved.

Besides, if the types of arrays A1 to A20 are relatively high densities, wire bondings of the driving circuit 22 are effected only for a single driving circuit 22, and the job efficiency is notably improved.

Figure 27:
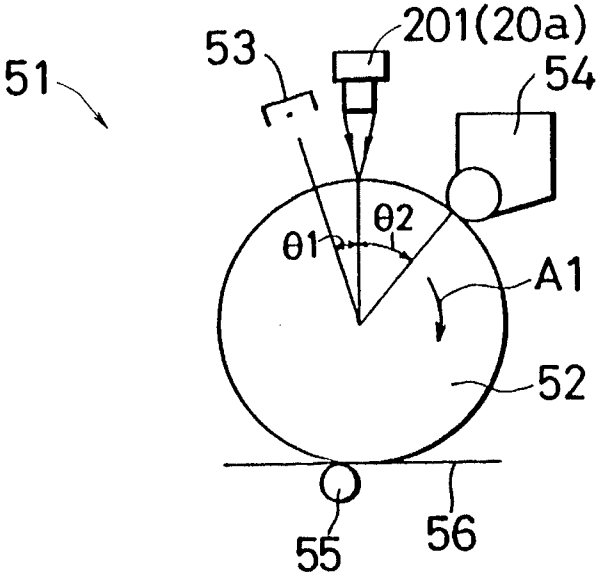
FIG. 27 is a systematic diagram showing a structural example of an optical printer 51.

As the length of the optical printer head 20*a* in the vertical direction in FIG. 26 is shortened as stated above, it is possible to narrow the angles Θ1, Θ2 among the charger 53, optical printer head 20*a* and develping device 53 in the composition of the optical printer 51 for using the optical printer head 20*a* shown in FIG. 27.

Figure 6:
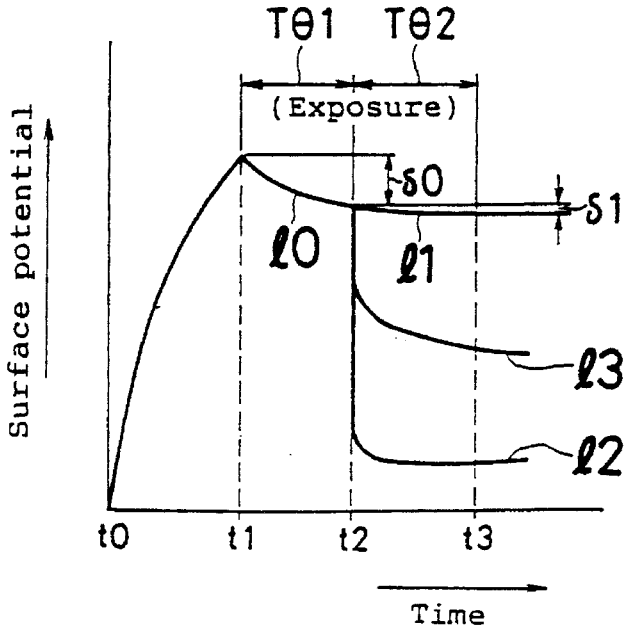
FIG. 6 PRIOR ART
FIG. 6 and FIG. 7 are graphs for explaining the problems of the prior art.
Figure 7:
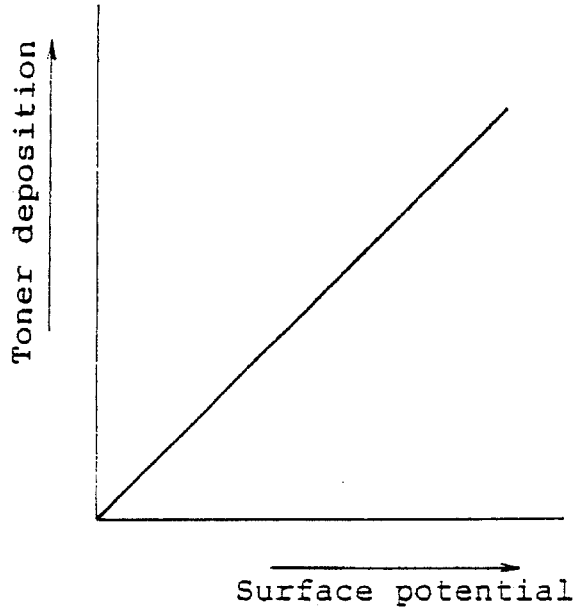
FIG. 7 PRIOR ART
Figure 8:
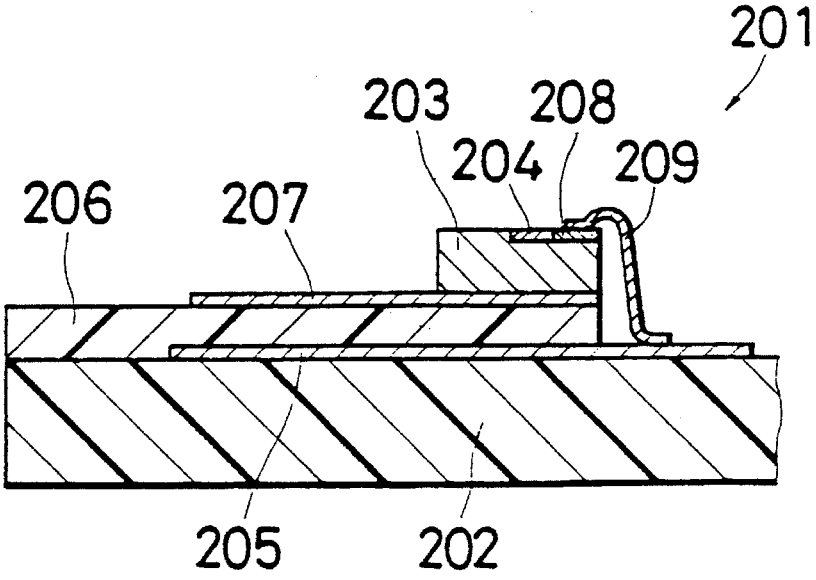
FIG. 8 PRIOR ART
FIG. 8 is a sectional view of an optical printer head 201 in a typical prior art.
Figure 9:
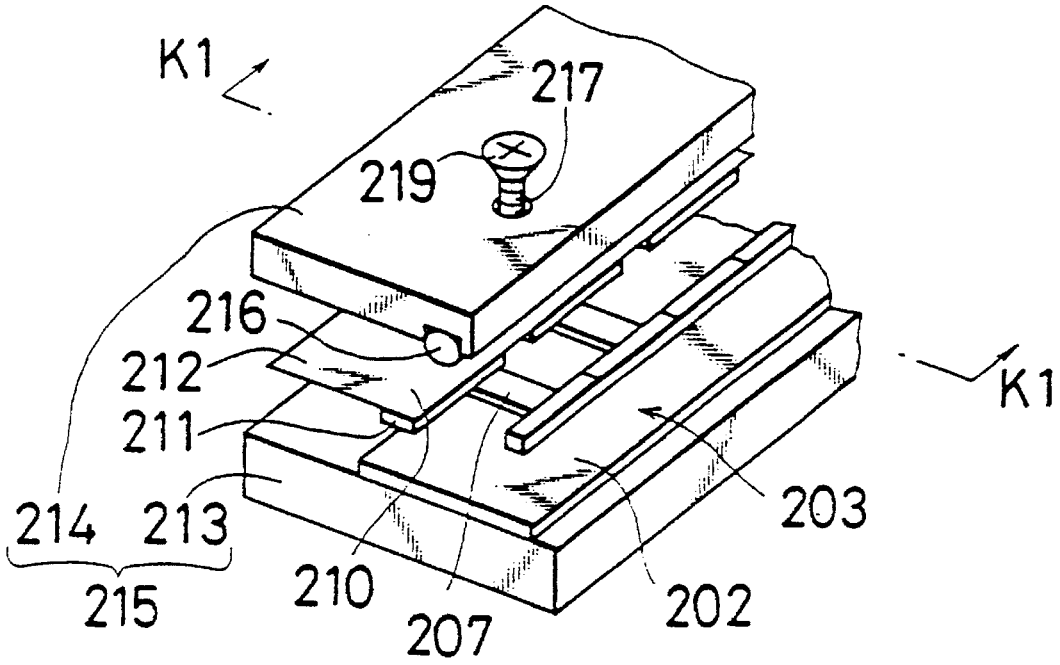
FIG. 9 PRIOR ART
FIG. 9 is an exploded perspective view for explaining the outline shape of the optical printer head 201.
Figure 10:
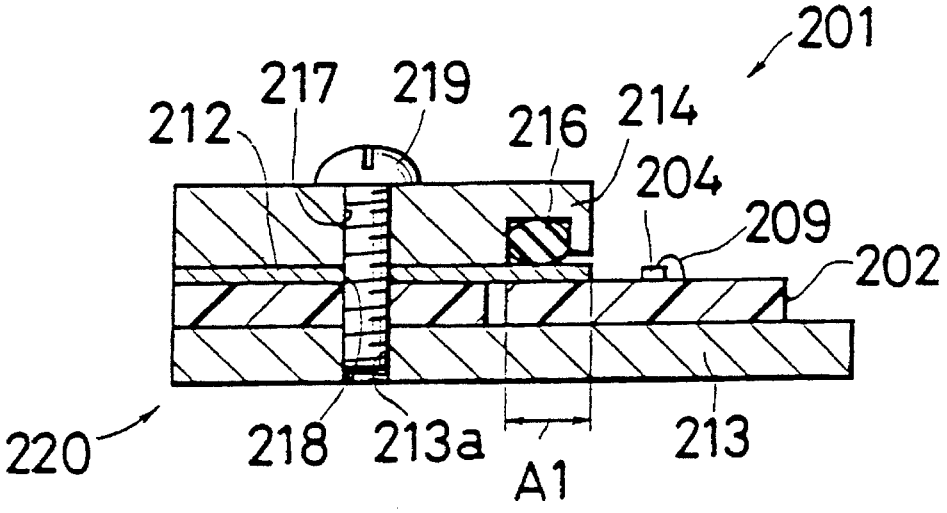
FIG. 10 PRIOR ART
FIG. 10 is a sectional view from line K1—K1 of FIG. 9.

Accordingly, the attenuations δ0, δ1 of the potential explained in relation to the prior art and also in FIG. 6 and FIG. 7 may be decreased, and the print quality may be improved. Or, when downsizing the photosensitive drum 52, relating to the devices to be disposed in the periphery thereof, the angles Θ1, Θ2 corresponding to the intervals of arrangement thereof may be decreased, and the size of the optical printer head 20*a* may be reduced, which may be considered to contribute greatly to reduction of the entire size of the optical printer 51.

Figure 28:
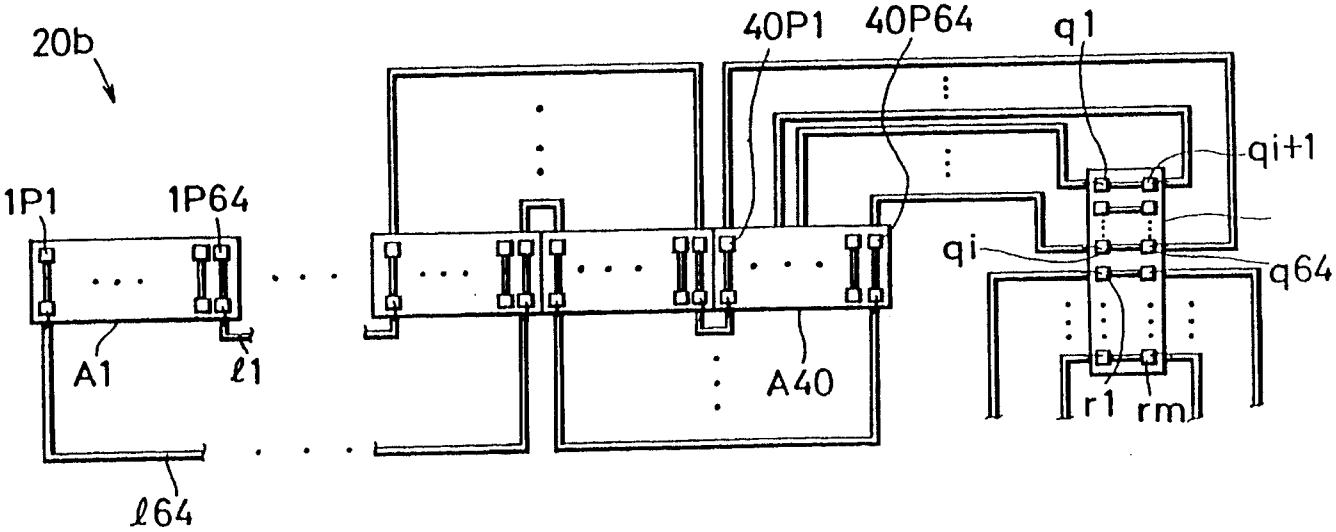
FIG. 28 is a plan view of an optical printer head 20*b* showing a structural example of a different embodiment of the invention.

FIG. 28 is a block diagram for explaining the structure of an optical printer head 20*b* in other embodiment of the invention. This embodiment is similar to the foregoing embodiments, and the corresponding parts are identified with the same reference numbers. What is of note in this embodiment is that, while the driving circuit 22 in the foregoing embodiments is disposed so that its longitudinal direction may be parallel to the direction of arrangement of the arrays A1 to A40, the longitudinal direction of the driving circuit 22 is selected in the direction crossing with the direction of arrangement. Besides, the driving circuit 22 may comprise, as shown in FIG. 28, input terminals r1, r2, . . . , ri+1, . . . , rm, and output terminals q1, . . . , q64, at both edges in the direction crossing with the longitudinal direction. In such composition, too, the same effects as in the foregoing embodiments will be obtained.

In the embodiments of the invention mentioned so far, the position of arrangement of driving circuit 22 may not be limited to a straight line in the direction of arrangement of LED arrays A1 to A40, but may be any other arbitrary position.

Thus, according to the invention, the driving circuit elements are connected on the straight line along the direction of arrangement of the light-emitting circuit elements, in the vicinity of one end common to the individual lines. As a result, the size of the optical printer head in the direction crossing with the direction of arrangement of the light-emitting circuit elements may be reduced, and the structure may be reduced in size. Besides, it is not necessary to arrange the driving circuit elements at a rate of 1:1 to the light-emitting circuit elements, and hence the limitation about the size of the driving circuit elements as mentioned in the prior art is eliminated, and it is enough to use driving circuit elements in a single size for light-emitting circuit elements in plural sizes, so that the production efficiency of these driving circuit elements and image forming apparatus may be outstandingly enhanced.

Figure 29:
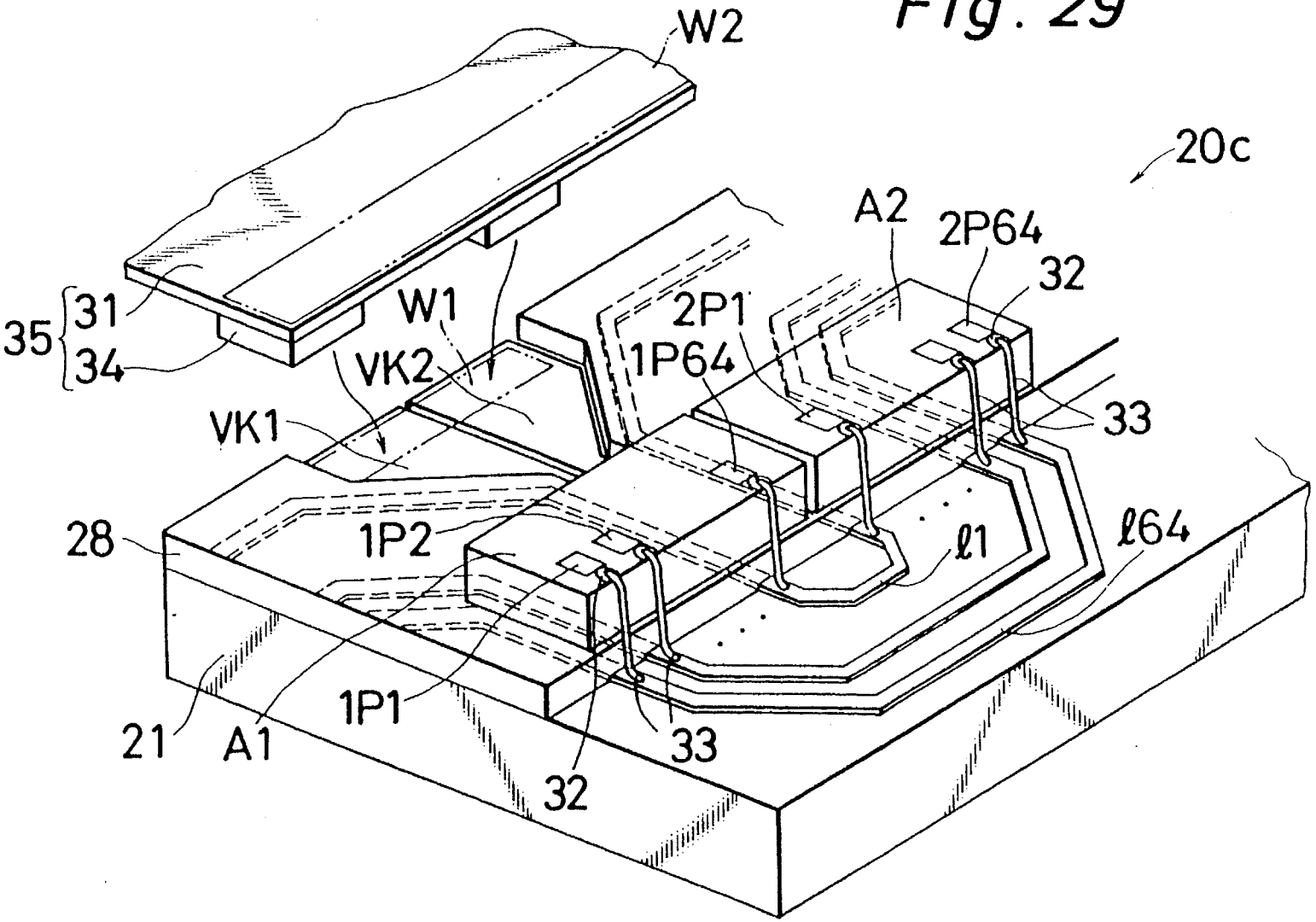
FIG. 29 is a perspective view of an optical printer head 20*c* in an embodiment of the invention.
Figure 30:
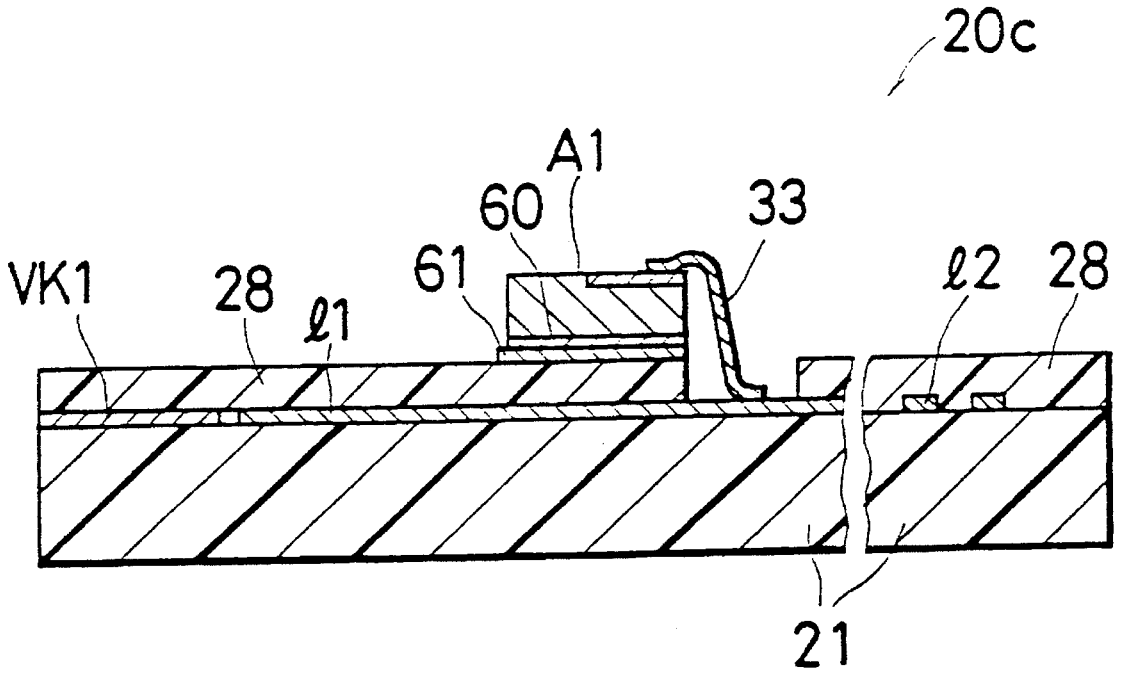
FIG. 30 is a sectional view of an optical printer head 20*c*.
Figure 31:
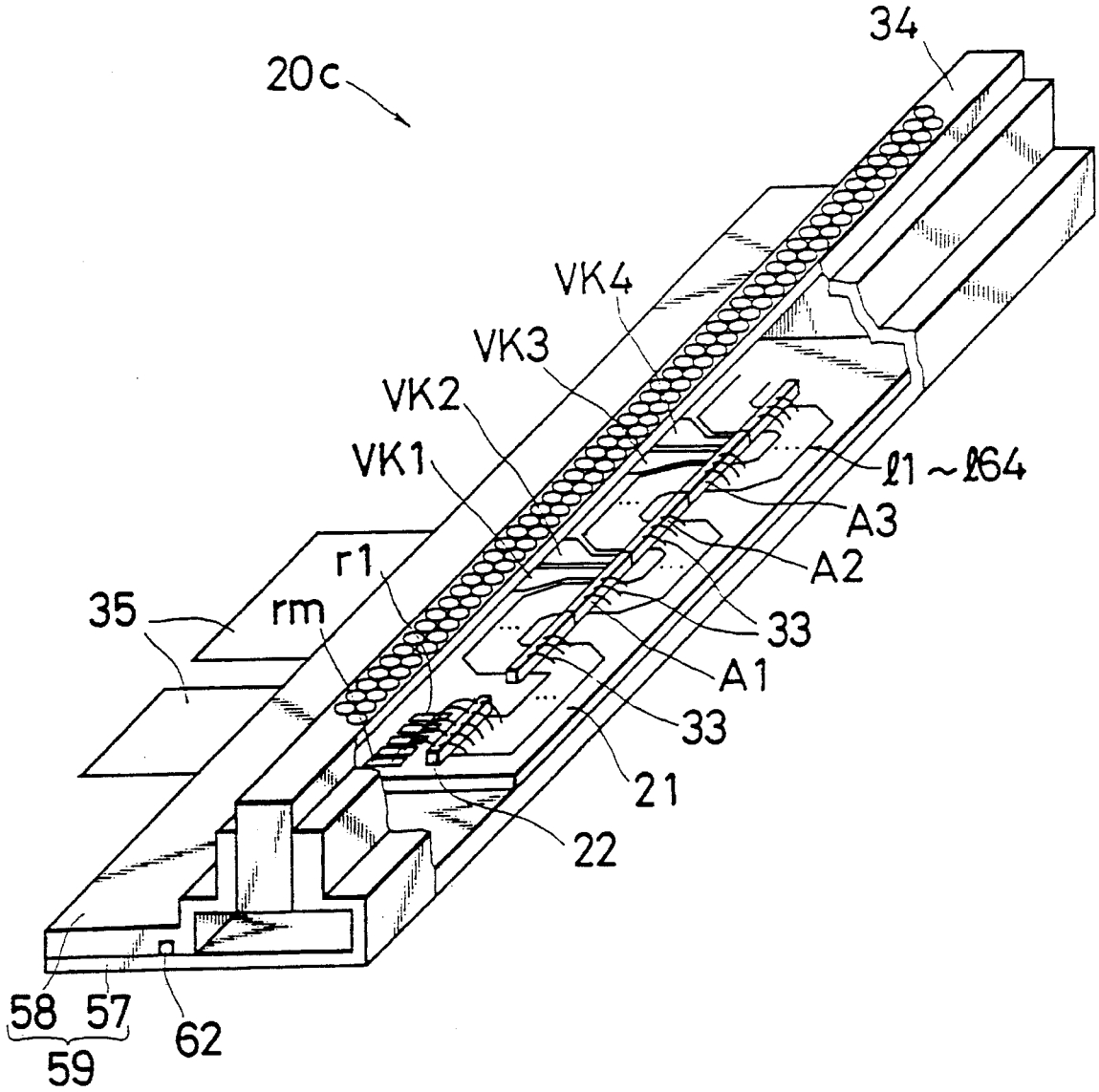
FIG. 31 is a perspective view of an optical printer head 20*c*.

FIG. 29 is an exploded perspective view of an optical printer head 20*c* in a fourth embodiment of the invention, FIG. 30 is a sectional view of the optical printer head 20*c*, and FIG. 31 is a perspective view showing the section of a part of the optical printer head 20*c*. The corresponding parts to those in the preceding embodiments are identified with the same reference numbers. The optical printer head 20*c* possesses a housing 50 composed of a housing main body 57 and a lid 58. At the bottom of the housing main body 57, a substrate 21 is placed, which is an electrical insulating wiring substrate made of electrically insulating material of a relatively high hardness, such as ceramics and glass. On the surface of the substrate 21, individual signal lines l1 to l64 in the shape as described below are formed.

Also on the substate 21, common signal electrodes VK1 to VK40 are formed in the manufacturing procedure and shape as stated below. On these individual signal lines l1 to l64 and common signal electrodes VK1 to VK40, an electrical insulating layer 28 made of an electrically insulating material such as polyimide resin is formed. On this electrical insulating layer 28, light-emitting diode (LED) arrays A1 to A40 composed as plural light-emitting elements individually joined with the common signal electrodes VK1 to VK40 and individual signal lines l1 to l64 are disposed.

The LED arrays A1 to A40 are connected and fixed to the common signal electrodes VK in the window area of the insulation layer 28 with the aid of argentum Ag or other conductive adhesive 61 by means of a cathode electrode layer 60. The common signal electrodes VK1 to VK40 function as one of the terminals for emitting light by passing an electric current to LEDs of the arrays A1 to A40, for example, LED 1P1, 1P2, . . . , 1P64; 2P1, . . . , 2P64; . . . , 40P1, 40P64.

The LEDs, 1P1 to 1P64 are arranged on a straight line on the array A1, and the arrays A2 to A40 having similar structures are also linearly arranged. As a result, a total of 2,560 LEDs 1P1 to 40P64 may be used for printing.

The LEDS 1P1 to 1P64 are individually provided with terminals 32. These terminals 32 are connected individually to the individual signal lines l1 to l64 through bonding wires 33. Such structure of connection is the same in the remaining arrays A2 to A40.

The individual signal lines l1 to l64 are individually connected to the output terminals of the driving circuit 22 disposed at the left side as shown in FIG. 31 at one side of the arrays A1 to A40 by means of bonding wires 33. This driving circuit 22 illuminates and drives the LEDs 1P1 to 40P64 selectively in response to the print data from the input terminals r1 to rm.

The common signal electrodes VK1 to VK40 are individually connected to flexible thin-film conductors 34 integrally formed with flexible films 31, and these flexible films 31 and conductors 34 compose a flexible wiring substrate 35. Such flexible wiring substrate 35 is located outside the housing 59, and the print data is supplied from an electronic device connected to the optical printer head 20*c*. The flexible wiring substrate 35 is pressed and fixed to the common signal electrodes VK1 to VK40 by a pressing member 62 which possesses an elasticity of, for example, a rubber bar, by fixing the lid 58 of the housing 59 containing the pressing member 62 extending over the entire length of the optical printer head 20*c* to the housing main body 57 by means of screw or the like. The housing 59 is equipped with a selfox lens array 63 for leading the light emitted from the LED 1P1 to 40P64 to the outside of the housing 59.

Figure 32:
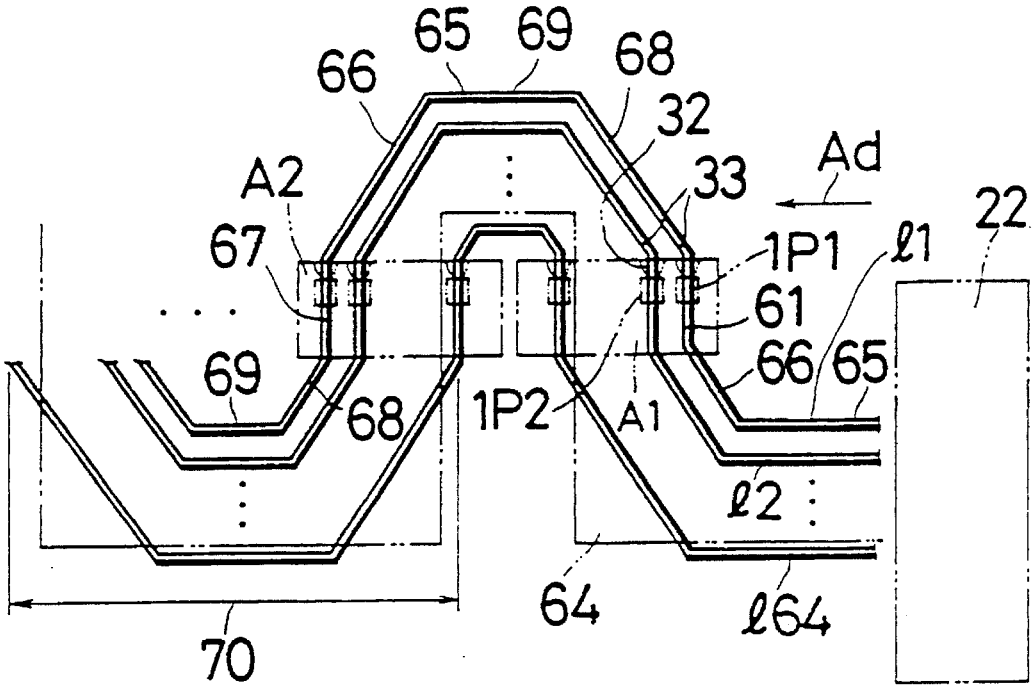
FIG. 32 and FIG. 33 are plan views for explaining the forming method of individual signal lines l1 to l64 and common signal electrodes VK1, VK2, . . . in the same embodiment, FIGS. 34(1)–34(3) are drawings for explaining the principle for determining the shape of the individual signal lines l1 to l64.
Figure 33:
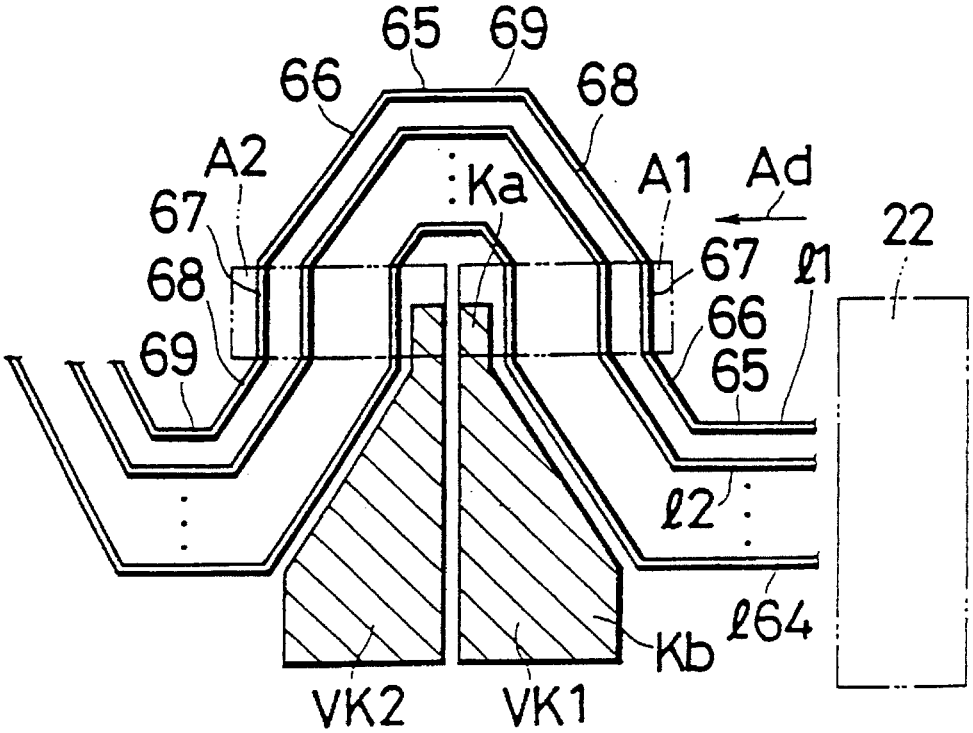

FIG. 32 and FIG. 33 are drawings for explaining the shape and forming procedure of the individual signal lines l1 to l64 and common signal electrodes VK1 to VK40. The shape of the individual signal lines l1 to l64 of the optical printer head 20 of the embodiment explained by reference to FIG. 12 in the description of the embodiment was shaped like a crank as indicated by virtual line 64 in FIG. 32, while in this embodiment, by contrast, the fillet parts of the individual signal lines l1 to l64 in crank shape are removed, and it is designed to be connected obliquely with respect to the direction of arrangement Ad of the LED arrays A1, A2, . . .

In other words, for example, the individual signal lines l1 contains, in every one of arrays A1, A2, . . . , a first parallel portion 65 parallel to the direction of arrangement Ad, a first oblique portion 66 oblique to the direction of arrangement Ad, a vertical portion 67 vertical to the direction of arrangement Ad, a second oblique portion 68 oblique to the same direction as the first oblique portion 66, and a second parallel portion 69 parallel to the direction of arrangement Ad, and as for the remaining arrays A2, . . . , the same composition is alternately repeated in a line symmetrical profile with respect to the arrays A1, A2, . . . It is the same for the other individual signal lines l2 to l64.

The second parallel portion 69, the first parallel portion 65, the second oblique portion 68, and the first oblique portion 66 of the mutually adjoining arrays Ai, Ai+1 (i=1, 2, 3, . . . ) are combined to compose a curved portion 70 of the individual signal lines l1 to l64. On the vertical portion 67, the LED arrays A1, A2, . . . are disposed, and the vertical portion 67 functions as the junction of the LED arrays A1, A2, . . .

Among such adjoining curved portions 70, common signal electrodes VK1, VK2 for feeding driving electric power to the corresponding arrays Ai, Ai+1 (i=1, 2, . . . ) are formed on a same plane. The common signal electrodes VK1, VK2, . . . in this embodiment are obtained by integrally forming the array connection parts Ka respectively connected to the arrays A1, A2, . . . , and the substrate connecting parts Kb for realizing the connection of the flexible wiring substrate 35 with the conductors 34.

FIG. 34 is a drawing for explaining the principle for determining the shape of the individual signal lines l1 to l64 in the shape mentioned above (hereinafter relating to the individual signal line l1). The individual signal line l1 is a band possessing a sectional area S with the width t and height b, and its length is l.

At this time, the electric resistance Rc is expressed as follows.

$$Rc = \rho \frac{l}{b \times t} = Rs \frac{l}{t} \tag{1}$$

where Rs=ρ/b.

Using the band BD in such shape as shown in FIG. 34 (1), after forming a crank-shaped signal line SL as shown in FIG. 34 (2), in the constitution of connecting the position at the distance of length E at one side from the corner and the position at the distance of length D at the other side by the oblique portion 66 composed of the band BD with width B and length C, the ratio of the electric resistance of the crank shape mentioned above to the case of the oblique portion 66 is calculated. Meanwhile, the angle formed by the oblique portion 66 and the portion of length D is supposed to be θ.

At this time, the electric resistance Rc of the oblique portion 66 is, by modification of equation (1), as follows.

$$Rc = Rs \cdot \frac{C}{B} \tag{2}$$

The lengths B, D, E are $$D+E=C\ (\cos\theta+\sin\theta) \tag{3}$$

$$B=A\cos\theta \tag{4}$$

and hence equation (2) may be rewritten as follows.

$$Rc = Rs \frac{C}{A\cos\theta} \tag{5}$$

Incidentally, the electric resistance $R_{D+E}$ of the portion of lengths D+E is $$R_{D+E} = Rs \frac{D}{A} + Rs \frac{E}{A} = Rs \frac{C(\cos\theta + \sin\theta)}{A} \tag{6}$$

Accordingly, the ratio of the electric resistances is $$\begin{aligned} \frac{R_{D+E}}{Rc} &= \frac{A\cos\theta}{RS \cdot C} \times \frac{Rs \cdot C(\cos\theta + \sin\theta)}{A} \\ &= \cos\theta(\cos\theta + \sin\theta) \end{aligned} \tag{7}$$

Therefore, the relation of the angle θ and the ratio of electric resistance may be summarized as shown in Table 1, and hence by properly selecting the value of θ, increase of wiring resistance may be prevented.

TABLE 1

| Angle θ | $R_{D+E}$/Rc |
|---|---|
| 0° < θ < 45° | Greater than 1 |
| θ = 45° | 1 |
| θ > 45° | Smaller than 1 |

The graph of equation (7) is shown in FIG. 34 (3). It is known from this graph that there is a peak at θ=22.5°. Therefore, the optimum value is θ=22.5°. Generally, it may be in a range of 0°<θ≦45°.

Thus, in this embodiment, when composing the individual signal lines l1 to l64 and common signal electrodes VK1 to VK40 on the substrate 21, it is designed so that they may be arranged on a same plane. As a result, the plural times of vapor deposition and etching processes of metal particles mentioned in relation to the prior art may be done by a single step, so that the manufacturing process and necessary materials may be significantly simplified. Moreover, when composing the common signal electrodes VK1 to VK40 as in the prior art, if the individual signal lines l1 to l64 have been already formed, the extremely high precision for matching positions may be eliminated. In this point, too, the manufacturing process may be simplified. Moreover, owing to these advantages, the material substrate may be increased in size, and a substrate 21 corresponding plural optical printer heads 20*c* may be also obtained, so that the manufacturing efficiency may be drastically improved.

Figure 35:
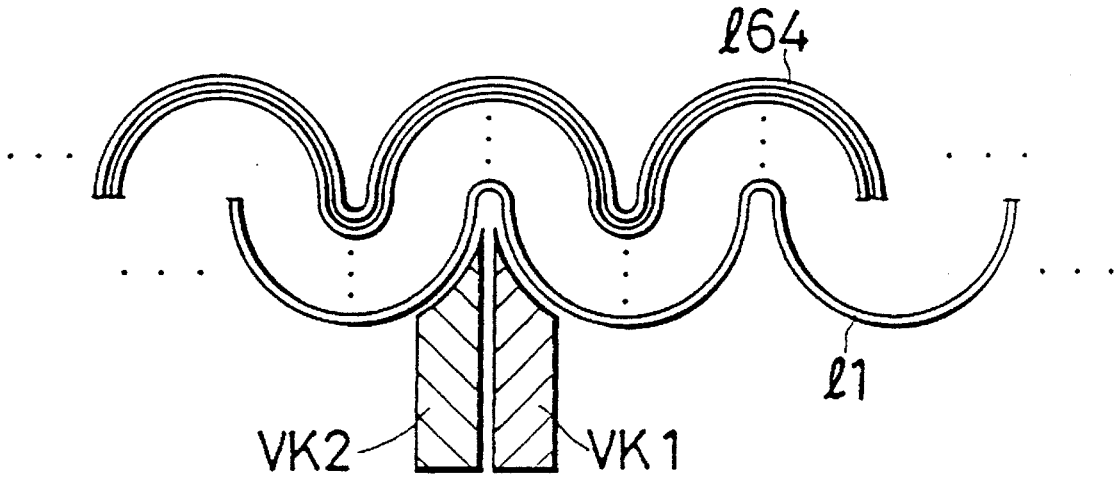
FIG. 35 is a block diagram for explaining an optical printer head in a different embodiment of the invention.

FIG. 35 is a plan view showing a structural example of a further different embodiment of the invention. This embodiment is similar to the foregoing embodiments, and corresponding parts are identified with the same reference numbers. What is of note in this embodiment is that the individual signal lines l1 to l64 are formed in polygonal shape composed of an arbitrary number of sides generally or in an arc shape as shown in FIG. 35, not limited to a polygonal shape composed of a relatively small number of sides as explained by reference to FIG. 32 and FIG. 33. In this case, the arc shape is meant to include all curves in a convex form such as ellipse and oval shape in the spirit of the invention.

Figure 36:
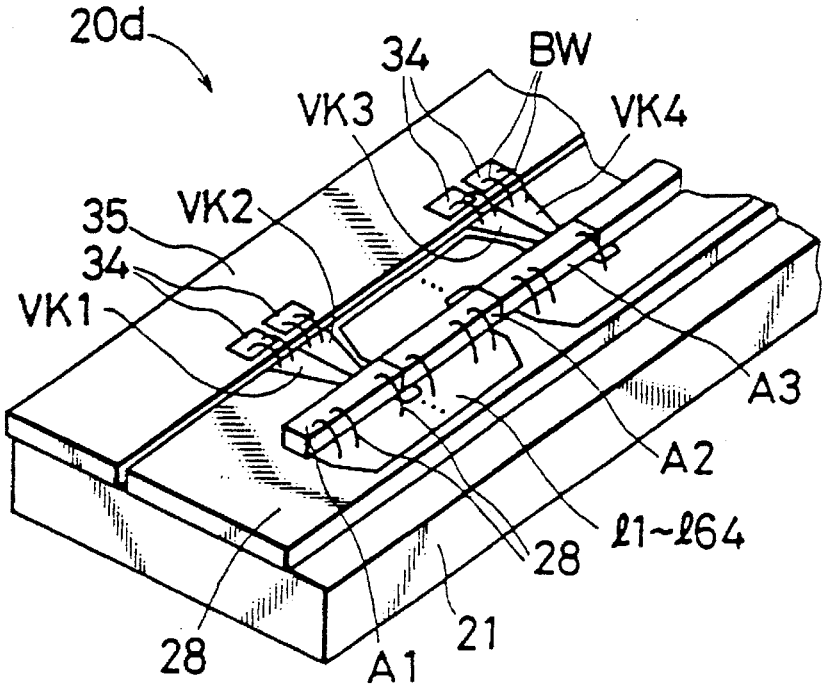
FIG. 36 is a perspective view of an optical printer head 20*d* in a further different embodiment of the invention.

FIG. 36 is a perspective view of an optical printer head 20*d* in a still another embodiment of the invention. This embodiment is similar to the foregoing embodiments, and corresponding parts are identified with the same reference numbers. By way of illustration, in the foregoing embodiments, in realizing the connection of the common signal electrodes VK1 to VK40 and the flexible wiring substrate 35, the mutual end portions were overlapped, and were pressed from above by the pressing member 62 to bond mutually by pressure, thereby achieving an electrical conduction.

In this embodiment, by contrast, the flexible wiring substrate 35 is adhered to the substrate 21, with the conductors 34 directed upward, by means of an adhesive or the like, and the conductors 34 and the common signal electrodes VK1 to VK40 are connected with bonding wires BW. The other structure of the invention is same as in the foregoing embodiments. That is, the common signal electrodes VK1 to VK40 conforming to the foregoing embodiments are connected with the conductors 34 by individual bonding wires BW. Since the common signal electrodes VK1 to VK40 of the embodiment are directly formed on the substrate 21 having a relatively high hardness, the trouble experienced in the prior art of failure of wire bonding due to concave bending of the common signal electrodes VK1 to VK40 by the jig for bonding may be avoided.

In such constitution, the overlapping allowances W1, W2 of the common signal electrodes VK1 to VK40 and the flexible wiring substrate 35 are not needed, and the structure of the optical printer head may be further reduced in size.

Thus, according to the invention, the individual signal lines and the common signal electrodes are formed on a same plane on the electrically insulating substrate. Accordingly, when forming such individual signal lines and common signal electrodes, plural times of vapor deposition and etching of metal particles may be curtailed to a single step, and the manufacturing process may be radically simplified. In addition, when electrically connecting the power feeding wiring substrate and common signal electrodes, since the common signal electrodes are directly formed on the electrically insulating substrate, it can be done by the wire bonding technology, and the structure of the image forming apparatus including the printed wiring substrate may be drastically reduced in size.

Figure 37:
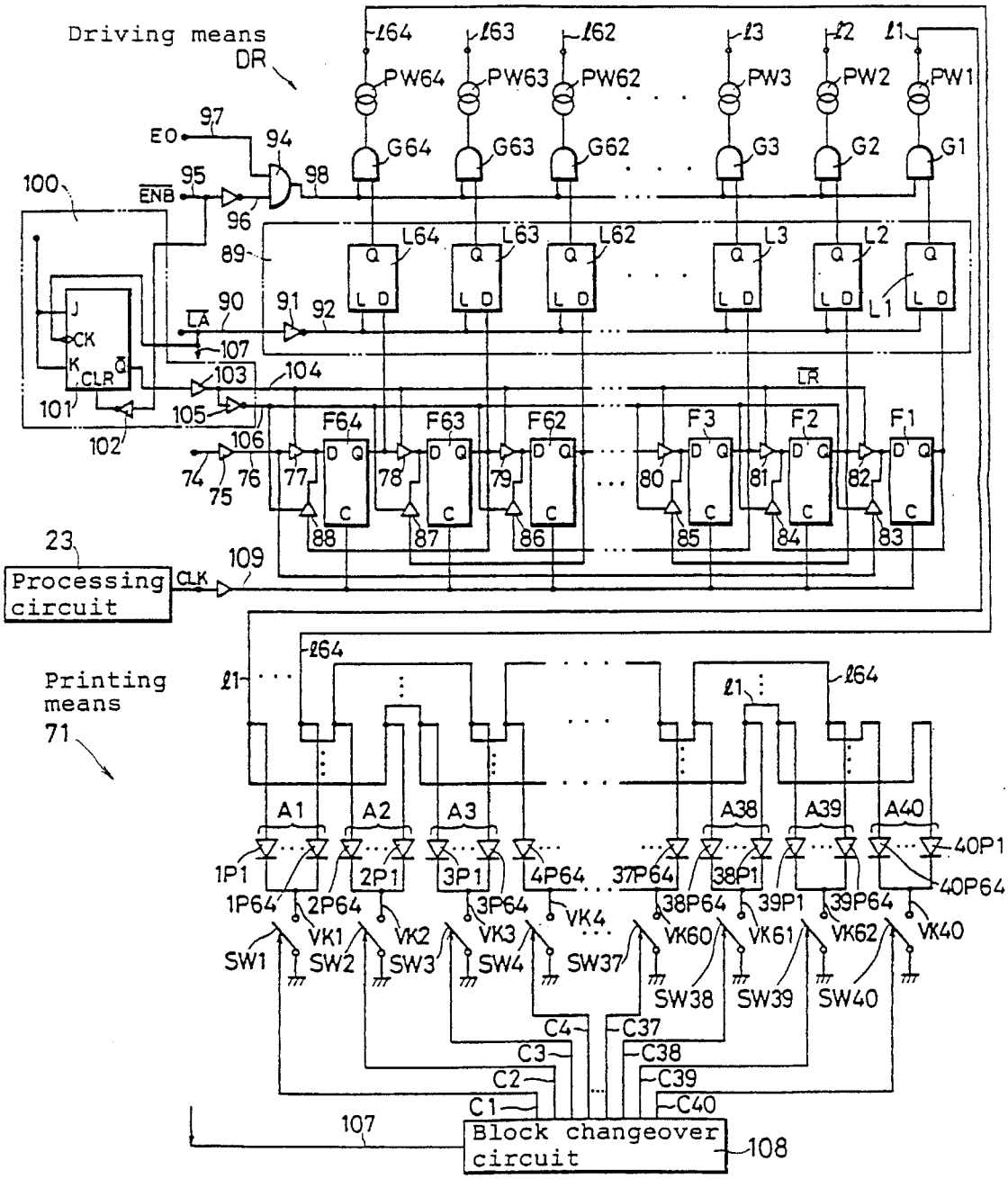
FIG. 37 is a block diagram of an embodiment of the invention, FIGS. 38(1)–38(8) are waveform diagrams for explaining the operation.

FIG. 37 is an entire block diagram of another electrical structural example of the optical printer head 20. This optical printer head 20 dynamically drives the LEDs 1p1 to 1p64, . . . , 40p1 to 40p64 contained in the printing means 71 sequentially in each block from left to right of FIG. 37 in the order of arrangement, and exposes the photoreceptor conveyed in the direction (vertical in FIG. 37) orthogonally crossing with the direction of arrangement of the LEDs (lateral in FIG. 37), thereby forming an image. The LEDs 1p1 to 1p64, . . . , 40p1 to 40p64 compose one block in every 64 LEDs, and these blocks are indicated by the reference numbers A1 to A40.

The LEDs 1p1 to 40p64 are driven in every block, and one block is used as one array in the foregoing embodiments as well as this embodiment of the invention. The case of one block composed of plural arrays is explained later. The individual signal lines l1 to l64 are connected with one of the terminals of the LEDs at symmetrical positions, such as 1p1 and 2p64, in FIG. 12, with respect to adjacent blocks, for example, symmetrical surfaces Sy (see FIG. 12) of A1 and A2, and the other terminals of LEDs 1p2, 2p63 at other symmetrical positions.

Referring again to FIG. 37, the driving means DR for driving the printing means 71 is the driving circuit 22 in the foregoing embodiments, and it is disposed on the substrate 21, and this driving means DR sequentially drives the LEDS 1P1 to 1P64, . . . , 40P1 to 40P64 of the printing means 71, according to the sequential print data delivered from the processing circuit 23, in each block from left to right of FIG. 37 in the direction of their arrangement.

The driving means DR is equipped with D-type flip-flops F1 to F64 which are memory elements individually corresponding to LEDs in each one of blocks A1 to A40. The print data $\overline{DA}$ coming from the processing circuit 23 through line 74 is given to the input terminal of the first flip-flop F64 from a first switching element 77 by way of line 76 from a buffer 75. The output Q of the flip-flop F64 is further given to the input terminal of the next flip-flop F63 through a first switching element 78. Thereafter, similarly, first switching elements 79 to 82 are provided.

The print data through the line 76 is given to the input terminal of the final flip-flop F1 through a second switching element 83, and the output Q of this final flip-flop F1 is given to the input of a memory element F2 of one stage before through a second switching element 84. Thereafter, similarly, second switching elements 85 to 88 are provided.

The outputs of the flip-flops F1 to F64 are given to the inputs of D-type flip-flops L1 to L64 installed in a latch circuit 89. These flip-flops L1 to L64 act to latch when a latch signal $\overline{LA}$ given from the processing circuit 23 to a line 90 is given from an inverting circuit 91 by way of a line 92. The outputs of the flip-flops L1 to L64 of the latch circuit 89 are given to one of the inputs of each of AND gates G1 to G64, and the outputs of these AND gates G1 to G64 are given to current sources PW1 to PW64. The current sources PW1 to PW64 supply currents, taking the individual signal lines l1 to l64 as one of the potentials, and thus the driving electric power of the LEDs is supplied.

At the AND gate 94, a strobe signal $\overline{ENB}$ is given from the processing circuit 23 through the line 95 and inverting circuit 96, and the signal E0 becoming high level after turning on the power is also given to this AND gate 94 from the processing circuit 23 through the line 97. The output of the AND gate 94 is given to the other input of the AND gates G1 to G64 from the line A changeover signal generation source 100 possesses a JK flip-flop 101, and its truth value table is as shown in Table 2.

TABLE 2

| CLR | CK | J | K | $\bar{Q}$ |
|---|---|---|---|---|
| L | X | x | x | H |
| H | ⌐ | H | H | Toggle |

Here, the input terminals J, K of the flip-flop 101 are connected to the power supply, and are always at high level. A strobe signal $\overline{ENB}$ is given to the clear input terminal CLR from the line 95 through an inverting circuit 102. A latch signal $\overline{LA}$ is fed to the clock input terminal CK. The output from the output terminal $\overline{Q}$ is given to the first switching elements 77 to 82 through line 104 as changeover signal from a buffer 103, and these first switching elements 77 to 82 are made to conduct when provided with high level signals from the line 104, and are cut off when low level signals are supplied. The changeover signal from the buffer 103 is changed over by an inverting circuit 105, and is given to the second switching elements 83 to 88 as another inverted changeover signal from a line 106, and when this inverted changeover signal from the line 106 is at high level, these second switching elements 83 to 88 are made to conduct, and they at low level, they are cut off.

The LEDs in each one of blocks A1 to A40 are respectively connected to the switches SW1 to SW40 through the common signal lines VK1 to VK40, and these switches SW1 to SW40 are connected to the grounding potential. The latch signal $\overline{LA}$ is given to a block changeover circuit 108 through a line 107. This block changeover circuit 108 responds to the latch signal $\overline{LA}$, and gives the block changeover signal to the switches SW1 to SW40 from the lines C1 to C40, thereby sequentially conducting the switches SW1 to SW40 of the blocks A1 to A40 one by one.

Figure 38:
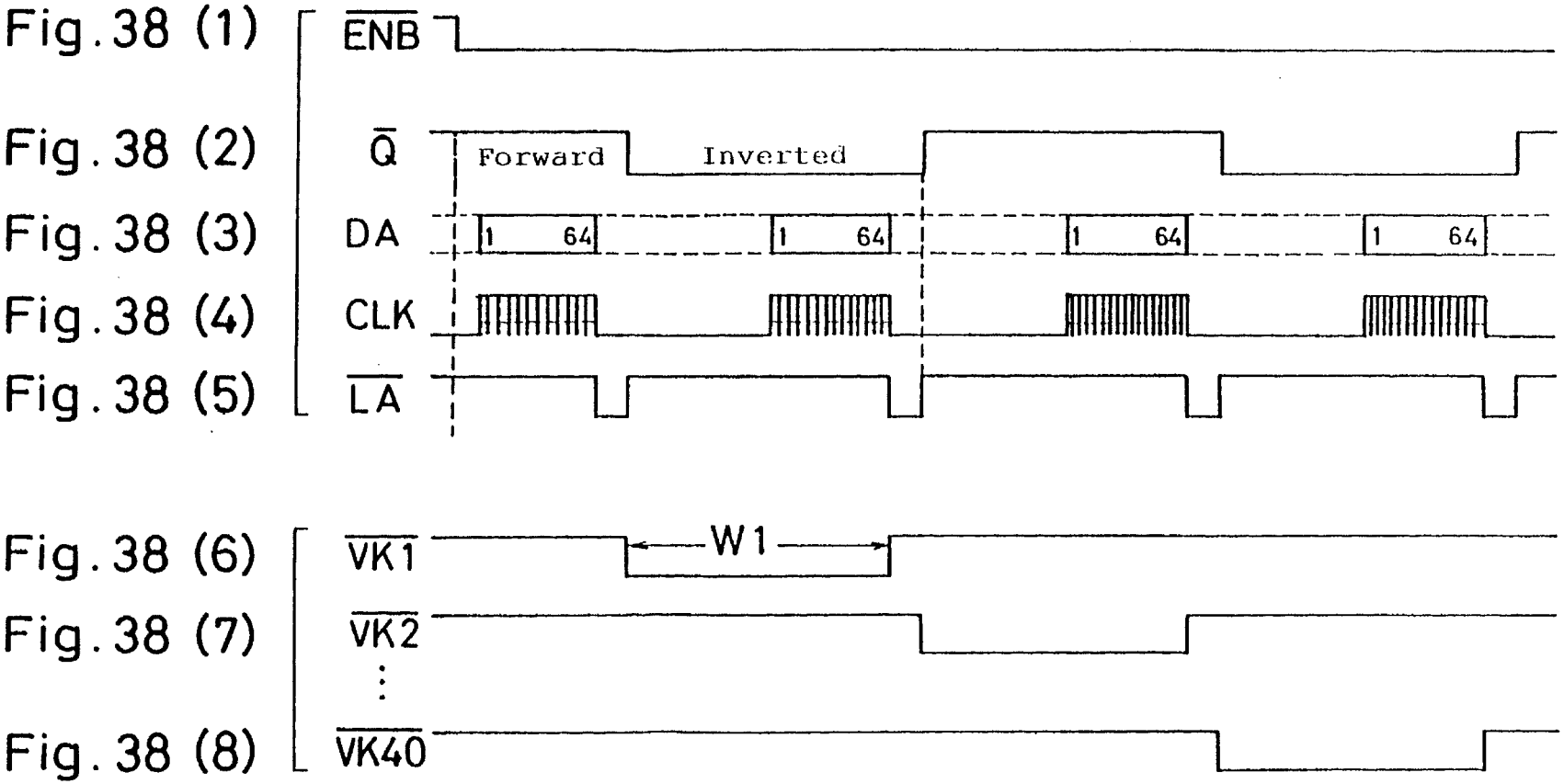

Referring now to FIG. 38, the operation of the printing means 71 and driving means DR is explained below. To start image formation, a high level signal E0 is given to the line 97 by the processing circuit 23, and the strobe signal $\overline{ENB}$ is converted from high level to low level as shown in FIG. 38 (1), and hence the signal led out from the AND gate 94 to the line 98 is high level, so that it is ready to start image formation. At the same time, the flip-flop 101 of the changeover signal generation source 100 becomes low level and is cleared because the strobe signal $\overline{ENB}$ passes through the inverting circuit 102 when it is at high level, and hence its output $\overline{Q}$ is maintained at high level. When the strobe signal $\overline{ENB}$ becomes low level, it is inverted in the inverting circuit 102, and its output $\overline{Q}$ is set to toggle state by the clock. In this state, the flip-flop 101 is ready to accept the latch signal $\overline{LA}$ at the clock input terminal CK. The waveform of the output $\overline{Q}$ of the flip-flop 101, that is, the waveform of the line 104 is shown in FIG. 38 (2), and while its output $\overline{Q}$ is at high level, the first switching elements 77 to 82 remain in conductive state.

In consequence, the 64-bit print data $\overline{DA}$ from the processing circuit 23 is sequentially led out in series bits into the line 74 as shown in FIG. 38 (3) to be in transferrable state, and in the flip-flops F1 to F64 operating in synchronism with the clock signal CLK shown in FIG. 38 (4) being led out from the processing circuit 23 through the line 109, the data of the LEDs are stored as being transferred from the flip-flop F64 to the flip-flop F1, from left to right in FIG. 38, for the portion of one block, in a total of 64 dots. Thus, after transfer of the print data for one block, as shown in FIG. 38 (5), the latch signal $\overline{LA}$ is given from the processing circuit 23, and therefore the print data of the flip-flops P1 to F64 are transferred parallel and latched in the flip-flops L1 to L64 of the latch circuit 89.

This latch signal $\overline{LA}$ is given to the clock input terminal CK of the flip-flop 101 of the changeover signal generation source 100, and the output $\overline{Q}$ is changed from high level to low level by the trailing edge of the latch signal $\overline{LA}$. As a result, the first switching elements 77 to 82 are cut off, and the second switching elements 83 to 88 are made to conduct, and the state is changed over so as to be ready to feed from right to left in FIG. 38 into the flip-flops F1 to F64. Accordingly, the block changeover circuit 108 responds to the latch signal $\overline{LA}$, and gives the block changeover signal VK1 shown in FIG. 38 (6) to the switch through the line C1, so that the switch SW1 is conducting during low level period W1 of the line C1.

In this way, the LEDs 1P1 to 1P64 contained in the first block A1 are electrically energized by the current from the current sources PW1 to PW64 and are illuminated, thereby printing the image. In this conducting period W1 of the switch SW1, the print data $\overline{DA}$ for the second block A2 is led out from the processing circuit 23 into the line 74, and is stored in the flip-flops F1 to F64 in this order through the second switching elements 83 to 88. The print data of the LED 2P1 of the second block A2 is stored in the flip-flop F1, and the print data of the LED 2P64 is stored in the flip-flop F64.

Consequently, when the latch signal $\overline{LA}$ is generated, the block changeover circuit 108 leads out a low level signal VK2 shown in FIG. 38 (7) in the line C2 to conduct the switch SW2, and the LEDs 2P1 to 2P64 of the second block A2 are electrically energized according to the output of the latch circuit 89. In this way, while the LEDS 1P1 to 1P64 of the first block A1 are being electrically energized, the print data of the LEDs 2P1 to 2P64 of the second block A2 are stored in the flip-flops F1 to F64, and such operation is repeated, and the LEDs of all blocks A1 to A40 are sequentially driven. FIG. 38 (8) shows a signal VK40 for conducting the switch SW3 as being applied from the line C3 to the switch SW3 for the block A3.

The invention may be executed not only in relation to the image forming apparatus using light-emitting diodes, but also in relation to an image forming apparatus having a thermal head using heating resistance elements, instead of light-emitting diodes, and the invention may be realized also by using printing elements having different structures.

Thus, according to the invention, the structure is simplified, and it is realized at low coat, while the printing speed may be enhanced.

Figure 11:
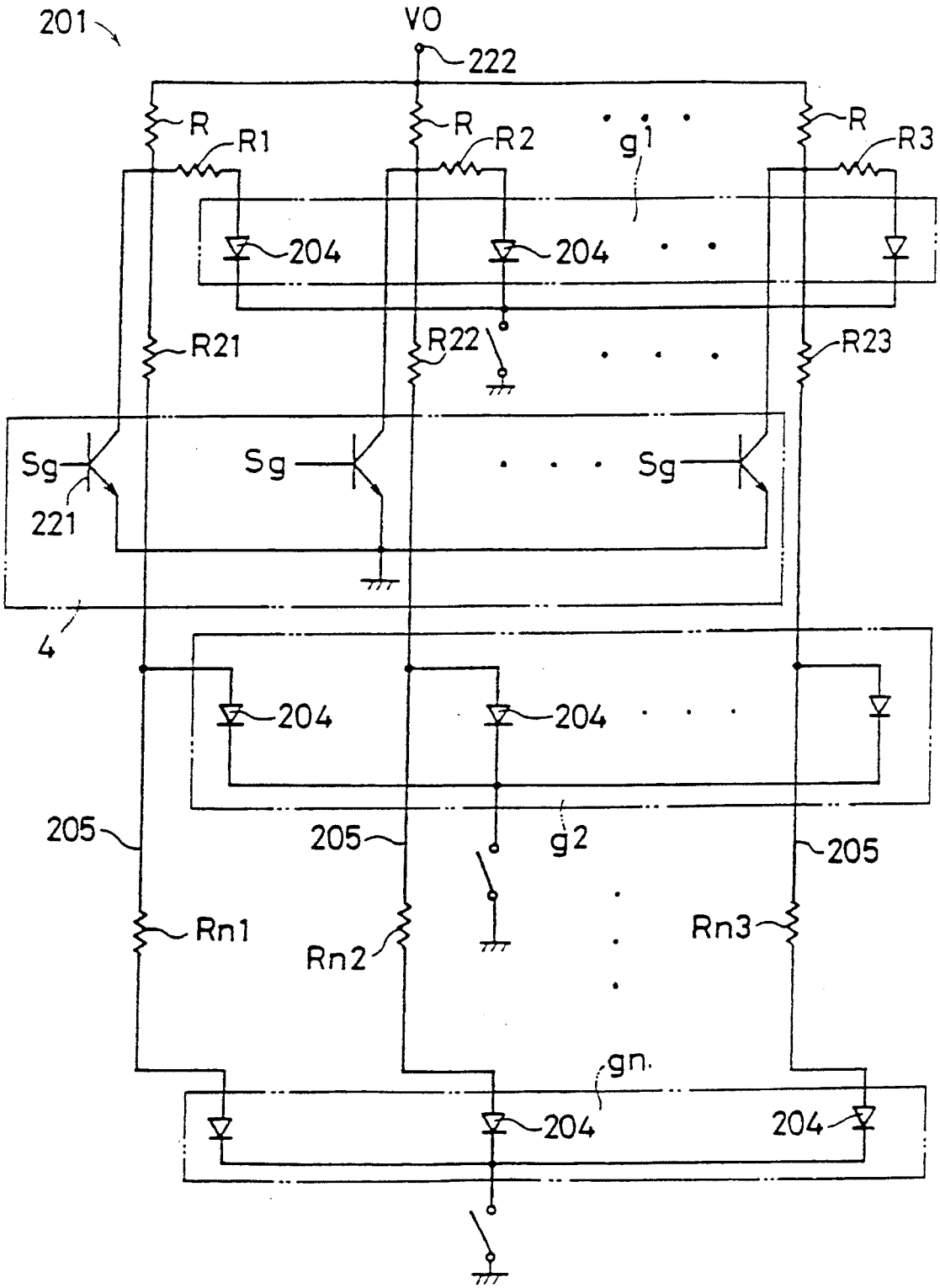
FIG. 11 PRIOR ART
FIG. 11 is a block diagram showing a composition of an optical printer 201 in a typical prior art.

Incidentally, in the individual signal lines l1 to l64 in FIG. 37, the wiring resistance as explained in reference to FIG. 11 is always contained in every group Ai (i=1 to 40), and this resistance becomes higher as going away from the power supply 222, and the maximum value may reach as high as 200 ohms.

Figure 39:
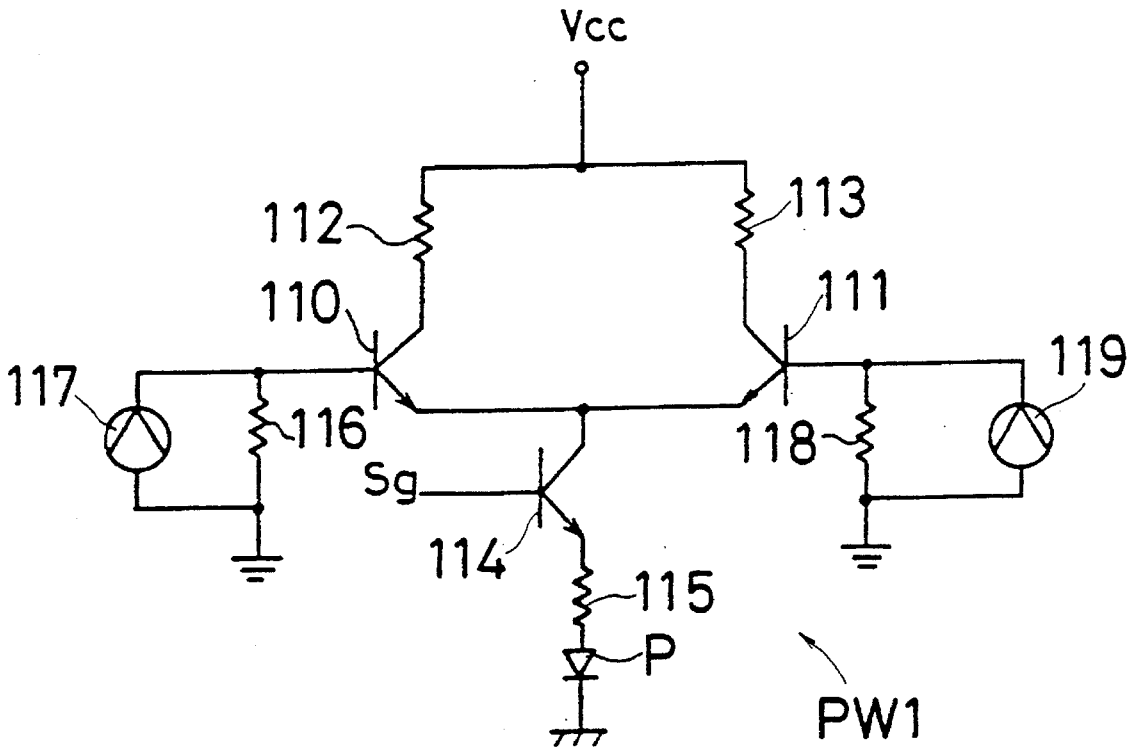
FIG. 39 is an electric circuit diagram showing a structural example of a constant current circuit PW1.

FIG. 39 is an electrical circuit diagram showing a structural example of the current source PW1, and the other current sources PW2 to PW64 are similarly structured. The current source PW1 contains a pair of transistors 110, 111 for composing a current mirror circuit, and their collectors are connected to a supply voltage Vcc through resistances 112, 113. The emitters of the transistors 110, 111 are commonly connected to the collector of a transistor 114 which is second switching means, and the emitter of the transistor 114 is connected to the line l1 through a resistance 115.

At the bases of the transistors 110, 111, a parallel circuit composed of resistance 116 and current source 117, and a parallel circuit composed of resistance 118 and current source 119 are respectively formed.

Figure 40:
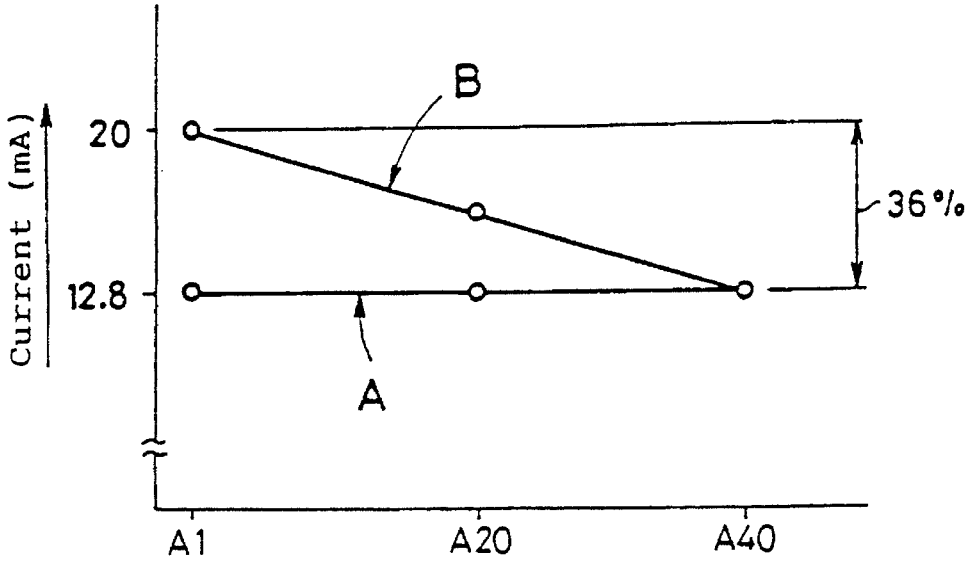
FIG. 40 is a graph showing the relation between connecting position of LED array Ai and the driving current value.

FIG. 40 is a graph showing the location of the group Ai, that is, the relation between the distance from the current source PW1 to PW64 and the magnitude of the driving current. Here are compared the structure of the prior art and the structure of the invention, in the optical printer head possessing, for example, 40 LED arrays g1 to g40. In this embodiment, meanwhile, an example of one group=one array is shown. That is, as shown in FIG. 11, when the current changeover type driving circuit 4 is disposed in the branch line of one side, the magnitude of the driving current flowing in each LED array gi in the optical printer head 201 is expressed by line B, while the magnitude of the driving current by the invention is represented by line A.

In the current changeover type in FIG. 11, supposing the resistance to be R=340 ohms and the wiring resistance to be (R1+R21+ . . . +Rn1)=140 ohms, when driven at the voltage of Vo=12 volts, if desired to pass 12.8 mA to the n-th LED array gn connected at the remotest position from the power supply 222, a current of 20 mA flows into the closest LED array g1. Therefore, as compared with the current flowing in the closest LED array, the magnitude of the driving current flowing in the remotest LED array g40 is about 36% smaller.

On the other hand, according to the invention, driving currents of almost uniform magnitude are obtained over the entire length of the individual signal lines l1 to l64. That is, along the overall length in the direction of arrangement of groups Ai, the magnitude of the driving currents flowing in the LEDs P is almost uniform, and the quantity of emission of light is also nearly constant. Therefore, by using such optical printer head 20, the quality of the obtained image may be dramatically improved.

Meanwhile, the current sources PW1 to PW64 for feeding electric power to the individual signal lines l1 to l64 may be installed not only at one end of the individual signal lines l1 to l64 as shown in FIG. 37, but also at both ends or at intermediate positions as mentioned later.

In this embodiment, the operation for feeding or cutting off the driving current into the LEDs P is effected by feeding or stopping the driving current from the current sources PW1 to PW64 installed at the positive pole side of the LEDs P. This, hence, eliminates the necessity of using the resistance R in the prior art explained in reference to FIG. 11, and the structure may be reduced in size, while the power consumption may be significantly saved.

It is also possible to prevent accidents such as unexpected lighting of the LED 204 due to drop of the ON voltage $V_{CE}$ between the collector and emitter of the transistor 221 explained in FIG. 11. Moreover, since the grounding potential to which the cathode side of the LED P is connected to the supply voltage Vcc by way of current source PW and LED P, shorting of the supply voltage Vcc at the grounding potential experienced in the prior art may be prevented.

Figure 41:
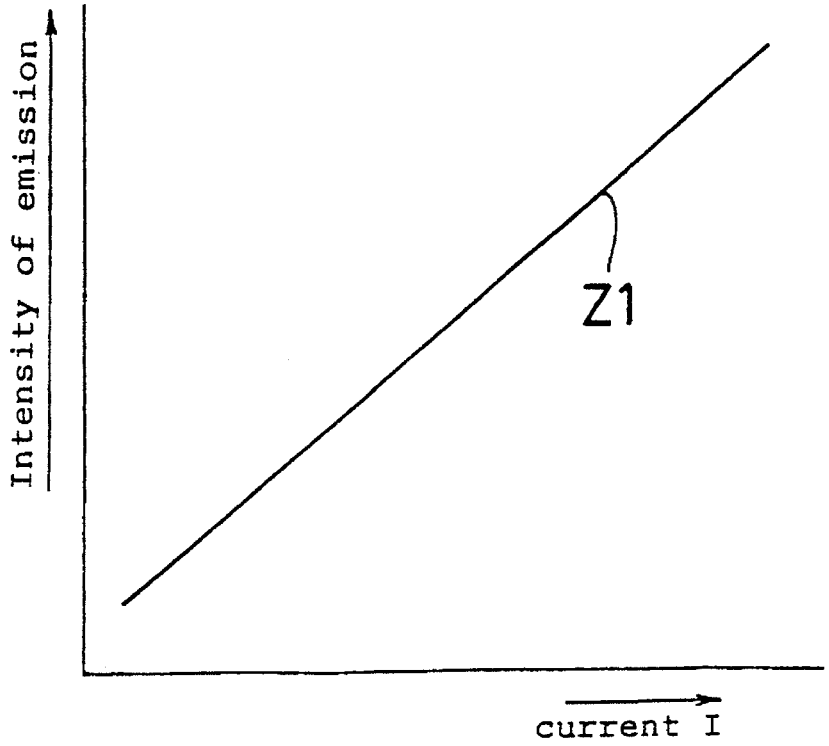
FIG. 41 is a graph showing the characteristics of LED.
Figure 42:
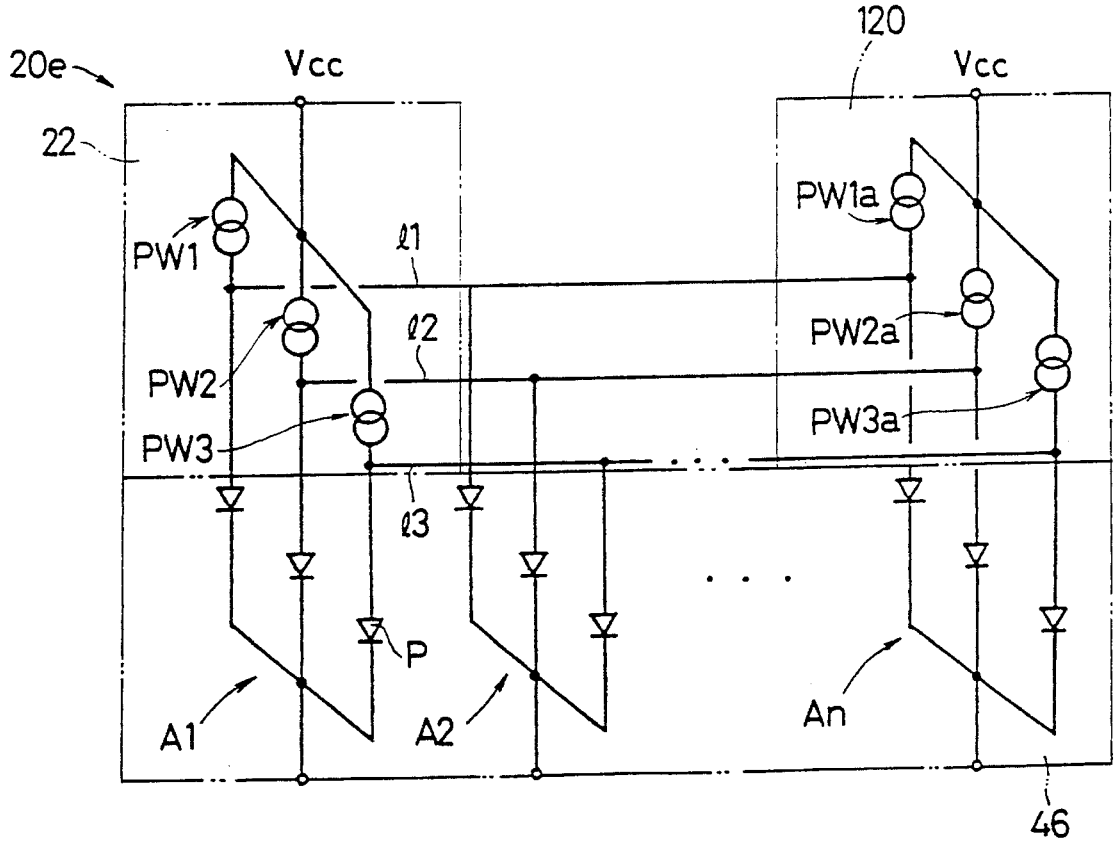
FIG. 42 is a block diagram showing a structure of other embodiment of the invention.

The intensity of emission of the LED P is known to have a positive correlation with the supplied current value, as indicated by line Z1 in FIG. 41. By making use of this principle, as another example of the invention, it may be designed to have a structure as shown in FIG. 42. In this embodiment, for the sake of simplicity of description, it is supposed that each group Ai is composed of three LEDs P. This embodiment, in addition to the driving circuit 22 connected to the light-emitting block 46 composed of group Ai, comprises a driving circuit 120 containing current sources PW1*a* to PW3*a* in a same structure as the set of the current sources PW1 to PW3 shown in FIG. 37, at the opposite side in the direction of arrangement of the LEDs P in the light-emitting block 46. By setting up in this way, the current to be supplied into each LED P increases, and when the quantity of light emission by each LED P is increased. As the quantity of light emission by the LEDs P increases, the exposure time in the photosensitive drum may be shortened, when applied in the optical printer as stated above, so that the entire operating speed may be increased.

Figure 43:
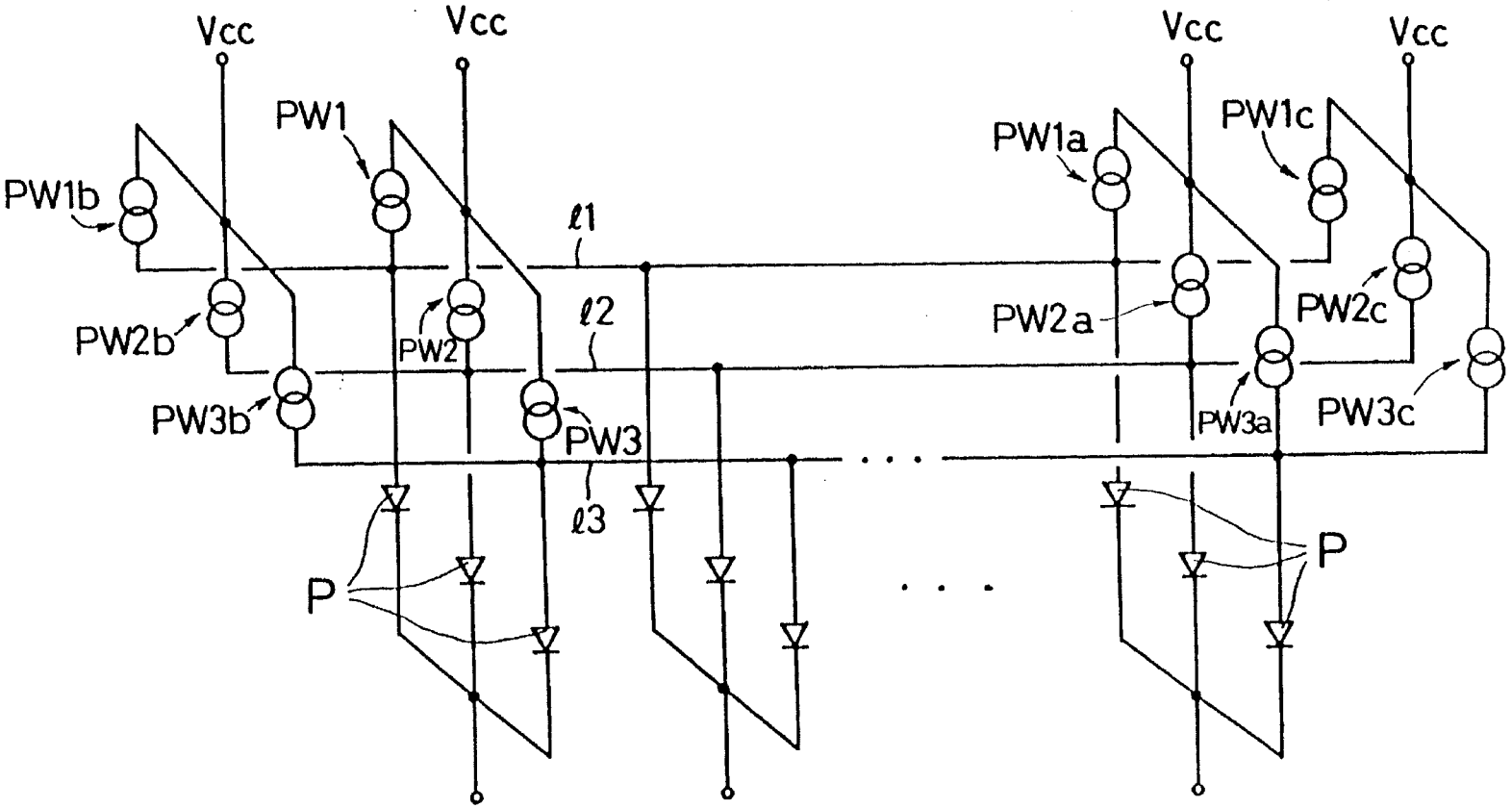
FIG. 43 is a block diagram showing a structure of a different embodiment of the invention.

FIG. 43 is a block diagram showing a structure of a further different embodiment of the invention. This embodiment is similar to the foregoing embodiments, and the corresponding parts are identified with the same reference numbers. What is particularly of note in this embodiment is that, for example, four sets of current sources PW1 to PW3, PA1*a* to PW3*a*, PW1*b* to PW3*b*, PW1*c* to PW3*c* are disposed on the individual signal lines l1 to l3. In such constitution, the operating speed of the optical printer head 20 may be further enhanced.

Thus, according to the invention, the driving current flowing in the selected light-emitting element is not decreased due to the wiring resistance of the common line to which the group of light-emitting elements is connected, and the fluctuations of the intensity of light emitting in the light-emitting elements of all groups may be eliminated. Therefore, it is possible to prevent deterioration of the image quality obtained by such optical printer head.

Also by the invention, since the current sources containing the second switching means for feeding and cutting off the driving currents to the light-emitting elements are disposed at the positive pole side of each light-emitting element, it is no longer necessary to use the electric resistance elements disposed at the positive pole side of the light-emitting elements as required in the prior art. As a result, the structure may be reduced in size. Moreover, since these electric resistance elements are not needed, the power consumption may be greatly decreased.

Furthermore, according to the invention, there is a plurality of a set of plural current sources disposed as many as the light-emitting elements in each group. Therefore, the level of the current supplied to each light-emitting element is increased, and the quantity of light emission is larger, and hence the operation speed may be enhanced.

Figure 44:
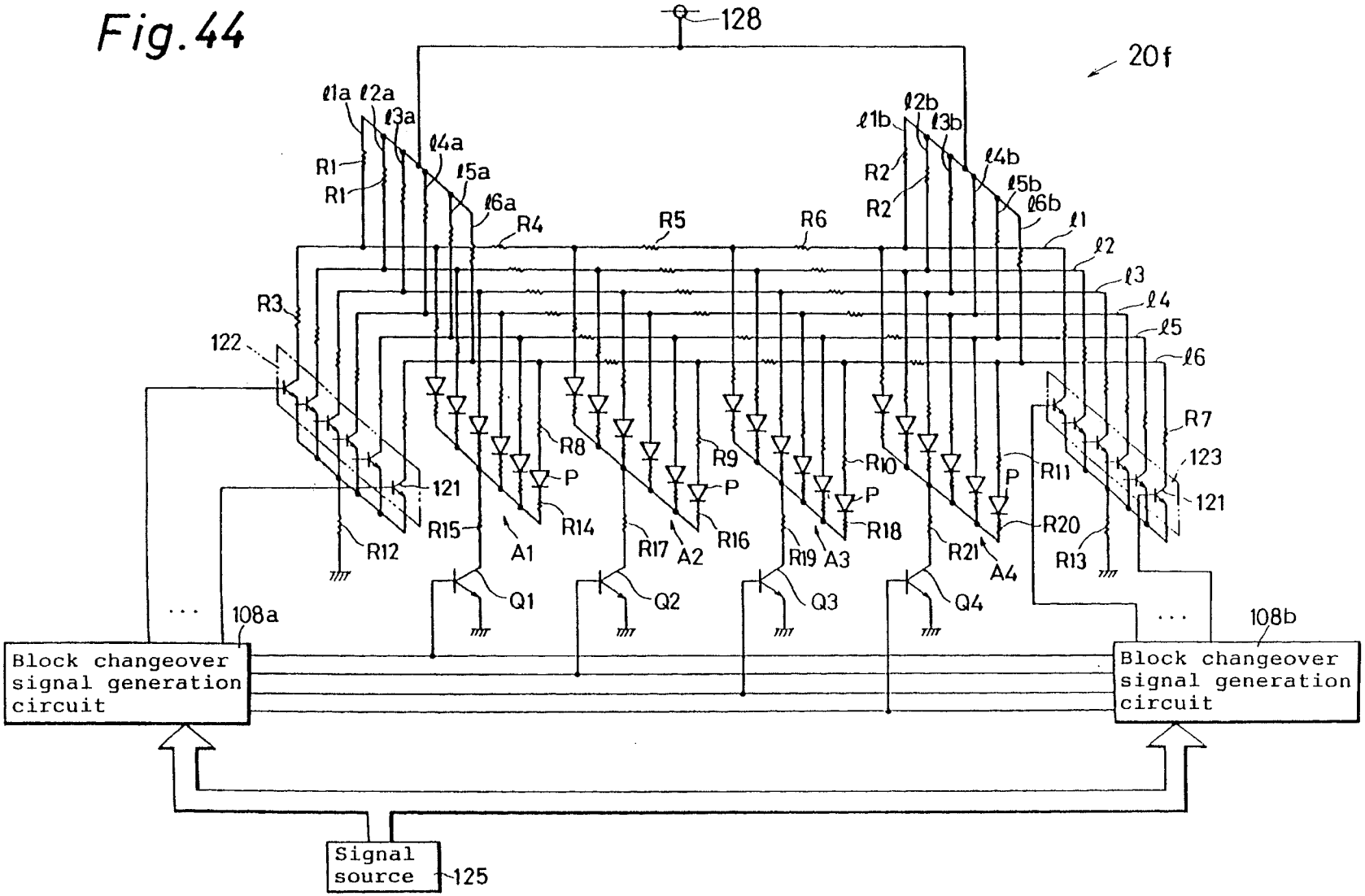
FIG. 44 is an electrical circuit diagram of an optical printer head 20*f* in an embodiment of the invention.

FIG. 44 is a diagram showing an electrical structure of an optical printer head 20*f* in a different embodiment of the invention, and FIG. 45 is a plan view of the same printer head 20*f*. The optical printer head 20*f* is composed by a linear arrangement of plural groups (four groups, for example, in this embodiment) A1 to A4 composed of plural LEDs (six, in this embodiment) P on a substrate 21 made of an electrically insulating material.

The LEDs P corresponding to each one of groups A1 to A4 are respectively connected to the individual signal lines l1 to l6. At both ends of the individual signal lines l1 to l6, first transistor array 122 and second transistor array 123 respectively composed of plural NPN transistors 121 are disposed.

A DC power supply 128 for driving this optical printer head 20*f* is connected to the first transistor array 122 side of the individual signal lines l1 to l6 through first branch lines l1*a* to l6*a*, and is also connected to the second transistor array 123 side of the individual signal lines l1 to l6 through second branch lines l1*b* to l6*b*. The first branch lines l1*a* to l6*a* and the second branch lines l1*b* to l6*b* are respectively provided with plural pull-up resistances R1, R2.

The emitters of the transistors 121 for composing the first transistor array 122 and the transistors 121 for composing the second transistor array 123 are respectively grounded through resistances R12, R13. The anode side of the LEDs P for composing groups A1 to A4 are commonly connected to the individual signal lines l1 to l6 by way of resistances R8 to R11. The LEDs P are connected with collectors of the NPN transistors Q1 to Q4 for group changeover in each one of groups A1 to A4, through resistances R14 to R21. The emitters of the transistors Q1 to Q4 for group changeover are individually grounded.

This optical printer head 20*f* is driven by a signal from a signal source 125. That is, the signal from this signal source 125 is commonly applied to two block changeover signal generation circuits 108*a*, 108*b*, and from the block changeover signal generation circuits 108*a*, 108*b*, block changeover signals are given to the base of the transistors 121 for composing the first transistor array 122 and second transistor array 123, while strobe signals are commonly applied to the transistors Q1 to Q4 for block changeover. Incidentally, the contents of the block changeover signals given from the block changeover signal generation circuit 108*a* to the first transistor array 122 and those from the block changeover signal generation circuit 108*b* to the second transistor array 123 are identical.

In FIG. 44, on the individual signal lines l1 to l6, line resistances R3 to R7 are equivalently shown. Meanwhile, the pull-up resistance R1 disposed in the first branch lines l1*a* to l6*a*, and the pull-up resistance R2 disposed in the second branch lines l1*b* to l6*b* are both selected at 750 ohms. The magnitude of the resistance of each line of the individual signal lines l is (as indicated by the sum of line resistances R4, R5, R6 in FIG. 47) selected at, for example, 140 ohms.

FIG. 46 is a timing chart for explaining the operation. In FIG. 46 (1) to (4), strobe signals given to the transistors Q1 to Q4 are shown, and in (5) to (10), the block changeover signals given to the transistors 121 for composing the first and second transistor arrays 122, 123 are given.

Figure 3:
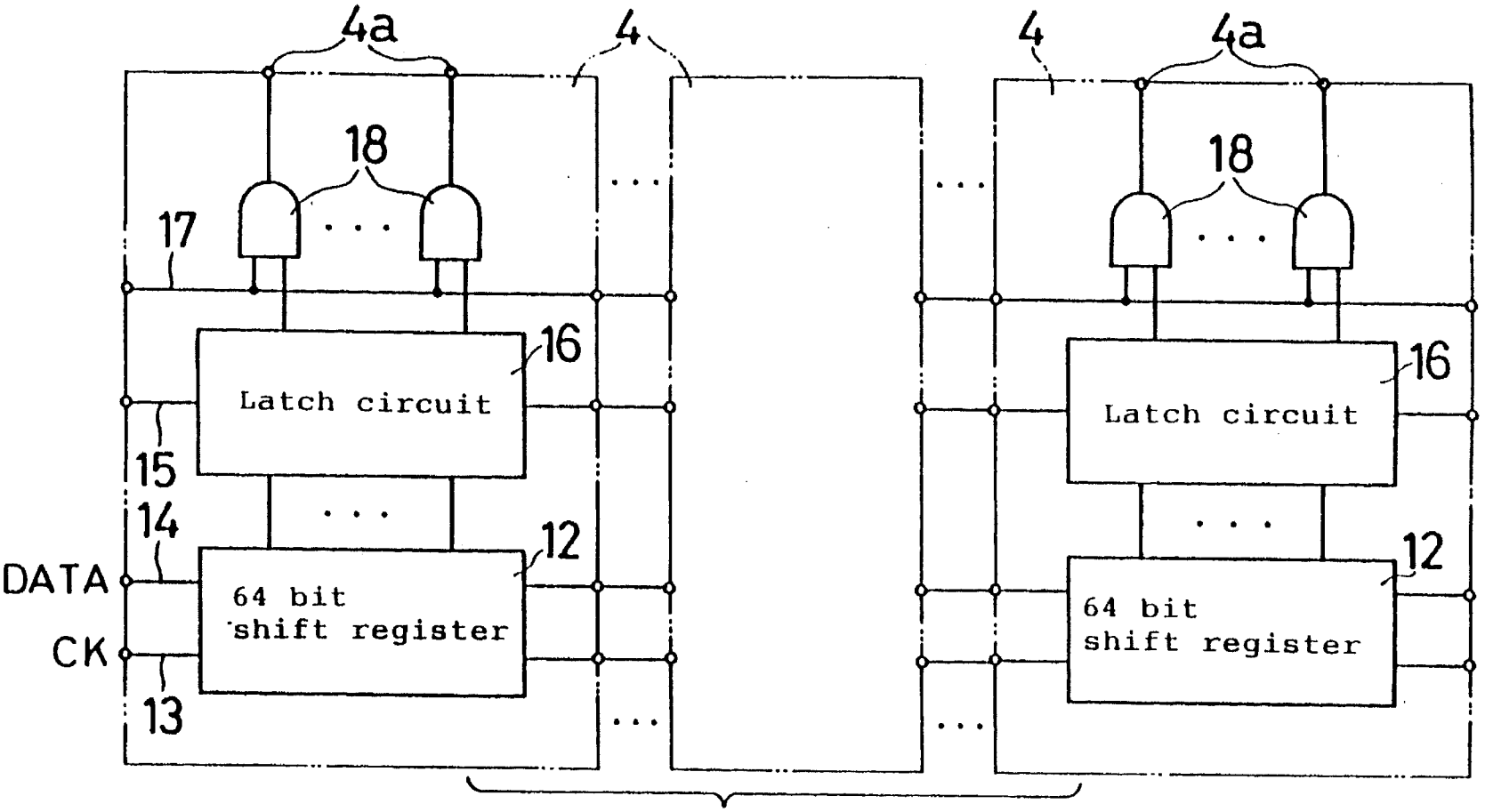
FIG. 3 PRIOR ART
FIG. 3 is a block diagram showing a practical electrical composition of an driving circuit 4 in the prior art shown in FIG. 1 and FIG. 2.
Figure 4:
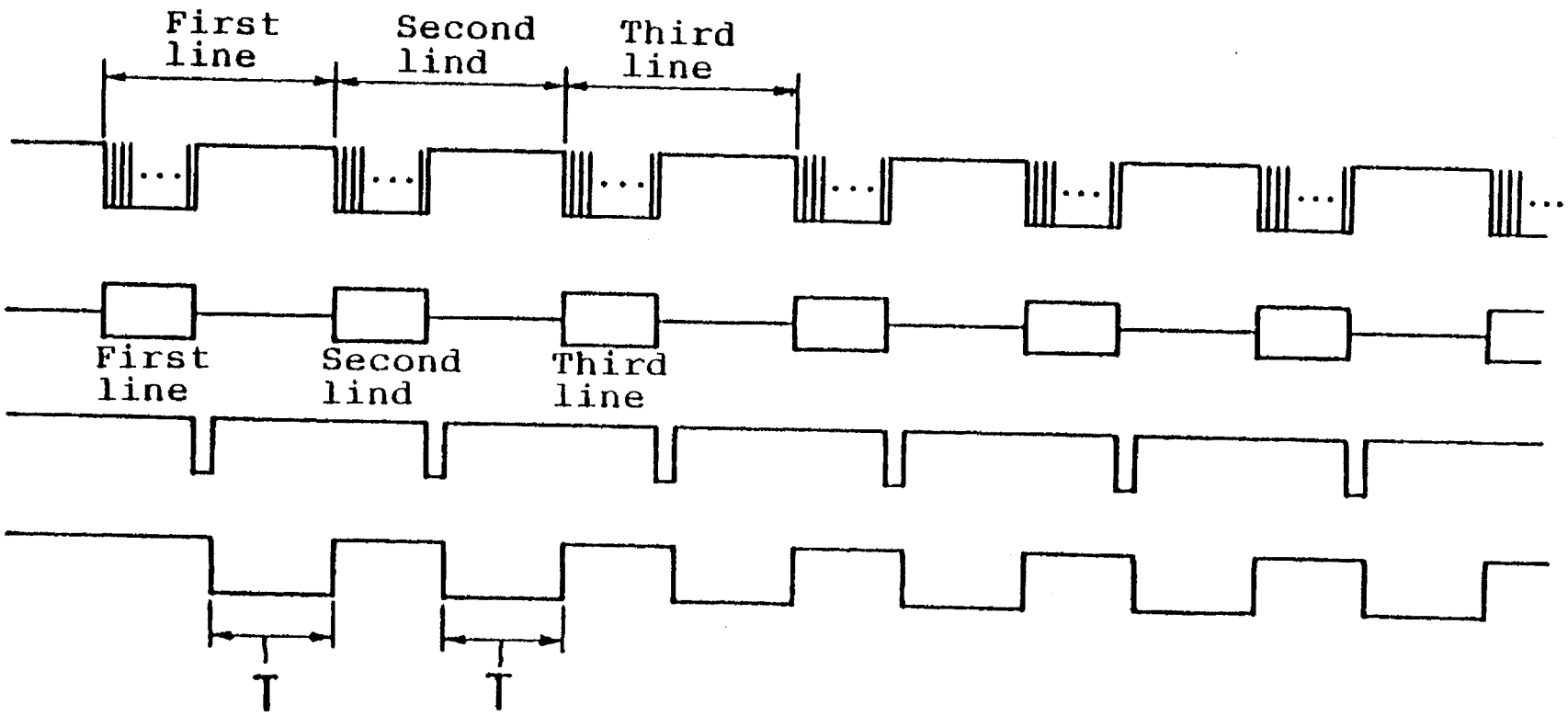
FIG. 4 PRIOR ART
FIG. 4 is a waveform diagram explaining the operation of the prior art.
Figure 5:
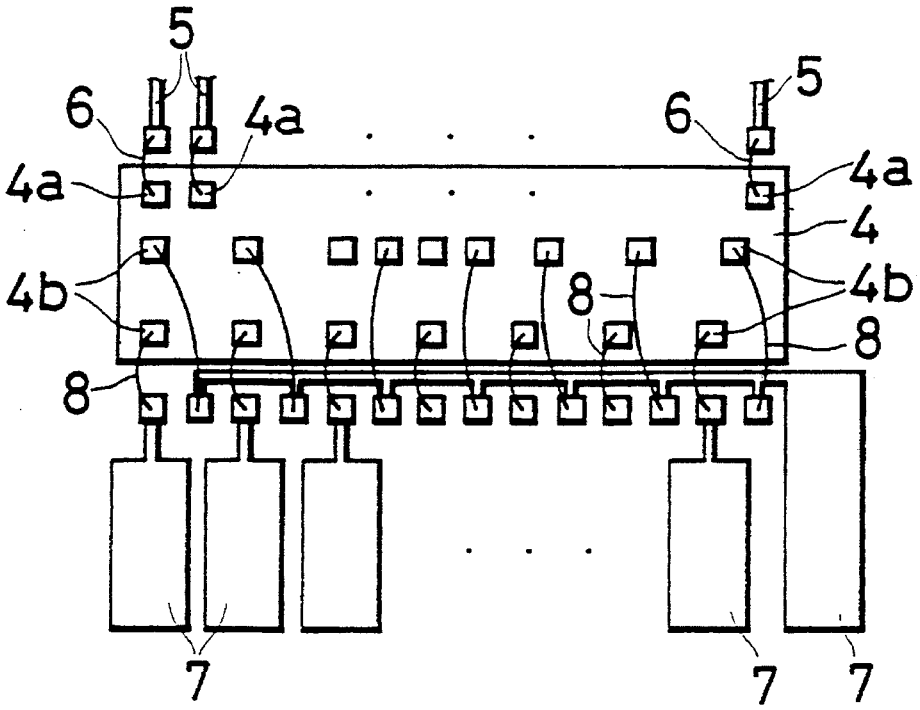
FIG. 5 PRIOR ART
FIG. 5 is a plan view near a driving circuit 4 of the prior art.

For example, in period T1 from time t1 to time t2, when a strobe signal of H level is applied to a first transistor Q1, this transistor Q1 is made to conduct, and the group A1 is selected. That is, in this period T1, H level signals are given to arbitrary transistors 121 of the first and second transistor arrays 122, 123 as shown in FIG. 3 (5), (7), (10), while low level signals are given to the remaining transistors as shown in FIG. 3 (6), (8), (9). As a result, the transistors 121 provided with H level signals are made to conduct, while the other transistors 121 given L level signals are cut off. Therefore, the individual signal line l in which the transistor 121 is conductive is grounded through resistances R12 to R13, and a driving current flows into the LED P in the group A1 corresponding to the individual signal line l in which the transistor 121 is cut off, thereby emitting light.

Similarly, in the period T2 from time t2 to time t3, the group A2 is selected as shown in FIG. 3 (2), and a driving current flows into the LED P selected by the data signal to emit light. In this way, the groups A3 and A4 are sequentially selected, and the corresponding LEDs P are driven.

When the group Ai (i=1 to 4) is selected, the driving current flowing into the corresponding LED P is the sum of the current flowing from the DC power supply 128 through the first branch lines l1*a* to l6*a*, and the current flowing through the second branch lines l1*b* to l6*b*. For example, in the group A2, the sum of the driving current flowing through the pull-up resistance R1 disposed in the first branch lines l1*a* to l6*a* and line resistance R4 of individual signal line l, and the driving current flowing through the pull-up resistance R2 disposed in the second branch lines l1*b* to l6*b* and the line resistances R6, R4 of the individual signal line l is given to the corresponding LEDs P.

Likewise, the driving current given to the group A3 is the sum of the current flowing through the pull-up resistance R1 and line resistances R4, R5, and the current flowing through the pull-up resistance R1 and line resistance R6.

In this way, in the optical printer head 20*f* of the invention, since two branch lines l1*a* to l6*a*, l1*b* to l6*b* are disposed as the power supply source to the individual signal lines in a manner to hold from both sides of group Ai, regardless of the position on the individual signal lines l to which the group Ai is connected, that is, regardless of the magnitude of the line resistance of the individual signal lines l, the supplied driving currents are not uneven.

Figure 47:
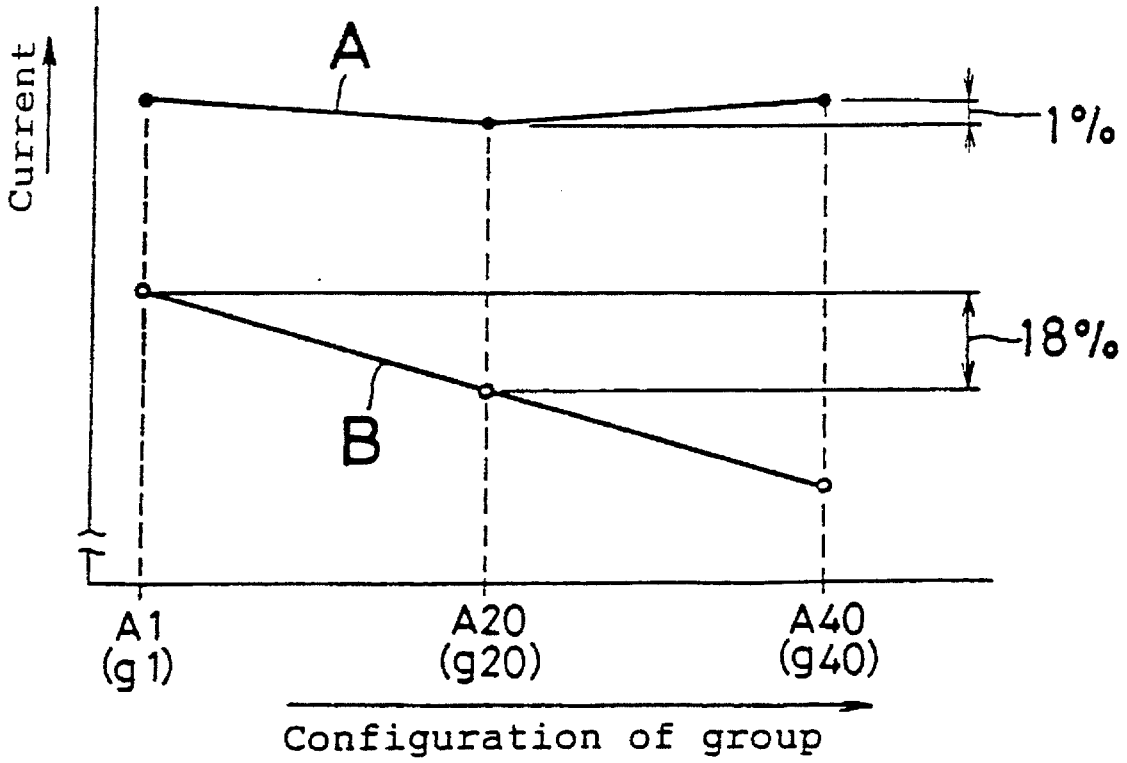
FIG. 47 is a graph showing the comparison between the invention and the prior art.

FIG. 47 is a graph showing the relation between the configuration of the group Ai and the magnitude of the driving current, in which the prior art and the invention are compared with respect to an optical printer head 201 shown in FIG. 11 comprising 40 LED arrays gi (i=1 to 40). That is, the magnitude of the driving current flowing in every LED array gi (i=1 to 40) in the conventional optical printer head 201 having the power supply 222 and driving circuit 4 disposed only at one side of the individual signal line 205 is indicated by line B, and the magnitude of the driving current by the invention is denoted by line A.

In the prior art, as compared with the magnitude of the driving current flowing in the first LED array g1 connected at the closest position to the power supply 222 which is the power feeding source of the individual signal line 204, the magnitude of the driving current flowing in the 20th LED array g20 connected in the middle position in the longitudinal direction of the individual signal line 205 is about 18% smaller, and therefore it is about 36% smaller at the remotest LED array g40.

On the other hand, according to the invention, the magnitude of the driving current flowing in the group A20 at the middle position is only about 1% smaller than the magnitude of the driving currents flowing in the first group A1 and the 40th group A40 positioned at both ends, and an almost uniform magnitude is obtained over the entire length of the individual signal lines l. That is, along the overall length in the direction of arrangement of LED arrays Ai, the magnitude of the driving currents flowing in the LEDs P is almost uniform, and the quantity of their light emission is hence almost constant. Therefore, by using such optical printer head 20*f*, the quality of the obtained image may be enhanced.

Meanwhile, the branch lines l1*a* to l6*b* and the transistor arrays 122, 123 for feeding electric power to the individual signal lines may be disposed at intermediate positions, instead of the both ends of the individual signal lines l.

Thus, according to the invention, without decrease of the driving current flowing in the selected LED elements due to line resistance of the common line to which the LED arrays are connected, unevenness of the intensity of light emission in the LED elements in all LED arrays may be eliminated, so that deterioration of the image quality obtained by the image forming apparatus according the invention may be prevented.

In such embodiment, the driving means is composed so as to drive the LEDs contained in one block, and each block is sequentially changed over to drive all LEDs, and therefore the structure of the driving means may be simplified if the number of blocks, hence the number of LEDs, is great, so that lowering of cost and reducing of size may be realized. To the contrary, if the emission time for exposure of the photoreceptor by each LED electrically energized is, for example, at least 34 μsec, in the LED head of 300 dots/inch for printing in the A4 format conforming to JIS, and when a total of 40 blocks are provided, and it is designed to energize all LEDs contained in each block simultaneously, the duration of 1.36 msec/line (=34 μsec×40) is required.

Figure 48:
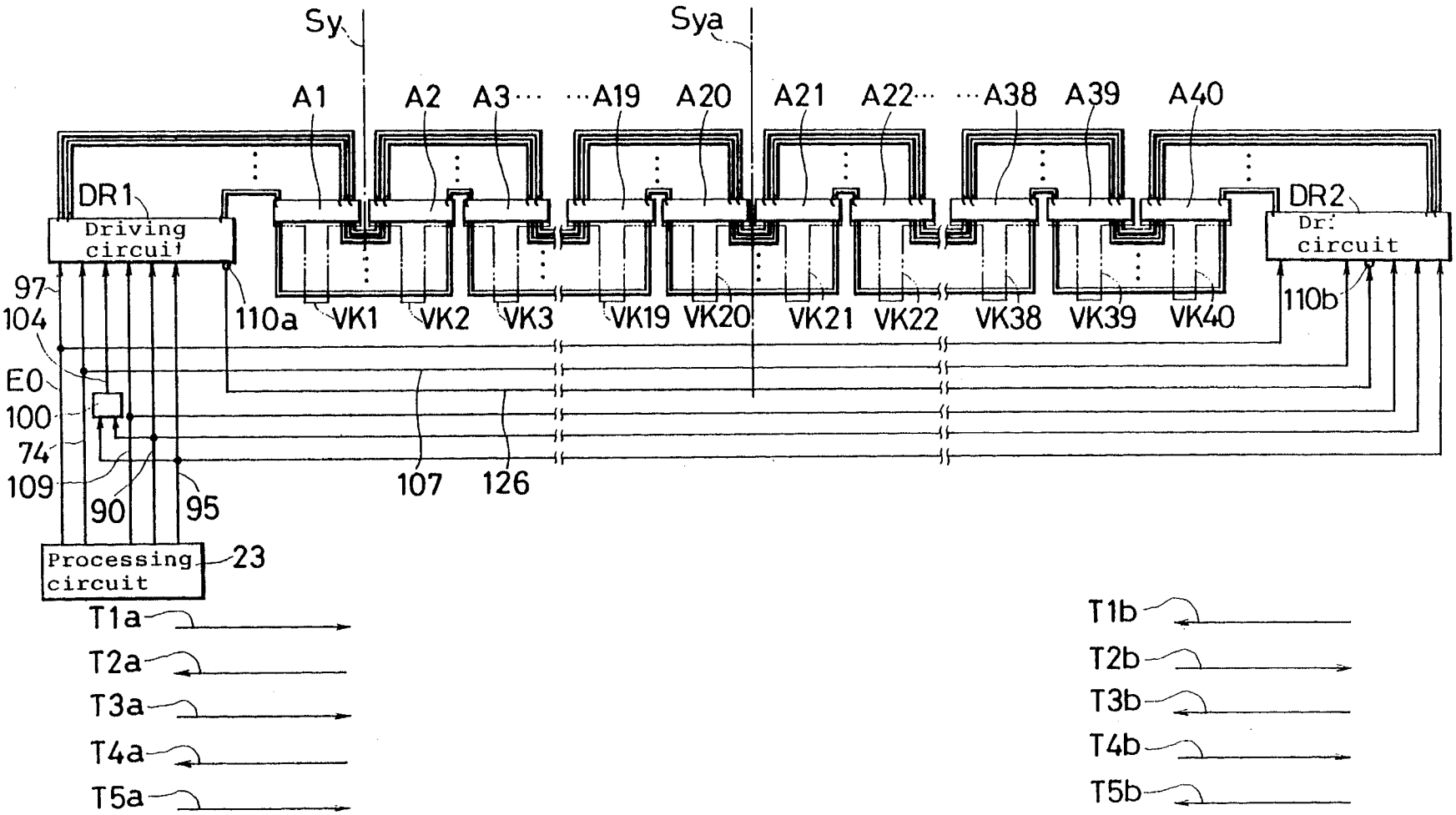
FIG. 48 is a simplified block diagram of a further different embodiment of the invention.

FIG. 48 is a simplified entire block diagram of a further different embodiment of the invention. This embodiment is similar in structure to the embodiments shown in FIGS. 12 to 14 and 16, and the detailed description is omitted herein. This image forming apparatus possesses printing means 71 as the LED head, and this printing means 71 has plural (40, in this embodiment) blocks A1 to A40 disposed in a row in the direction of arrangement, that is, in the lateral direction in FIG. 48, and, exposing the photoreceptor conveying in the direction (vertical direction in FIG. 48) orthogonally crossing with this direction of arrangement, an image is formed. A pair of driving means DR1, DR2 are respectively at both ends in the direction of arrangement of the blocks A1 to A40, and a changeover signal is given to one driving means DR1 from the changeover signal generation source 100 through line 104, and this driving means DR1 possesses an output terminal 110*a*, from which an inverted changeover signal of the changeover signal is led out. The inverted changeover signal from the output terminal 110*a* is given to an input terminal 110*b* of the other driving means DR2 through line 126. The signal for control and the print data signal from the processing circuit 23 are given to the driving means DR1, DR2. In the block sequence, the LEDs contained in the blocks are energized and driven.

FIGS. 49, 50, 51 and 52 are block diagrams showing practical composition of the image forming apparatus in this embodiment. The blocks A1 to A40 contain LEDs to 1P64, . . . , 40P1 to 40P64, and each block of A1 to A40 contains a total of 64 LEDs.

Figures 49, 50, 51, 52:
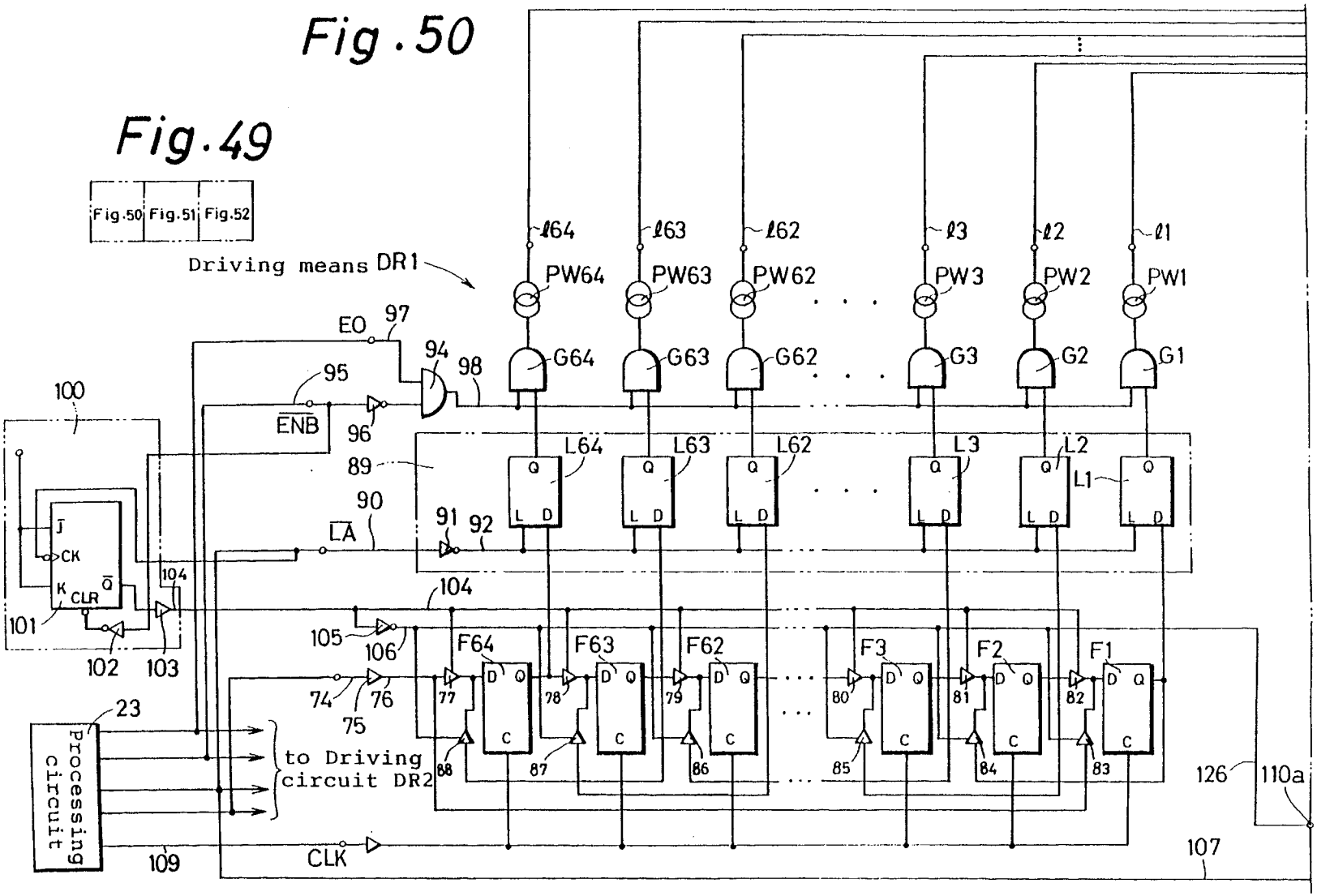
FIG. 49 is a drawing showing the structure of the same embodiment.
FIG. 50 is a block diagram showing the structure of driving means DR1.
FIG. 51 is a block diagram of printing means 70.
FIG. 52 is a block diagram of driving means DR2.
Figure 51:
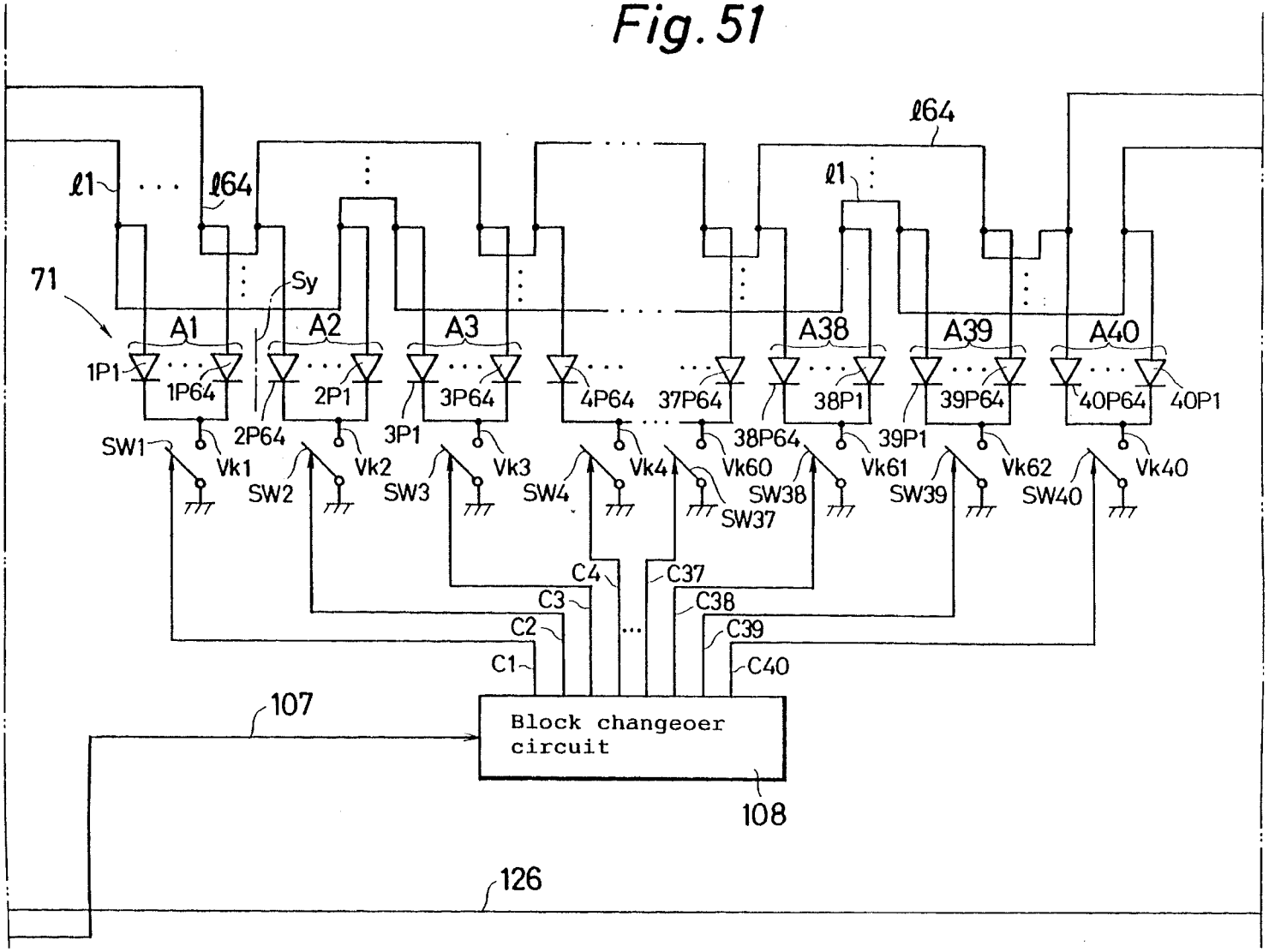
Figure 52:
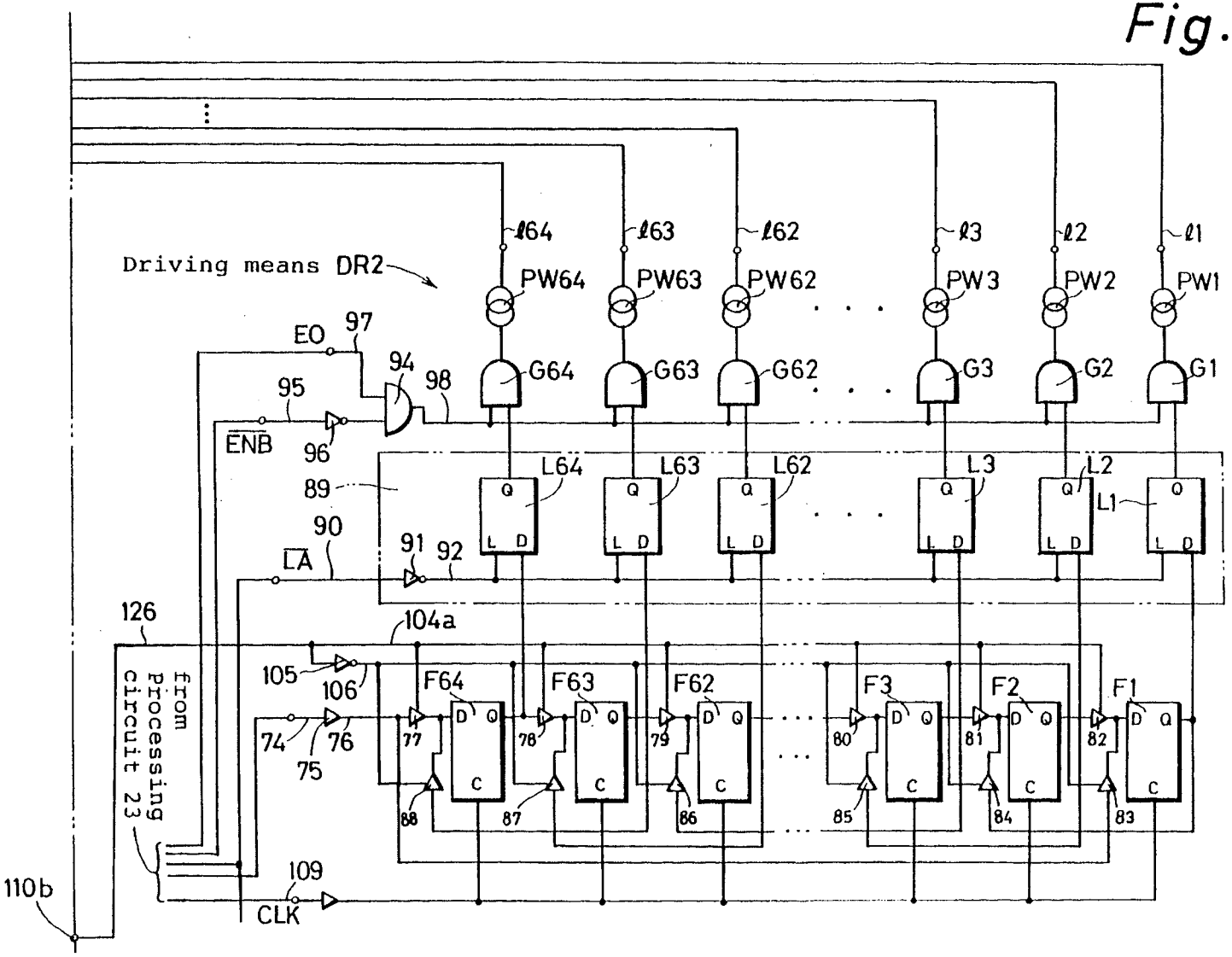

The individual signal lines l1 to l64 are connected with LEDs at symmetrical positions at the right and left sides in FIG. 51, relating to adjacent blocks, say, symmetrical surfaces Sy of A1, A2 (see FIG. 51), for example, the terminals at one side of 1p1, 2p64, and the terminals at other side of LEDs 1p2, 2p63 at symmetrical positions are respectively connected. The printing means 71 is composes so that a total of 20 blocks A1 to A20, and another 20 blocks A21 to A40 may by symmetrical with respect to the symmetrical surface Sy.

The control content of the changeover signal generation source 100 by the processing circuit 23 in this embodiment, and the control content of the driving means DR1 and driving means DR2 are same as in the explanation referring to FIGS. 18 to 21, and more specifically as in the explanation referring to FIGS. 37 and 38, and such explanation is omitted herein. The noticeable action in this embodiment is as follows.

In one driving means DR1, the changeover signal from the line 104 is inverted, and the inverted changeover signal is led out from the output terminal 110*a*, and the inverted changeover signal from the output terminal 110*a* is fed into the input terminal 110*b* of the other driving means DR2 through a line 110. Thus, the driving means DR1, DR2 store and lead out the print data in the opposite data transfer directions, and the transfer direction is indicated by reference codes T1*a* to T5*a* in FIG. 48, and reference codes T1*b* to T5*b*.

The driving means DR1 inverts the changeover signal from the line 104 in the inverting circuit 105, and leads out the inverted changeover signal from the output terminal 110*a*, and gives to the input terminal 110*b* of the other driving means DR2 through the line 126. These driving means DR1, DR2 operate in the same manner, except that the data transfer directions are opposite to each other. The driving means DR has the same structure as the driving means DR1, and the corresponding parts are identified with the same reference numbers. In this driving means DR2, the inverted changeover signal through the line 106 of the driving means DR1 is given through the line 126 to the line 104*a* of the driving means DR2. In the driving means DR2, the parts corresponding to those of the driving means DR1 are sometimes indicated by attaching the subscript "a" to the same reference numbers.

The flip-flops F1 to F64 of the driving means DR1 correspond to the individual signal lines l1 to l64, and by contrast, at the other driving means DR2, the flip-flops F1 to F64 correspond to the individual signal lines l64 to l1. In the driving means DR2, as the inverted changeover signal from the driving means DR1 is given to the line 104 through the line 126, the print data corresponding to the LEDs in the blocks A1 to A40 are stored in the mutually reverse directions of the direction of arrangement of LEDs in the flip-flops P1 to F64 of the driving means DR1 and the flip-flops P1 to F64 of the driving means DR2. Therefore, the driving means DR1, DR2 can commonly energize the same LEDs in the blocks A1 to A40.

For example, on the basis of the output of the flip-flop F1 of the driving means DR1, the LED 1P1 of the block A1 is electrically energized through the individual signal line l1, and at this time, on the basis of the output of the flip-flop F64 of the other driving means DR2, the electric power of the LED 1P1 is supplied to the line l1. In this way, as one LED 1P1 is energized by two driving means DR1, DR2, a large current can be passed into the LED 1P1. Therefore, its emission output can be increased. This holds true with the remaining LEDs. Thus, by increasing the emission output of the LEDs, the energizing time W1 (see FIG. 38 (6) to (8)) may be shortened, and the printing speed may be raised.

The invention may be realized not only in relation to the LED head, but also to the heating resistance element of the thermal head, or also to printing elements in other structure.

The driving means DR1, DR2 may also possess other structures.

Anyway, according to the invention, since a pair of driving means are disposed at both ends in the direction of arrangement of blocks of printing elements and the printing elements contained in the selected block are driven simultaneously by the driving means, the electric current supplied in the printing elements may be increased, and the emission output may be increased if the printing elements are LEDs, or the heat generation may be increased when the printing elements are heating resistance elements, and hence the required energization time may be shortened, and hence the printing speed may be enhanced.

Furthermore, by the invention, the changeover signal from the changeover signal generation source is given to one driving means, and alternately changes over the storing direction of its print data, and this driving means inverts the changeover signal, and leads out the inverted changeover signal from the output terminal to give to the input terminal of the other driving means, which is designed to act in response to the inverted changeover signal received at its input terminal, and therefore the two driving means are identical in structure, and operate in the reverse store direction of the data mutually, and hence in the reverse transfer direction of the print data, so that the structure may be simplified.

in the foregoing embodiments, there is a single driving means disposed at an end in the direction of arrangement of the blocks A1 to A40, and by this driving means it is designed to drive the LEDs contained in each block by sequentially changing over the blocks. Therefore, when the number of blocks increases, it is supposed to increase the printing speed. For example, if the emission time for exposure of the photoreceptor by each LED electrically energized is required to be at least 34 μsec, in the LED head of 300 dots/inch for printing A4 format of JIS, when 40 blocks containing 64 LEDs each are disposed and the LEDs contained in each block are simultaneously energized, the time of 1.36 msec/line (=34 μsec×40) should be required. Therefore it is desired to increase the printing speed furthermore.

Figure 53:
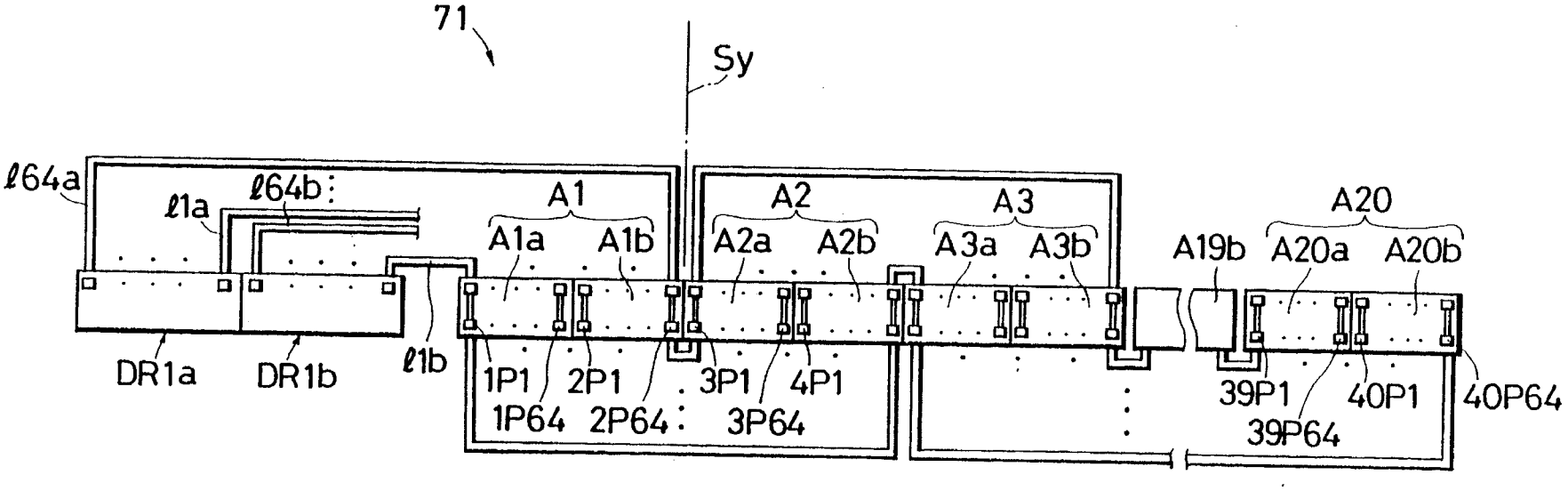
FIG. 53 is a simplified block diagram of another different embodiment of the invention.

FIG. 53 is a simplified entire block diagram of a different embodiment of the invention for realizing the above purpose. This image forming apparatus comprising printing means 71 as the LED head, and this printing means 71 is linearly disposed in the direction of arrangement, that is, the lateral direction in FIG. 53, of plural (20, in this embodiment) blocks A1 to A20, and in the direction (vertical in FIG. 53) orthogonally crossing with this direction of arrangement, the photoreceptor is conveyed, and is exposed to form an image. A pair of driving means DR1*a*, DR1*b* are respectively disposed at the end in the direction of arrangement of the blocks A1 to A20, and in the block sequence the LEDs contained in the blocks are electrically energized and driven. The block A1 contains plural (2, in this embodiment) block portions A1*a*, A1*b*, and the other blocks A2 to A20 are similarly structured.

FIGS. 54 to 57 are block diagrams showing a practical structure of the image forming apparatus of this embodiment containing the driving means DR1*a*, DR1*b*. The blocks A1 to A20 contain LEDS 1P1 to 1P64 . . . , 40P1 to 40P64, and each one of blocks A1 to A20 possess a total of 128 LEDs, individually. The block portion A1*a* has a total of 64 LEDs 1P1 to 1P64, and the block portion A1*b* has a total of 64 LEDs 2P1 to 2P64, and the remaining block portions have the same structure.

The output of the flip-flop F1*a* of the driving means DR1*a* is delivered from the first switching element 83*a* through the line 127, and is fed into the input terminal 132 of the other driving means DR1*b* from the output terminal 131, and thus the driving means DR1*a*, DR1*b* are linked, and the data is transferred continuously from the driving means DR1*a* to DR1*b*.

The changeover signal from the line 104*a* of the driving means DR1*a* is given from the line 104*c* through the output terminal 133, to the line 104*b* from the input terminal 134 of the other driving means DR1*b*.

When transferring the data to be printed from the processing circuit 23 by storing in the reverse direction (from right to left in FIG. 55 and FIG. 56), the print data is fed from the output terminal 135, which serves also as the input of the driving means DR1*b* from the line 136, into the switching element 83*b*, and is fed into the flip-flop F1*b*. The output of the flip-flop F1*b* is given to the switching element 183*b*, and is given to the output terminal 135, and also to the switching element 83*b*.

The output of the flip-flop F64*b* in the first stage of this driving means DR1*b* is given from the switching element 188*b* to line 74*b*, and the inverted changeover signal from the line 106*b* is given to this switching element 188*b*. Such structure is same for the other driving means DR1*a*, and the corresponding parts are shown by attaching the subscript "a" to the same reference numbers.

Figure 58:
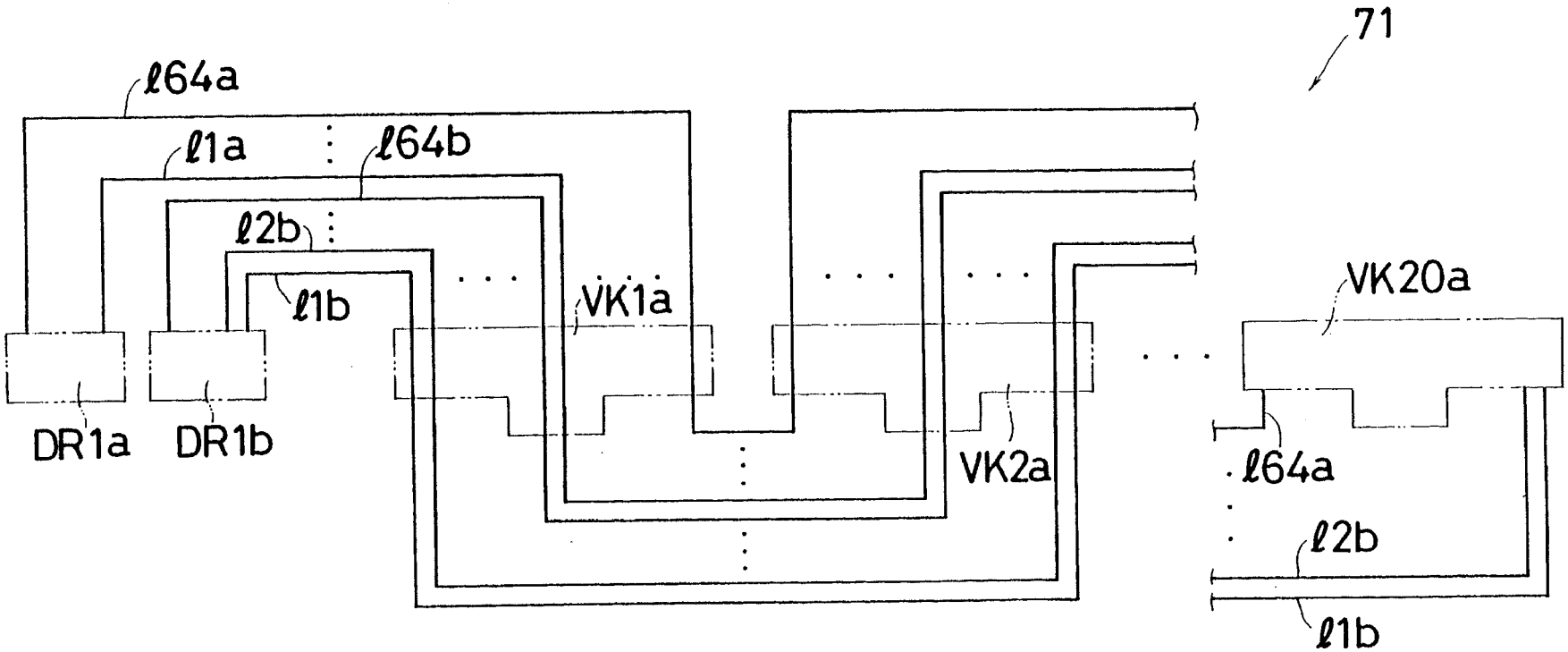
FIG. 58 is a simplified plan view of printing means 71.

FIG. 58 is a simplified plan view of the printing means 71. The terminals at one side of the LEDs contained in the blocks A1 to A20 are connected to the individual signal lines l1*a* to l64*a*, l1*b* to l64*b*.

Figure 59:
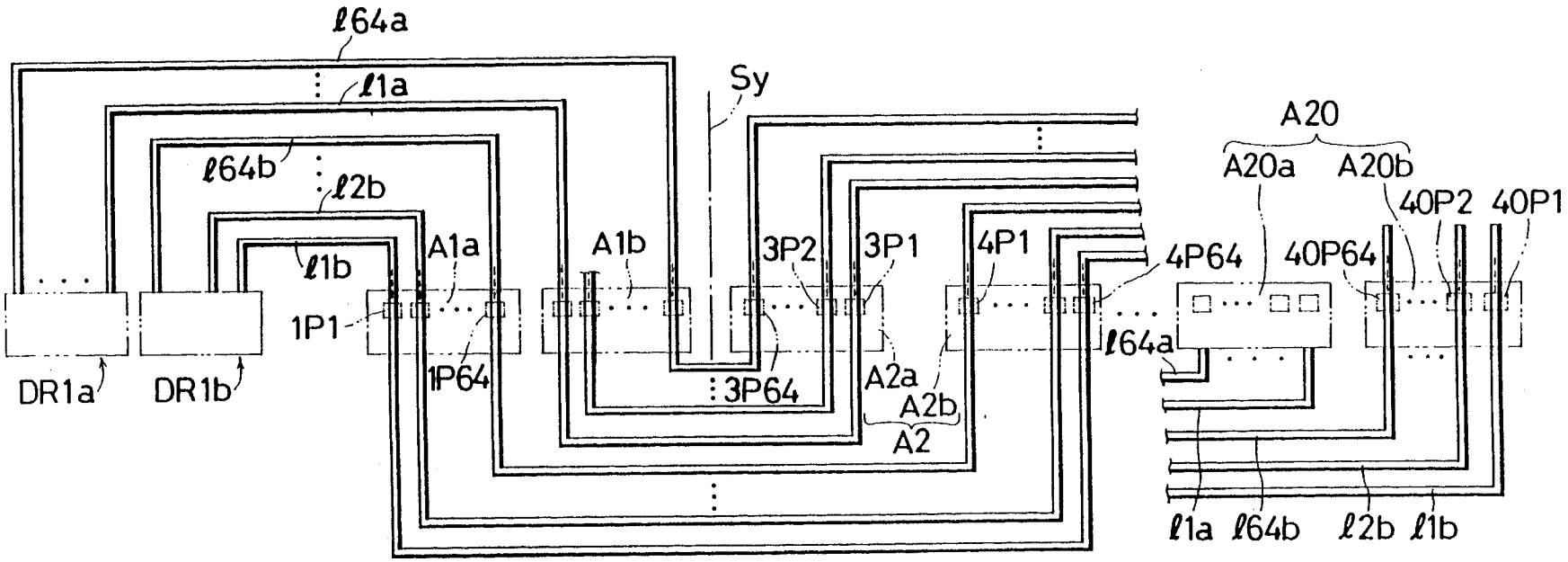
FIG. 59 is other simplified plan view of the same printing means 71.

FIG. 59 is a different simplified plan view of the printing means 71. The other terminals of the LEDs contained in the blocks A1 to A20 are respectively connected to the common signal lines VK1*a* to VK20*a* of blocks A1 to A20.

Figure 60:
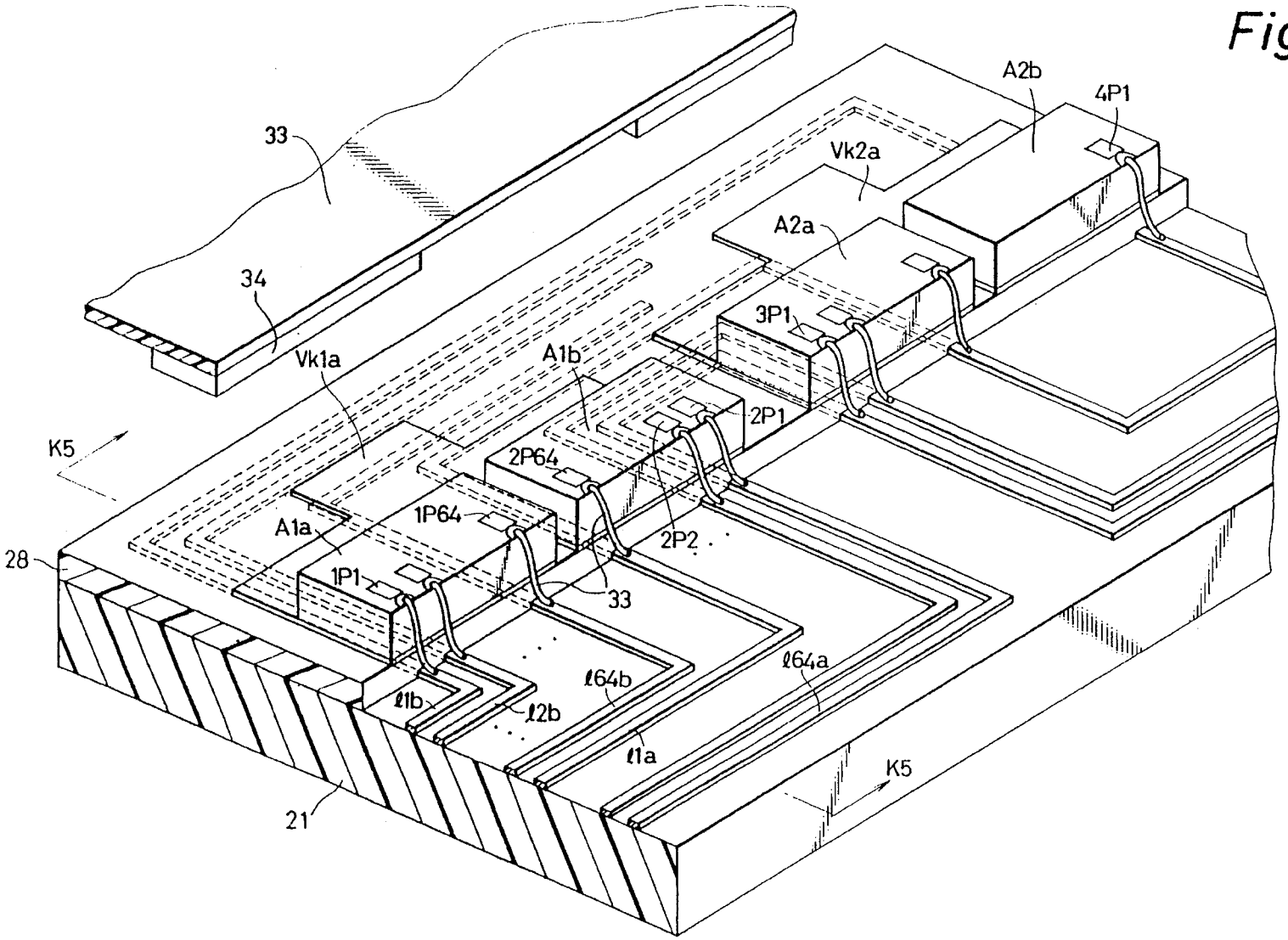
FIG. 60 is a partial perspective view of printing means 71.
Figure 61:
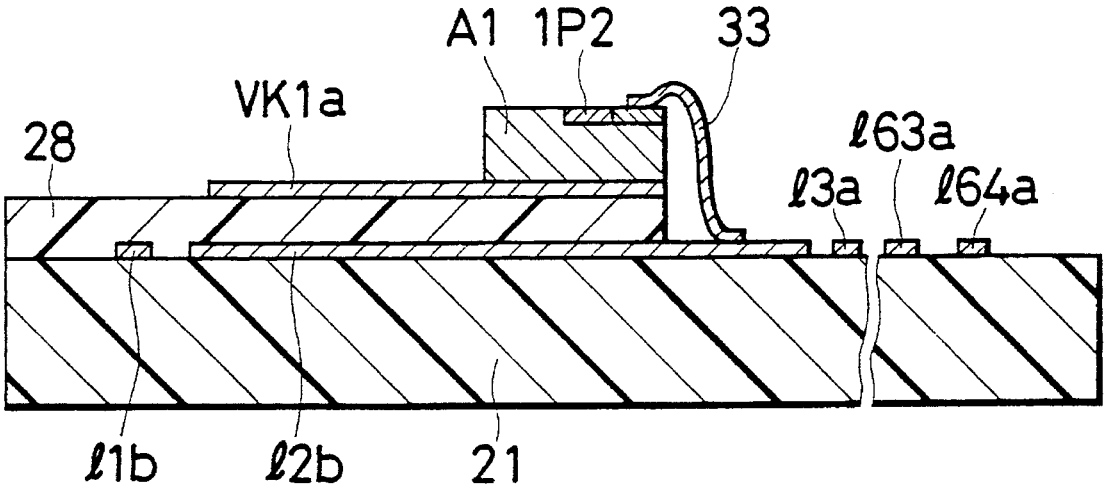
FIG. 61 is a sectional view seen from section line K5—K5 FIG. 60, FIGS. 62(1)–62(8) are waveform diagrams showing the operation of the embodiments shown in FIG. 53 to FIG. 61.

FIG. 60 is a partial perspective view of the printing means 71, and FIG. 61 is a sectional view seen from section line K5—K5 in FIG. 58. The substrate 21 is made of an electrically insulating material such as ceramic and glass, and the individual signal lines l1*a* to l64*a*, l1*b* to l64*b* are formed on its surface in a zigzag or crank form. These individual signal lines l1*a* to l64*a*, l1*b* to l64*b* are connected with terminals at one side of the LEDs, for example, 1p1, 4p64, at symmetrical positions at the right and left sides in FIG. 53, with respect to the symmetrical surfaces Sy of adjacent blocks, say, A1, A2 (see FIG. 53), and the terminals at one side of LEDs 1p2, 4p63 at symmetrical positions are individually connected.

On the substrate 21, an electrical insulation layer 28 is partially formed on the individual signal lines l1*a* to l64*a*, l1*b* to l64*b*, and the common signal lines VK1*a* to VK20*a* are formed thereon. These common signal lines VK1*a* to VK20*a* are commonly connected with the other terminals of the LEDs 1P1 to 1P64, . . . , 40P1 to 40P64 of the blocks At to A20. That is, the LEDs 1P1 to 1P64, 2P1 to 2P64 contained in the block portions A1*a*, A1*b* in the block A1 are commonly connected to the common signal line VK1*a* corresponding to the block A1, and this structure is same as in the remaining blocks A2 to A20.

As clearly shown in FIG. 61, the LED 1P2 and the individual signal line l2*a* are mutually connected by bonding wire 33. The similar structure is applied to the other LEDs.

The common electrode VK1*a* to VK20*a* are individually and electrically connected to the conductor 34 formed on the surface of the flexible film 31.

Figures 54, 55, 56, 57:
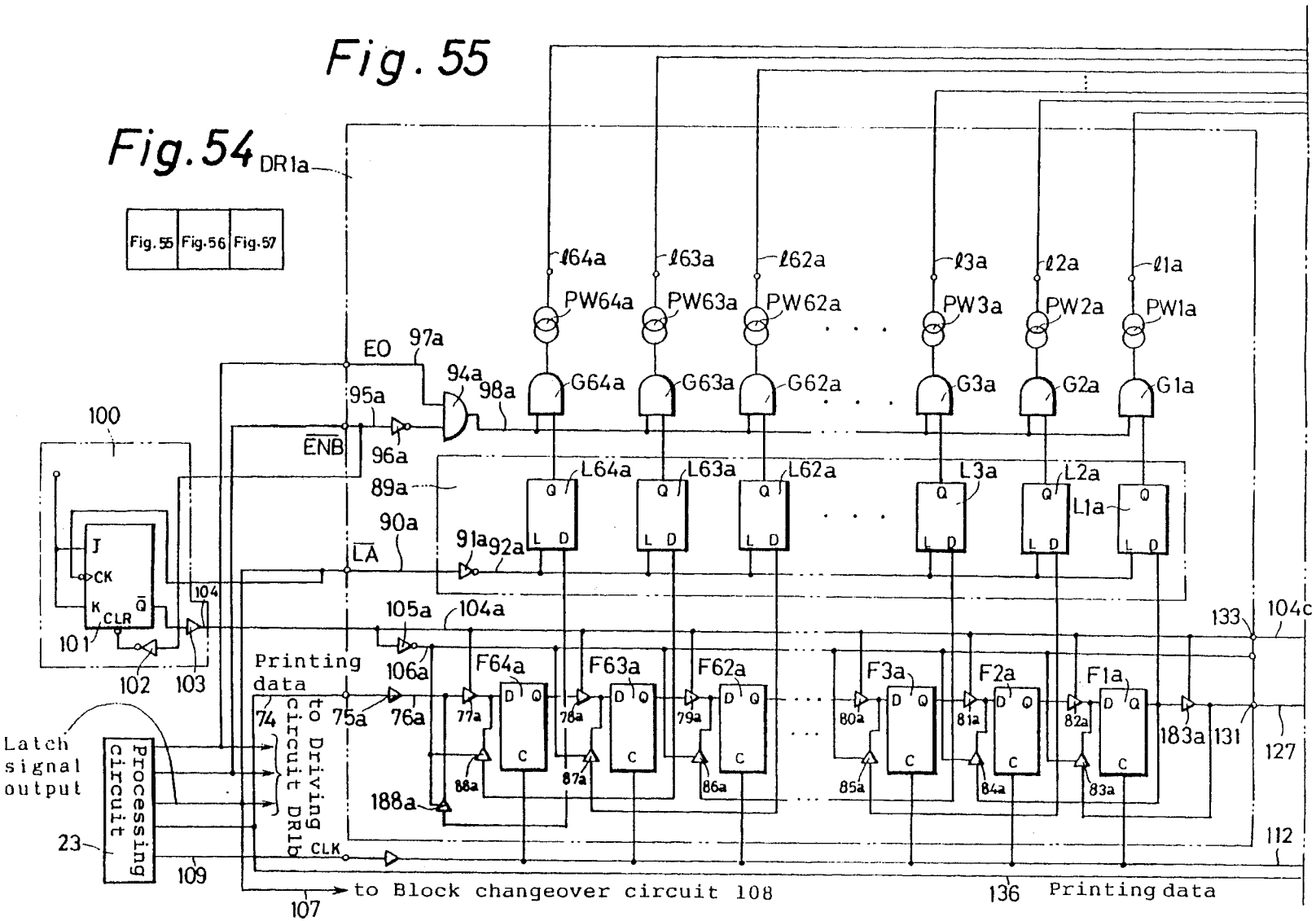
FIG. 54 is a drawing showing the structure of the same embodiment.
FIG. 55 is a block diagram showing the structure of driving means DR1***a*.
FIG. 56 is a block diagram of driving means DR1*b*.
FIG. 57 is a block diagram of printing means 71.
Figure 56:
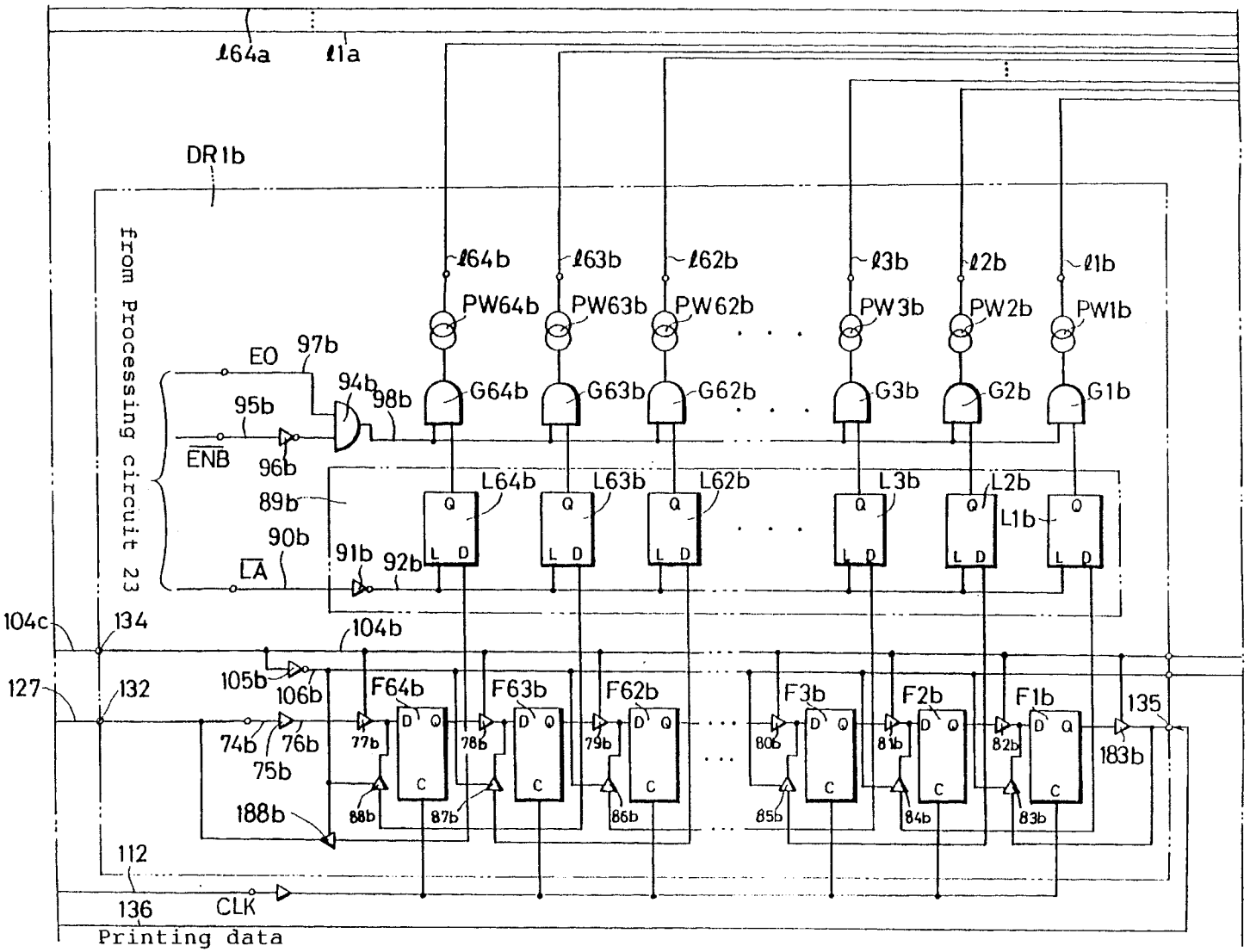
Figure 57:
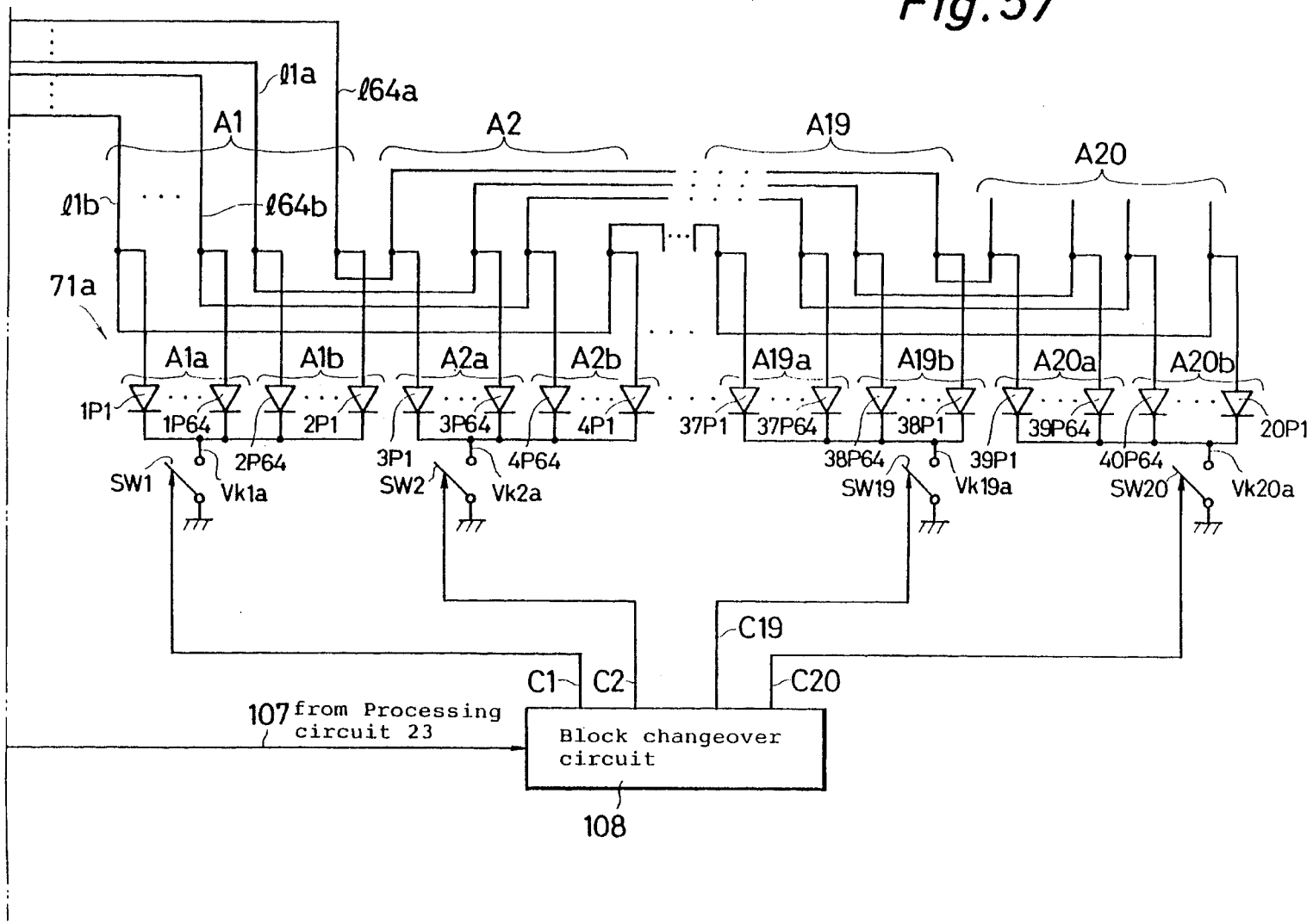

Referring again to FIG. 54 to FIG, 57, the driving means DR1*a*, DR1*b* for driving the printing means 71 are disposed on the substrate 21, and the driving means DR1*a*, DR1*b* drive the LEDs 1P1 to 1P64, . . . , 40P1 to 40P64, on the basis of the sequential print data delivered from the processing circuit 23, sequentially in each block, from right to left in FIG. 53 and FIG. 57, in the direction of arrangement.

In the driving means DR1*a*, DR1*b*, there are D-type flip-flops F1*a* to F64*a*, F1*b* to F64*b* which are memory elements individually corresponding to the LEDs of the blocks A1 to A20. The print data DA from the processing means 23 through the line 74 is given to the input terminal of the first stage flip-flop F64*a* from the first switching element 77*a*, through the line 76*a* from the buffer 75*a*. The output Q of the flip-flop F64*a* is further given to the input terminal of the flip-flop F63*a* of the next stage by way of the first switching element 78*a*, and thereafter similarly the first switching elements 79*a* to 82*a*, 183*a* are provided.

By conducting the first switching elements 77*a* to 183*a* in this way, the printing data can be transferred in the forward direction from left to right in FIG. 55, and the printing data from the first switching elements 183*a* is given to the other driving means DR1*b* in the forward direction, and stored.

To transfer the printing data in the reverse direction from right to left in FIG. 55, the output of the first stage flip-flop F64*b* of the driving means DR1*b* is transferred in the reverse direction from the switching element 188*b*,line 127 and the input terminal 132 serving also as the output, through the input terminal 131 of the driving means DR1*a* and line 127, and this print data is fed to the input of the flip-flop F1*a* in the final stage through the second switching element 83*a*, and the output Q of this flip-flop F1*a* in the final stage is given to the input of the memory element F2*a* one stage before through the second switching element 84*a*, and thereafter similarly the second switching elements 85*a* to 88*a*, 188*a* are provided.

The outputs of the flip-flops F1*a* to F64*a* are applied to the inputs of the D-type flip-flops L1*a* to L64*a* installed in the latch circuit 89*a*, and these flip-flops L1*a* to L64*a* perform latch actions when the latch signal $\overline{LA}$ given from a latch signal output of the processing circuit 23 to the latch signal output line 90*a* is given from the inverting circuit 91*a* through line 92*a*. The outputs of the flip-flops L1*a* to L64*a* of the latch circuit 89*a* are given to one of the inputs of the AND gates G1*a* to G64*a*, and the outputs of these AND gates G1*a* to G64*a* are given to current sources PW1*a* to PW64*a*. The current sources PW1*a* to PW64*a* supply currents, using the individual signal lnies 11*a* to 164*a* as one of the potentials, thus feeding the driving power for the LEDs.

To the AND gate 94*a*, the strobe signal $\overline{ENB}$ is given from the processing circuit 23 through line 95*a* and inverting circuit 96*a*, and the signal E0 becoming high level after turning on the power source is given also to this AND gate 94*a* fore the processing circuit 23 through lane 97*a*. The output of the AND gate 94*a* is given from the line 98*a* to the other inputs of the AND gates G1*a* to G64*a*.

The changeover signal generation source 100 possesses a JK flip-flop 101, of which truth value table is as shown in Table 3.

TABLE 3

| CLR | CK | J | K | $\bar{Q}$ |
|---|---|---|---|---|
| L | x | x | x | H |
| H | ⌐ | H | H | Toggle |

Here, the input terminals J, K of the flip-flop 101*a* are connected to the power supply so as to be always kept at high level. The strobe signal $\overline{ENB}$ is applied to the clear input terminal CLR from the line 95 through the inverting circuit 102. The latch signal $\overline{LA}$ is fed to the clock input terminal CK. The output from the output terminal $\overline{Q}$ is given to the first switching elements 77*a* to 82*a* through line 104*a* as changeover signal from the buffer 103, and these first switching elements 77*a* to 82*a* are made to conduct when a high level signal is given from the line 104*a*, and are cut off when a low level signal is given. The changeover signal from the buffer 103 is inverted in the inverting circuit 105*a*, and is applied to the second switching elements 83*a* to 88*a* as another inverted changeover signal from the line 106*a*, and when this inverted changeover signal from the line 106*a* is at high level, these second switching elements 83*a* to 88*a* are made to conduct, and when it is low level, they are cut off. The other driving means DR1*b* is similarly structured, and the corresponding parts are indicated by attaching the subscript "b" instead of "a" to the same reference numbers.

The lines 104*a*, 104*b* are mutually connected by line 104*c*, and the output of the, flip-flop F1*a* of the driving means DR1*a* is applied to the input of the flip-flop F64*b* of the driving means DR1*b* through lines127, 74*b*, terminals 131, 132, buffer 75*b* and first switching element 77*b*. Furthermore, the printing data from the processing circuit 23 is given to the flip-flop F1*b* by way of the second switching element 83*b* through the terminal 135 of the driving means DR1*b* via line 136. The output of the flip-flop F64*b* of the driving means DR1*b* is applied to the flip-flop F1*a* of the driving means DR1*a* by way of the second switching element 83*a* from the switching element 188*b* through the line 127 and further through the terminals 132, 131.

The LEDs of blocks A1 to A20 are connected to the switches SW1*a* to SW20*a* through the common signal lines VK1*a* to VK20*a*, and these switches SW1*a* to SW20*a* are connected at the grounding potential. The latch signal $\overline{LA}$ is given to the block changeover circuit 108 through line 107. This blocck changeover circuit 108 responds to the latch signal $\overline{LA}$, and gives the block changeover signal to the switches SW1*a* to SW20*a* from the lines C1 to C20, thereby conducting the swatches SW1*a* to SW20*a* of the locks A1 to A20 one by one sequentially.

Figure 62:
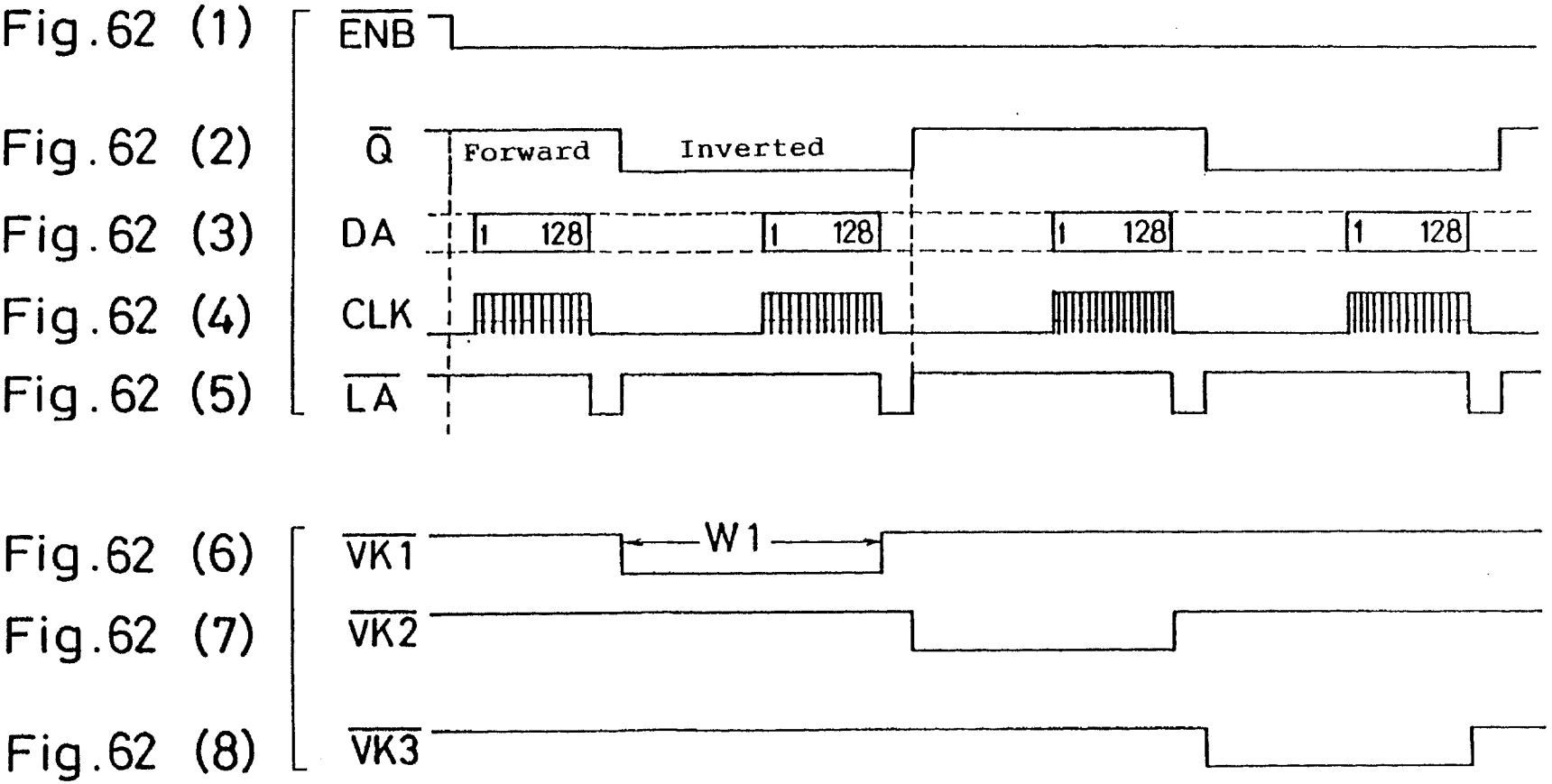

Referring now to FIG. 62, the operation of the printing means 71 and the driving means DR1*a*, DR1*b* is explained. To start image formation, the processing circuit 23 gives a high level signal to the line 97*a*, and sets the strobe signal $\overline{ENB}$ to low level as shown in FIG. 62 (1), so that the signal led out from the AND gate 94*a* of the driving means DR1*a* into the line 98*a* becomes high level, and the flip-flop 101 of the changeover signal generation source 100 is cleared, and its output $\overline{Q}$ becomes high level. This output $\overline{Q}$ of the flip-flop 101 remains at high level even when the strobe signal $\overline{ENB}$ inverted by the inverting circuit 102 is changed from low level to high level, and in this state the flip-flop 101 is ready to accept the latch signal $\overline{LA}$ at the clock input terminal CK.

The waveform of the output $\overline{Q}$ of the flip-flop 101, that is, the waveform of the line 104 is as shown in FIG. 62 (2), and since this output $\overline{Q}$ is at high level, the first switching elements 77*a* to 82*a* remain conducting. This is the same in the other driving means DR1*b*. Here, when the 128-bit print data DA from the processing circuit 23 is led out and transferred to the line 74 sequentially in the series bit as shown in FIG. 62 (3), in the flip-flops F1*a* to F64*a*, F1*b* to F64*b* which operate in synchronism with the clock signal CLK shown in FIG. 62 (4) being led out from the processing circuit 23 through the line 109, the data of the LEDs are transferred, from left to right in FIG. 55 and FIG. 56, from the flip-flop F64*a* to F1*a*, and from the flip-flop F64*b* to F1*b*, and stored, for the portion of one block, in a total of 128 dots. After the print data for one block is transferred in this way, the latch signal $\overline{LA}$ is given from the processing circuit 23 as shown in FIG. 62 (5), and hence the print data of the flip-flops F1*a* to F64*a*, F1*b* to F64*b* are transferred parallel and latched in the flip-flops L1*a* to L64*a*, L1*b* to L64*b* in the latch circuits 89*a*, 89*b*.

This latch signal $\overline{LA}$ is given to the clock input terminal CK of the flip-flop 101 of the changeover signal generation source 100, and at the trailing edge of the latch circuit $\overline{LA}$, the output $\overline{Q}$ changes from high level to low level. Accordingly, the first switching elements 77*a* to 82*a*, 77*b* to 82*b* are cut off, and the second switching elements 83*a* to 88*a*, 83*b* to 88*b* are made to conduct, so as to be ready to feed input sequentially from right to left in FIG. 55 and FIG. 56, in the flip-flops F1*a* to F64*a*, P1*b* to F64*b*. Now, the block changeover circuit 108 responds to the latch signal $\overline{LA}$, and the block changeover signal shown in FIG. 62 (6) is given to the switch SW1*a* through line C1, so that the switch SW1*a* remains conducting while the line C1 is at high level in the period W1.

In this way, the LEDs 1P1 to 1P64, 2P1 to 2P64 of the block portions A1*a*, A1*b* contained in the first block A1 are energized and lit by the currents from the current sources PW1*a* to PW64*a*, PW1*b* to PW64*b*, so that the image is printed. In this period W1 while the switch SW1*a* is conducting, the print data DA for the second block A2 is led out from the processing circuit 23 into the line 74, and is stored in the flip-flops F1*a* to F64*a*, F1*b* to F64*b* in this order through the second switching elements 83*a* to 88*a*, 83*b* to 88*b*.

The print data of the LED 3P1 of the second block A2 is stored in the flip-flop F64*a*, and the print data of the LED 3P64 is stored in the flip-flop F1*b*. Consequently, when the latch signal $\overline{LA}$ is generated, the block changeover signal generation circuit 108 leads out the low level signal shown in FIG. 62 (7) into the line C2 to conduct the switch SW2*a*, so that the LEDs 3P1 to 3P64, 4P1 to 4P64 of the second block A2 are electrically energized on the basis of the outputs of the latch circuits 89*a*, 89*b*.

Thus, while the LEDs 1P1 to 1P64, 2P1 to 2P64 of the first block A1 are energized, the print data of the LEDs 3P1 to 3P64, 4P1 to 4P64 of the second block A2 are stored in the flip-flops F1*a* to F64*a*, F1*b* to F64*b*, and the same operation is repeated and the LEDs of all blocks A1 to A20 are sequentially driven. FIG. 62 (8) shows the signal conducted from the line C3 for the block A3.

Figures 63, 64:
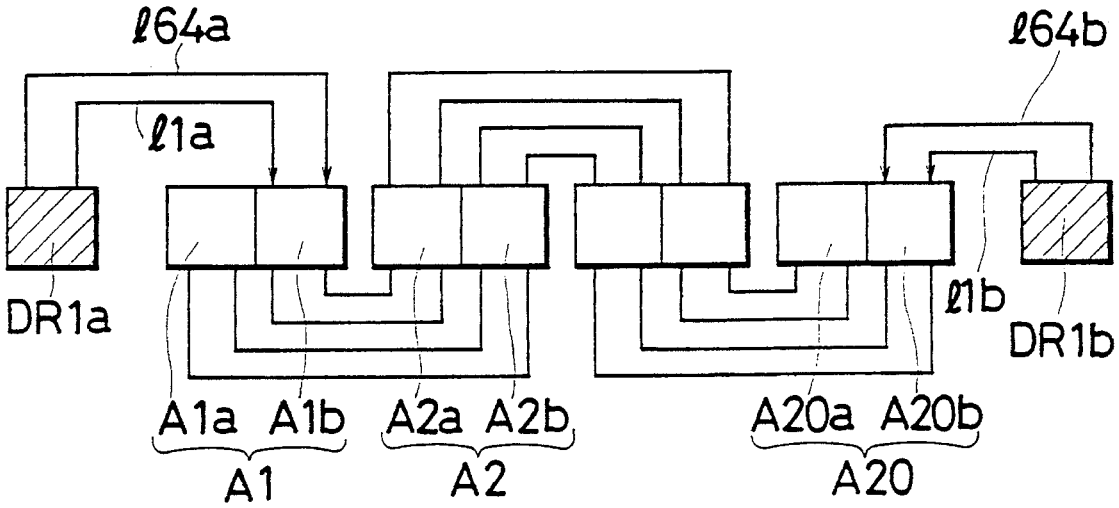
FIG. 63 is a simplified block diagram of a different embodiment of the invention.
FIG. 64 is a drawing showing a still different embodiment of the invention.

FIG. 63 is a simplified block diagram of a different embodiment of the invention. In this embodiment, driving means DR1*a*, DR1*b* are disposed at both ends in the direction (lateral direction in FIG. 63) of arrangement of the blocks A1 to A20, and the driving means DR1*a* is connected to the individual signal lines l1*a* to l64*a*, while the driving means DR1*b* is connected to lines l1*b*, to l64*b*,respectively, and the LEDs contained in the blocks A1 to A20 are simultaneously energized in the block sequence. Such embodiments are also included in the spirit of the invention.

Figure 65:
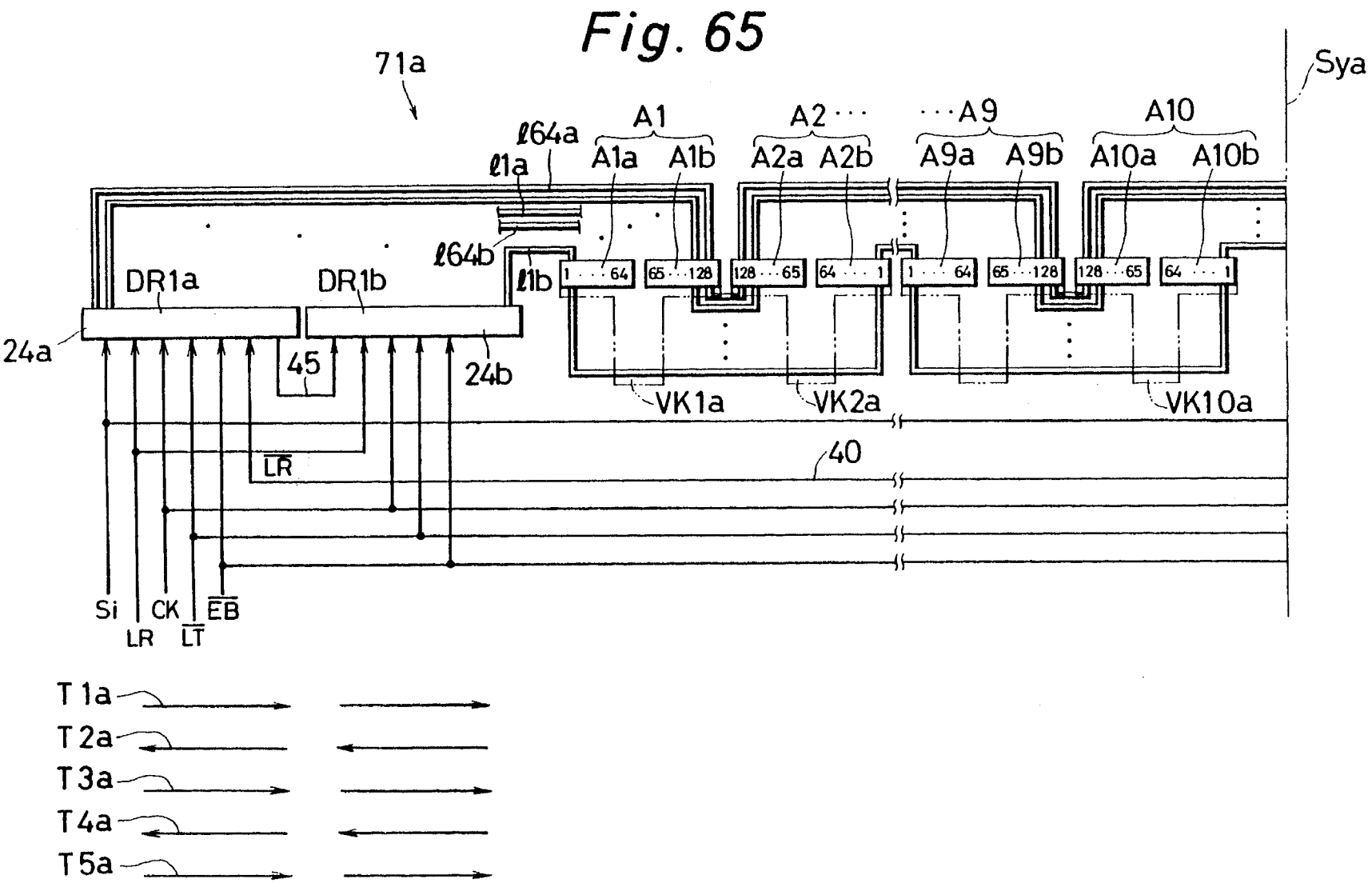
FIG. 65 is a plan view of a structure of a part of the same embodiment.
Figure 66:
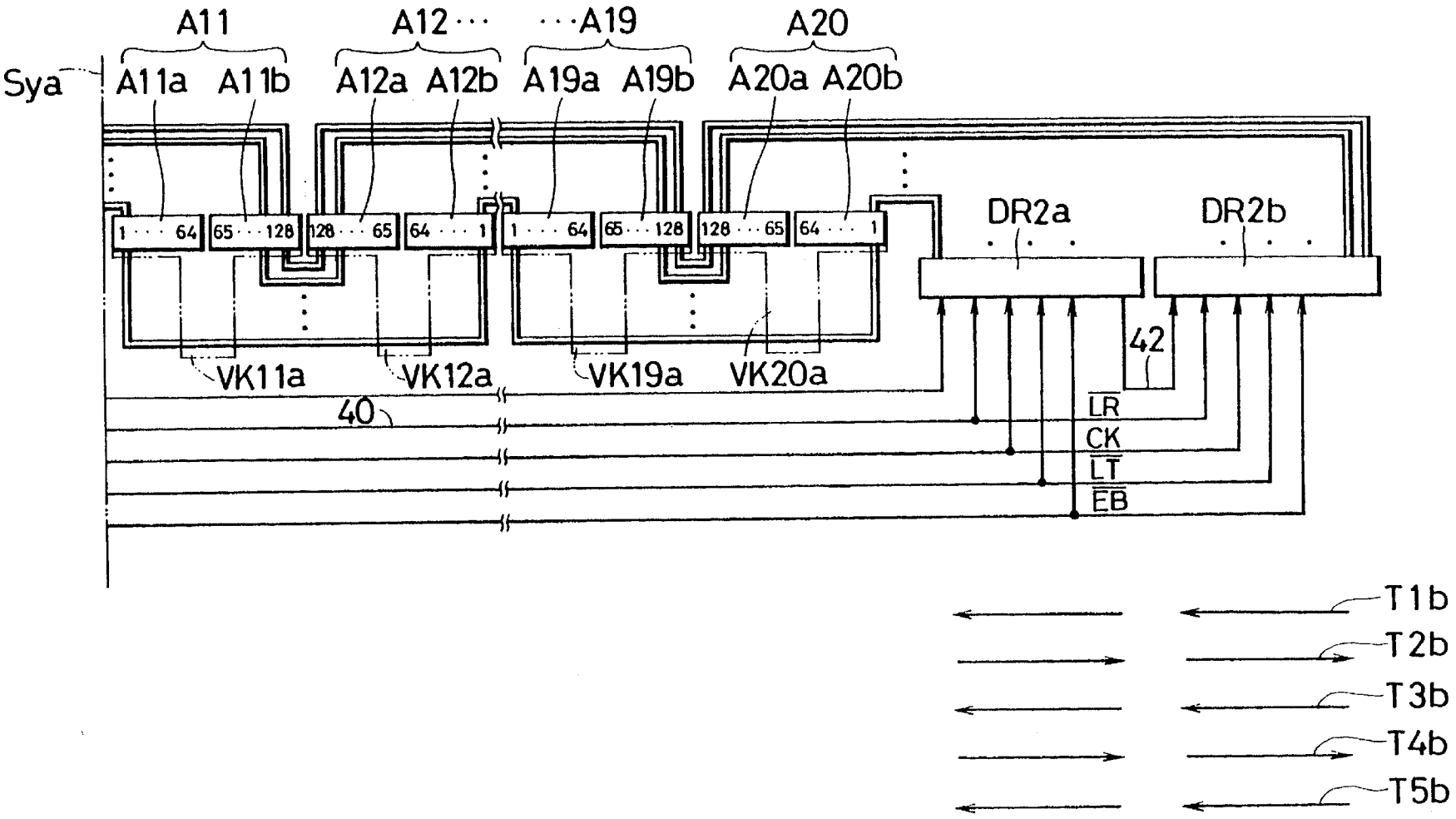
FIG. 66 is a plan view of a structure of the remainder of the same embodiment.
Figures 67, 68, 69, 70, 71, 72:
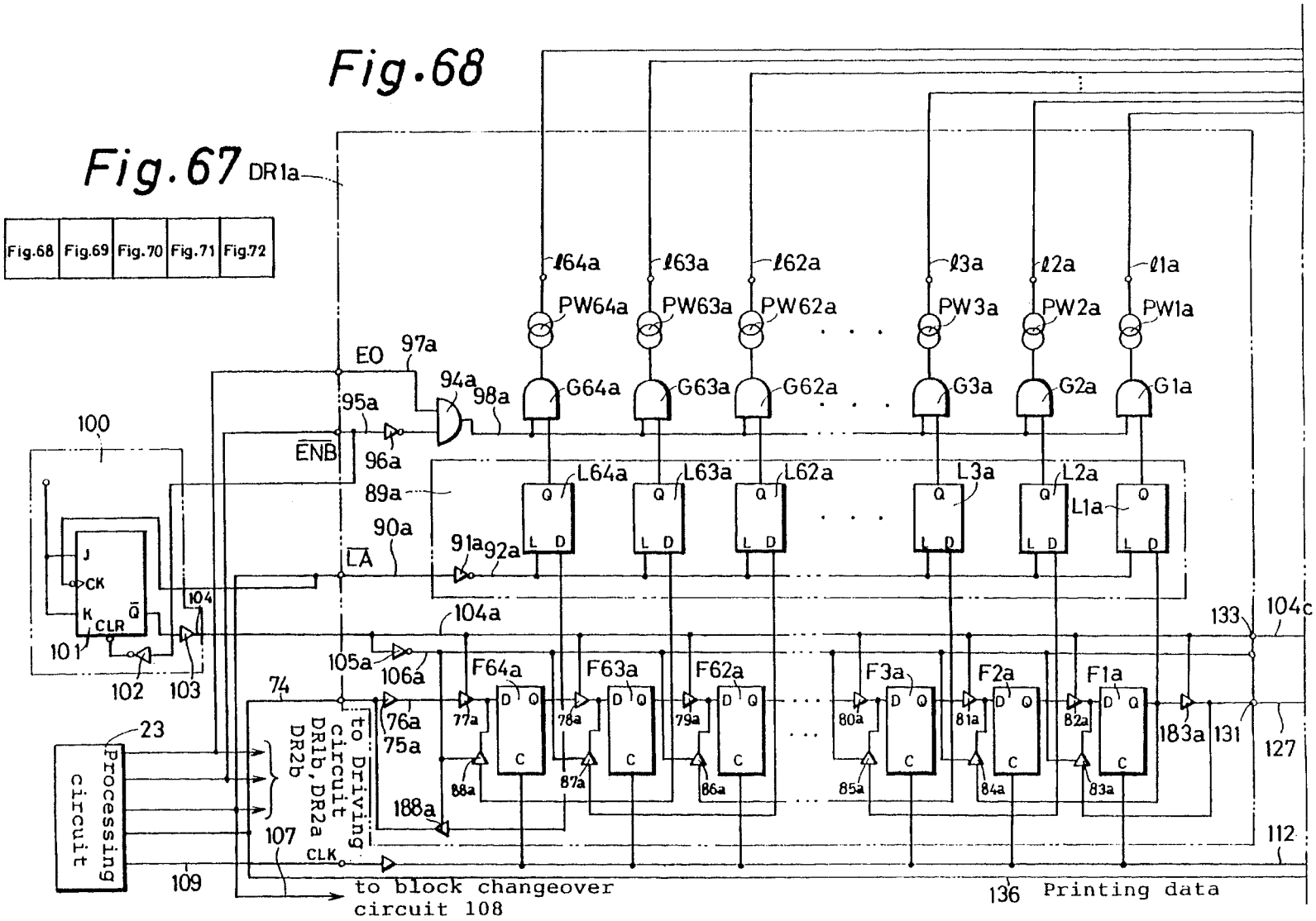
FIG. 67 is a drawing showing the structure of the same embodiment.
FIG. 68 is a block diagram showing a structural example of driving means DR1*a*.
FIG. 69 is a block diagram showing a structural example of driving means DR1*b*.
FIG. 70 is a block diagram showing a structural example of printing means 71.
FIG. 71 is a block diagram showing a structural example of driving means DR2*a*.
FIG. 72 is a block diagram showing a structural example of driving means DR2*b*.
Figure 69:
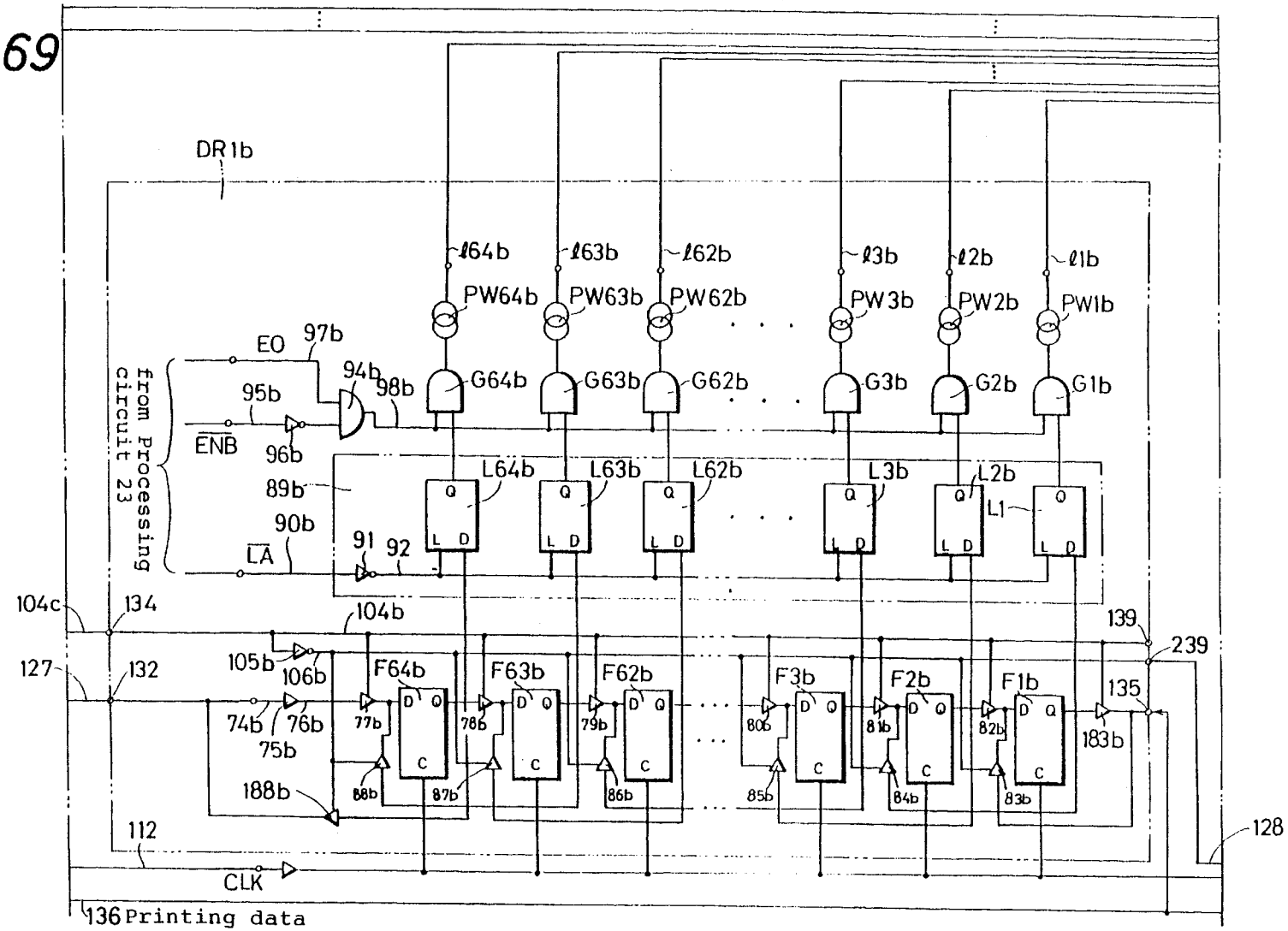
Figure 70:
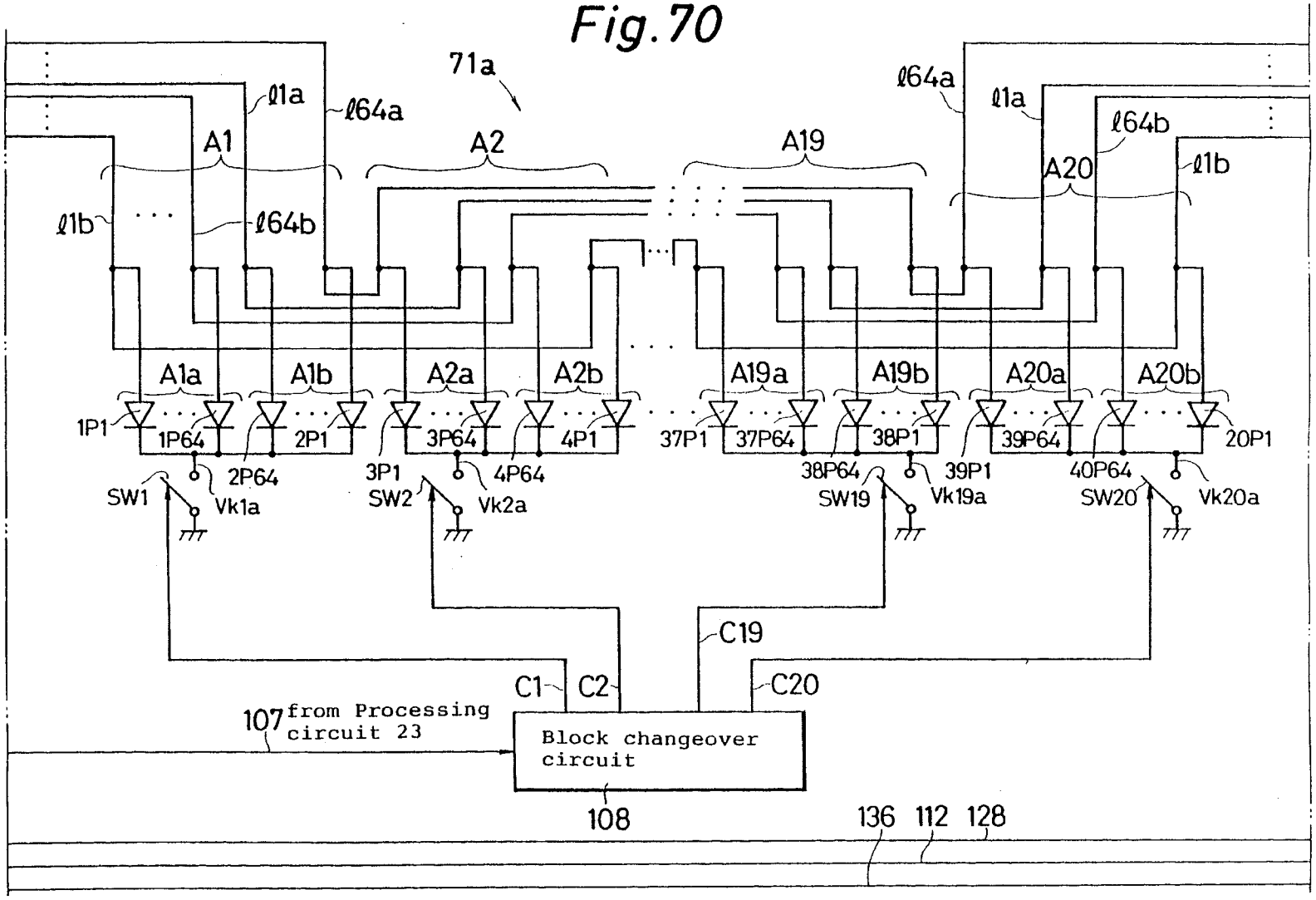
Figure 71:
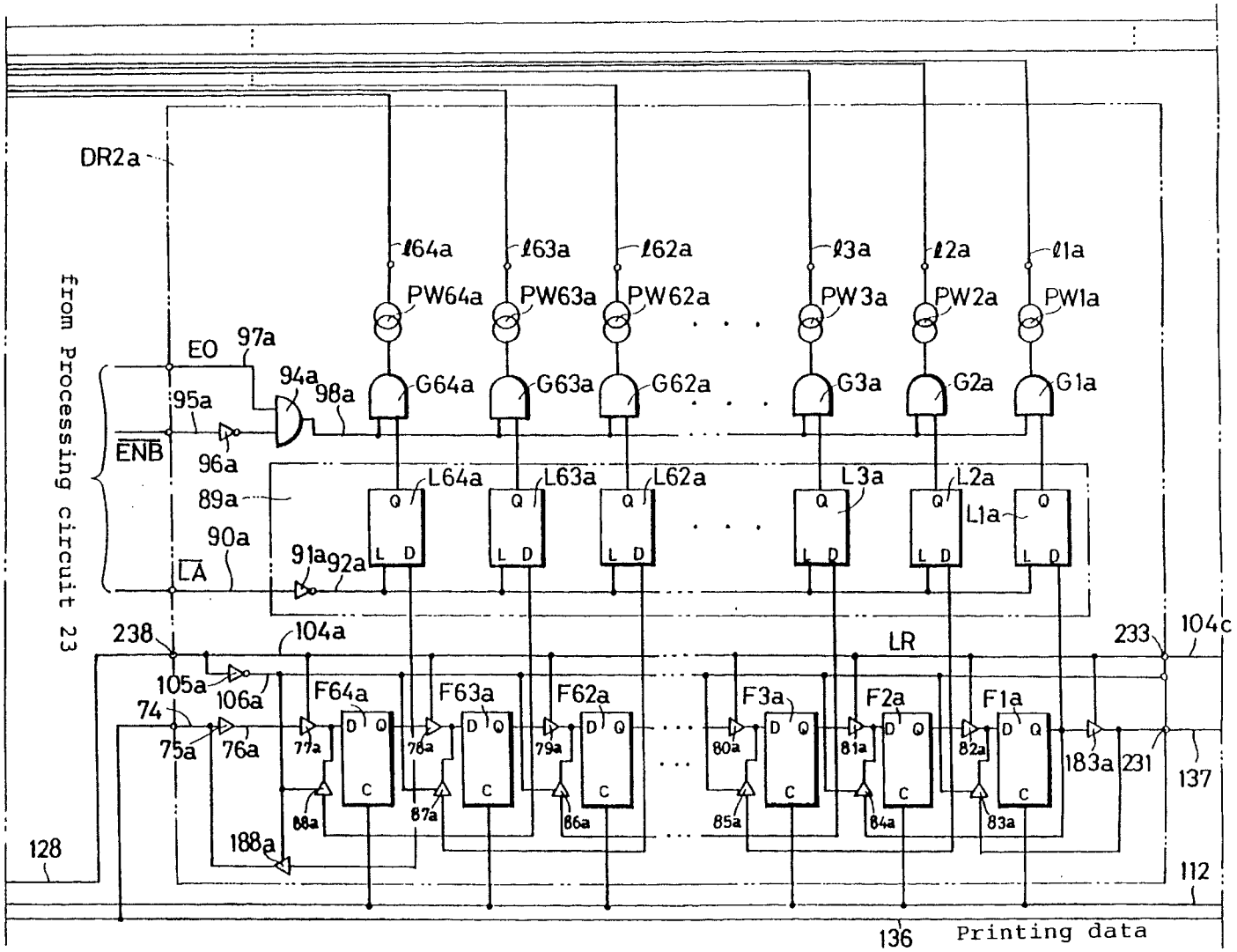
Figure 72:
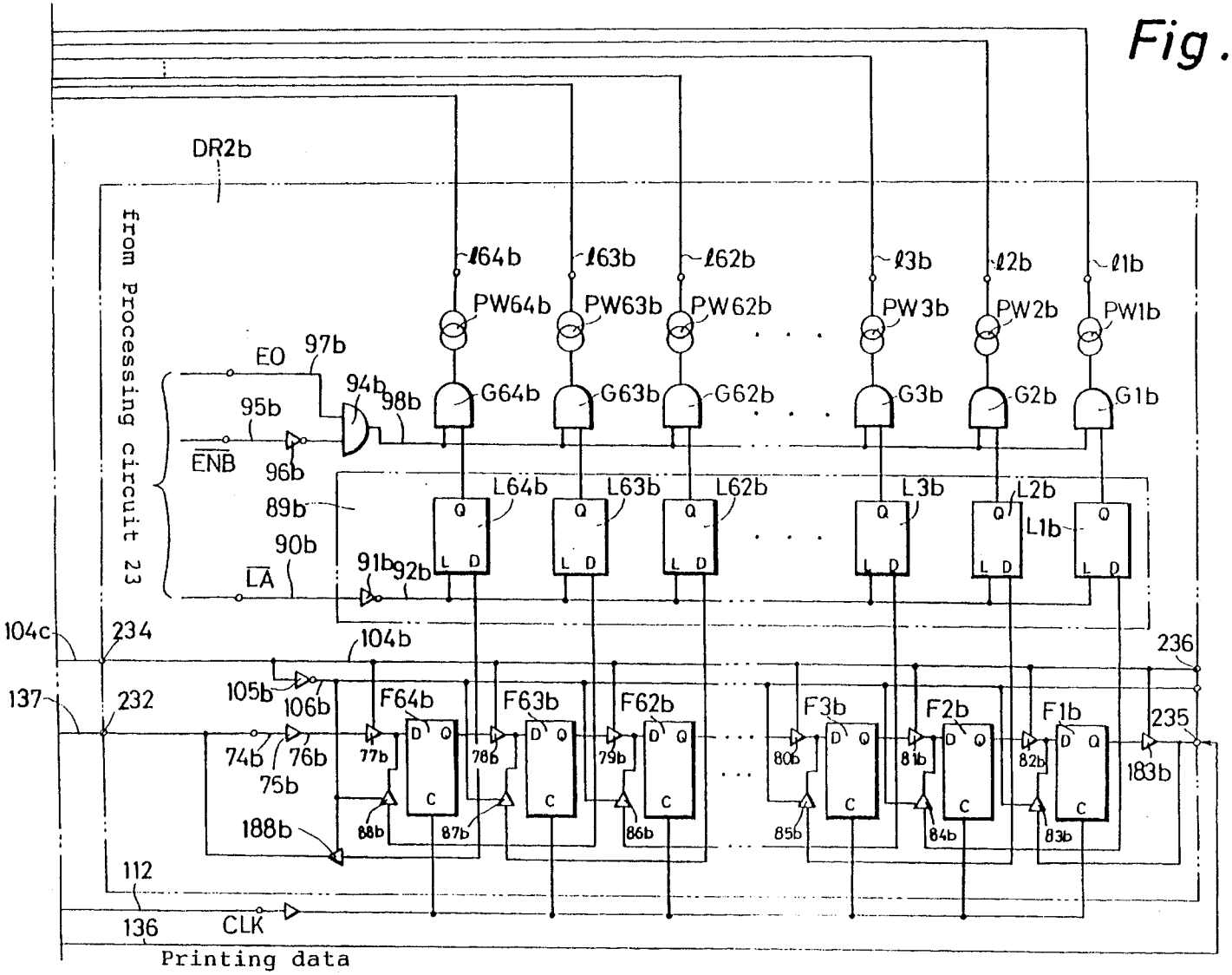

FIG. 64 is an entire simplified block diagram of another embodiment of the invention, FIG. 65 is a plan view of a part of the same embodiment, and FIG. 66 is a plan view of the remaining portion of the same embodiment. This embodiment resembles the foregoing embodiments, and the corresponding parts are identified with the same reference numbers. What is of note in this embodiment is that the printing means 71*a* possesses a total of 20 blocks A1 to A20, and that each of the blocks A1 to A20 possesses plural (two, in this embodiment) block portions A1*a*, A1*b*, . . . , A20*a*, A20*b*. The block portion A1*a* has a total of 64 LEDs, and the block portion A1*b* also has 64 LEDs, and the other blocks possess similarly. At each end in the direction (lateral direction in FIG. 65 and FIG. 66) of arrangement of these blocks A1 to A20, plural (two, in this embodiment) driving means DR1*a*, DR1*b*; DR2*a*, DR2*b* are respectively disposed along the direction of arrangement.

FIG. 67 to FIG. 72 are block diagrams showing practical compositions of image forming apparatus of this embodiment containing driving means DR1*a*, DR1*b*; DR2*a*, DR2*b*. These driving means DR1*a*, DR1*b*; DR2*a*, DR2*b* are similar to the driving meand DR1 mentioned in the foregoing embodiments, and the corresponding parts are indentified with the same reference numbers together with subscripts a, b. In this embodiment, the corresponding lines 104*a*, 104*b* in the driving means DR1*a*, DR1*b* are mutually connected by line 104*c*, by way of terminals 133, 134, and the output of the flip-flop F1*a* of the driving means DR1*a* is applied to the input of the flip-flop F64*b* of the driving means DR1*b* by way of switching element 183*a*, lines 127, 74*b*, terminals 131, 132, buffer 75*b*, and first switching element 77*b*. Furthermore, the print data from the line 74 is applied to the flip-flop F1*b* of the driving means DR1*b* through line 136, by way of terminal 135 and second switching element 83*b*. The output of the flip-flop F64*b* of the driving means DR1*b* is given to the flip-flop F1*a* of the driving means DR1*a* through the second switching element 83*a* by way of the switching element 188*b*, line 127, and terminals 132, 131.

The changeover signal from the driving means DR1*a* through line 104*a* is fed into the line 104*b* of the driving means DR1*b* through line 104*c*, and terminals 133, 134.

The driving means DR2*a*, DR2*b* disposed at the opposite side of the driving means DR1*a*, DR1*b* with respect to the printing means 71 are similar to the driving means DR1*a*, DR1*b* in structure, and the corresponding parts are identified with the same reference numbers. What is of note is that, in the driving means DR1*b*, the inverted changeover signal of the line 106*b* is given to the input terminal 238 of the driving means DR2*a* from the output terminal 137 through the line 128, and is further applied to the line 104*a* of the driving means DR2*a*. To the driving means DR2*b*, the inverted changeover signal from the line 104*a* is given from the output terminal 233 of the driving means DR2*a* through line 104*c*, and it is further given to the input terminal 234 of the driving means DR2*b*. The print data of the flip-flop F1*a* of the driving means DR2*a* is applied to the input terminal 232 of the driving means DR2*b* from the switching element 183*a* through the terminal 231 and line 137. The print data through the line 136 is given from the terminal 235 of the driving means DR2*b* to the flip-flop F1*b* through the switching element 83*b*. Meanwhile, the number of driving means DR1*a*, DR1*b*; DR2*a*, DR2*b* disposed at both ends of the printing means 71 may be three or more, and in such a case, a changeover signal is given to the output terminal 139 of the driving means DR1*b*, and an inverted changeover signal from the output terminal 236 of the driving means DR2*b* may be also given similarly.

When the changeover signal from the output terminal 239 of the driving means DR1*b* is given to the input terminal 238 of the driving means DR2*a* through the line 128, the storing direction of the print data in the driving means DR1*a*, DR1*b*, that is, the transfer direction may be mutually reverse to the storing direction of the print data in the driving means DR2*a*, DR2*b*, that is, the transfer direction.

The operation of this embodiment is similar to that of the embodiments shown in FIG. 53 to FIG. 62. Hence, referring again to FIG. 62, the operation of this embodiment is described below. From the processing circuit 23, a strobe signal $\overline{ENB}$ is led out, and the changeover signal shown in FIG. 62 (2) is led out from the changeover signal generation source 100 into the line 104, and is applied to the driving means DR1*a*, DR1*b*, and when the line 104*a* is at high level, the first switching elements 77*a* to 82*a* conduct, while the second switching elements 83*a* to 88*a* are cut off, and this operation is same as in the other driving means DR1*b*. This changeover signal is inverted in the inverting circuit 105*b* of the driving means DR1*b*, and is applied to the input terminal 238 of the driving means DR2*a* from the output terminal 239 through the line 128, and in consequence, in the driving means DR2*a*, the inverted changeover signal at low level is inverted in the inverting circuit 105*a* again to become high level, so that the second switching elments 83*a* to 88*a* are made to conduct, while the switching elements 77*a* to 82*a*, 183*a* are cut off, and the operation of this driving means DR2*a* is same in the other driving means DR2*b*.

From the processing circuit 23, the print data is generated to the line 74, as shown in FIG. 62 (3), in the direction of arrangement for a total of 128 LEDs of block A1, by the driving means DR1*a*, DR1*b*, that is, generated sequentially from left to right in FIG. 65 and FIG. 66, and is sequentially stored in the flip-flops F1*b* to F64*b*, F1*a* to F64*a* in response to the clock signal CLK shown in FIG. 62. Afterwards, by the latch signal $\overline{LA}$ shown in FIG. 62 (5), the store contents of the flip-flops F1*a* to F64*a*, F1*b* to F64*b* are transferred and latched in the latch circuits L1*a* to L64*a*, L1*b* to L64*b*.

The block changeover signal generation circuit 108 gives a low level signal shown in FIG. 62 (6) for the energization period W1 to the switch SW1 for the common signal line VK1 to conduct the switch SW1 for the period W1, and thus the total 128 LEDS are energized in response to the printing data. While the LEDS of the block A1 are being energized, the printing data for the next block A2 is generated from the processing circuit 23, and a low level signal is led out from the changeover signal generation source 100 to the line 104*a*, and the inverted changeover signal of the line 106*a* conducts the second switching elements 83*a* to 88*a*, 83*b* to 88*b*, and cuts off the first switching elements 77*a* to 82*a*, 77*b* to 82*b* by the driving means DR1*a*, DR1*b*, and the print data generated from the processing circuit 23 in the sequence to the right in FIG. 65 and FIG. 66 of the LEDs contained in the block A2 is stored in the reverse direction indicated by T2*a* in the flip-flops F1*a* to F64*a*, F1*b* to F64*b*, and the LEDs in the block A2 are driven at the next timing. The switches SW2, SW3 are controlled in response to the signal shown in FIG. 62 (7) and (8).

In the driving means DR2, DR2*b*, when the inverted changeover signal is given from the line 106*a* of the driving means DR1*a* through the line 136 as mentioned above, the storing direction of the print data is mutually reverse in the driving means DR1*a*, DR1*b*, and DR2*a*, DR2*b*. As a result, for example, one LED 1P1 contained in the block portion A1*a* in the block A1 is driven by the driving means DR1*b*, and is also driven by the corresponding driving means DR2*a*. Thus, each LED of the printing means 71 is simultaneously driven by the driving means DR1*a*, DR1*b*; DR2*a*, Dr2*b* disposed at the right and left side in the direction of arrangement, and therefore the current for driving is increased, and hence the printing speed may be raised. Moreover, these driving means DR1*a*, DR1*b*; DR2*a*, DR2*b* are basically in the same structure, and hence the productivity may be also enhanced.

In such embodiments as shown in FIG. 64 to FIG. 72, the blocks A1 to A20 contain plural block portions A1*a*, A1*b*; . . . ; A02*a*, A20*b*, and each block portion contains plural LEDs, which are driven as the print data is transferred in every one of the blocks A1 to A20, and hence the entire printing speed may be further increased. Incidentally, the print data may be led out, for example, at 10 MHz from the processing circuit 23, and the time necessary for data transfer of 123 LEDs is 12.8 μsec (=128 dots/10 MHz), and if the energization period W1 is, for example, 22 μsec, it is possible to transfer within this period W1.

The invention is executed not only in relation to the LED head, but also in relation to the heating resistance element of a thermal head, and also to the printing elements in other structures.

The driving means DR1*a*, DR1*b*; DR2*a*, DR2*b* may possess also other constructions.

Thus, according to the invention, plural driving means are disposed at one end or both ends in the direction of arrangement of blocks, and each driving means is designed to drive by supplying an electric power corresponding to the printing data to the printing elements contained in the selected block through the individual signal lines, in response to each one of plural block portions contained in each block, and therefore the number of printing elements simultaneously energized in each block may be increased, and hence the printing speed may be raised. Moreover, by disposing the driving means at both ends in the direction of arrangement of blocks, and simultaneously energizing the printing elements by the driving means disposed at both ends, the current of each printing element may be increased, and hence the printing speed may be further enhanced.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

printing means for forming an image on a recording medium, said printing means having an array of printing blocks, said array having two opposed ends, and a plurality of individual signal lines, each of said individual signal lines having a first end and a second end, wherein each of said blocks contains a plurality of printing elements arranged in an order in a row, and a common signal line, each of said printing elements having a first terminal and a second terminal, each of said individual signal lines is connected to the first terminal of one of said printing elements of each of said blocks such that the printing elements connected to one of said individual signal lines are disposed at symmetric positions on adjacent printing blocks, and the second terminal of said plurality of printing elements in each of said blocks is connected to said common signal line of the respective one of said blocks;

data generating source means for sequentially generating printing data for said printing means in a sequence corresponding to the order of printing elements of each of said blocks;

block selecting means connected between said data generating source means and said common signal lines for selecting each of said blocks in sequence; and first driving means and second driving means each disposed at a respective end of said array of printing blocks and connected to said data generating source means, each said driving means for providing drive signals simultaneously to all printing elements of each of said blocks, wherein said first driving means has outputs connected to said first end of each of said individual signal lines and said second driving means has outputs connected to said second end of each of said individual signal lines so that both of said driving means simultaneously supply power to selected printing elements of one of said blocks corresponding to said drive signals and in response to printing data generated by said data generating means when said one of said blocks is selected by said block selecting means.

2. An image forming apparatus comprising:

an electrically insulating wiring substrate having an upper surface;

a power feeding wiring substrate for supplying driving electric power;

a plurality of light-emitting element arrays disposed above said electrically insulating wiring substrate, each of said arrays having a plurality of light-emitting elements arranged in a straight line, said arrays being disposed adjacent one another so that said light-emitting elements of all of said arrays are arranged in a common straight line;

a plurality of individual signal lines mounted on said upper surface of said electrically insulating wiring substrate, wherein said individual signal lines extend parallel to one another along a path which generally follows said common straight line and which is composed of a series of U-shaped portions which are curved in alternately opposite directions transverse to said common straight line, and each of said individual signal lines is connected to a respective one of said light-emitting elements of each of said arrays;

a plurality of common signal electrodes mounted on said upper surface of said electrically insulating wiring substrate at locations spaced from said individual signal lines, so that said common signal electrodes and said individual signal lines are in a common plane on said upper surface of said electrically insulating wiring substrate, said common signal electrodes extending into regions enclosed in the common plane by said individual signal lines at said U-shaped portions of said path, and each of said common signal electrodes being connected to said light-emitting elements of a respective one of said arrays and to said power feeding wiring substrate, wherein all of said common signal electrodes are disposed entirely to one side of said common straight line; and a housing containing said plurality of light-emitting element arrays, said plurality of individual signal lines and said plurality of common signal electrodes, and wherein said power feeding wiring substrate is located outside of said housing and comprises at least one flexible film and a plurality of flexible thin-film conductors carried by said thin film, each of said flexible thin-film conductors being connected to a respective one of said common signal electrodes.

* * * * *